US011480411B2

(12) United States Patent
Tubb

(10) Patent No.: US 11,480,411 B2
(45) Date of Patent: Oct. 25, 2022

(54) RANGE-FINDING AND COMPENSATING SCOPE WITH BALLISTIC EFFECT COMPENSATING RETICLE, AIM COMPENSATION METHOD AND ADAPTIVE METHOD FOR COMPENSATING FOR VARIATIONS IN AMMUNITION OR VARIATIONS IN ATMOSPHERIC CONDITIONS

(71) Applicant: G. David Tubb, Canadian, TX (US)

(72) Inventor: G. David Tubb, Canadian, TX (US)

( * ) Notice: Subject to any disclaimer, the term of this patent is extended or adjusted under 35 U.S.C. 154(b) by 0 days.

(21) Appl. No.: 16/370,953

(22) Filed: Mar. 30, 2019

(65) Prior Publication Data

US 2020/0018566 A1 Jan. 16, 2020

Related U.S. Application Data

(63) Continuation-in-part of application No. 16/253,169, filed on Jan. 21, 2019, now Pat. No. 10,591,239, and (Continued)

(51) Int. Cl.
*F41G 1/38* (2006.01)
*F41G 3/06* (2006.01)

(52) U.S. Cl.
CPC ..... *F41G 1/38* (2013.01); *F41G 3/06* (2013.01)

(58) Field of Classification Search
CPC ... F41G 1/38; F41G 1/473; F41G 3/06; F41G 3/065; F41G 3/2683; F41G 3/2688; F41G 3/08

(Continued)

(56) References Cited

U.S. PATENT DOCUMENTS 197,397 A 11/1877 O'Neil
252,240 A 1/1882 Morris (Continued)

FOREIGN PATENT DOCUMENTS

DE 3401855 7/1985
DE 3834924 4/1990

(Continued)

OTHER PUBLICATIONS

Aerodynamic Jump Caused by the Wind, http://bisonballistics.com/system/uploaded_files/9/original/aerodynamic_jump_target.png. Bison Ballistics, printed Dec. 30, 2011.

(Continued)

*Primary Examiner* — Joshua E Freeman
*Assistant Examiner* — Benjamin S Gomberg
(74) *Attorney, Agent, or Firm* — J. Andrew McKinney, Jr.; McKinney & Associates, LLC

(57) ABSTRACT

A range-finding and ballistics effect compensating scope 804 with a ballistic effect compensating reticle aim point field 650 and ammunition adaptive aim compensation method for rifle sights or projectile weapon aiming systems includes (a) a primary aiming point 658 adapted to be sighted-in at a first selected range and (b) the locus of the RF beam for sensing range 29 to a selected target 28. The when firing, the reticle's aim point field also includes a sloped array of wind dots (e.g., 660) illustrating aim points for a range of crosswind conditions. The method for compensating for a projectile's ballistic behavior permits the shooter to sense or measure the LOS range to target 29 and sense or input the slope angle 27 and local or nominal air density ballistic characteristics (e.g., air density), and then display corrected hold points.

17 Claims, 29 Drawing Sheets

Related U.S. Application Data a continuation-in-part of application No. 15/419,793, filed on Jan. 30, 2017, now Pat. No. 10,371,485, said application No. 16/253,169 is a continuation of application No. 15/224,646, filed on Jul. 31, 2016, now Pat. No. 10,184,752, said application No. 15/419,793 is a continuation of application No. 14/216,674, filed on Mar. 17, 2014, now Pat. No. 9,581,415, which is a continuation of application No. 13/947,858, filed on Jul. 22, 2013, now Pat. No. 9,557,142, which is a continuation of application No. 13/342,197, filed on Jan. 2, 2012, now Pat. No. 8,701,330.

(60) Provisional application No. 62/650,602, filed on Mar. 30, 2018, provisional application No. 61/437,990, filed on Jan. 31, 2011, provisional application No. 61/429,128, filed on Jan. 1, 2011.

(58) Field of Classification Search
USPC ..... 42/119, 122, 130, 142
See application file for complete search history.

(56) References Cited

U.S. PATENT DOCUMENTS

| | | | |
|---|---|---|---|
| D14,355 | S | 10/1883 | Dressel |
| 912,050 | A | 2/1909 | Wanee |
| 1,006,699 | A | 10/1911 | Straubel |
| 1,107,163 | A | 8/1914 | Grauheding |
| 1,127,230 | A | 2/1915 | Grauheding |
| 1,190,121 | A | 7/1916 | Critchett |
| 1,406,620 | A | 2/1922 | Dear |
| 1,425,321 | A | 8/1922 | Etherington |
| 1,428,389 | A | 9/1922 | Miller |
| 1,540,772 | A | 6/1925 | Gibbs |
| 1,851,189 | A | 3/1932 | King |
| 2,090,930 | A | 8/1937 | Schaffner |
| 2,094,623 | A | 10/1937 | Stokey |
| 2,150,629 | A | 3/1939 | Mossberg |
| 2,154,454 | A | 4/1939 | Joyce |
| 2,171,571 | A | 9/1939 | Karnes |
| 2,417,451 | A | 3/1947 | Schaffner |
| 2,420,273 | A | 5/1947 | West |
| 2,450,712 | A | 10/1948 | Brown |
| 2,464,521 | A | 3/1949 | McCall |
| 2,486,940 | A | 11/1949 | Garber et al. |
| 2,615,252 | A | 10/1952 | Wing |
| 2,806,287 | A | 9/1957 | Sullivan |
| 2,807,981 | A | 10/1957 | Barnes |
| 2,823,457 | A | 2/1958 | Mihalyi |
| 2,891,445 | A | 6/1959 | Staubach |
| 2,949,816 | A | 8/1960 | Weaver |
| 2,955,512 | A | 10/1960 | Kollmorgen et al. |
| 3,058,391 | A | 10/1962 | Leupold |
| 3,190,003 | A | 6/1965 | O'Brien |
| 3,229,370 | A | 1/1966 | Plisk et al. |
| 3,297,389 | A | 1/1967 | Gibson |
| 3,313,026 | A | 4/1967 | Akin, Jr. |
| 3,381,380 | A | 5/1968 | Thomas |
| D211,467 | S | 6/1968 | Wilbur |
| 3,392,450 | A | 7/1968 | Herter et al. |
| 3,410,644 | A | 11/1968 | McLendon |
| 3,431,652 | A | 3/1969 | Leatherwood |
| 3,470,616 | A | 10/1969 | Thompson |
| 3,492,733 | A | 2/1970 | Leatherwood |
| 3,540,256 | A | 11/1970 | Thompson |
| 3,575,085 | A | 4/1971 | McAdam, Jr. |
| 3,682,552 | A | 8/1972 | Hartman |
| 3,684,376 | A | 8/1972 | Lessard |
| 3,743,818 | A | 7/1973 | Marasco et al. |
| 3,744,133 | A | 7/1973 | Fukushima et al. |
| 3,744,143 | A | 7/1973 | Kilpatrick |
| 3,749,494 | A | 7/1973 | Hodges |
| 3,777,404 | A | 12/1973 | Oreck |
| 3,782,822 | A | 1/1974 | Spence |
| 3,798,796 | A | 3/1974 | Stauff et al. |
| 3,826,012 | A | 7/1974 | Pachmayr |
| 3,876,304 | A | 4/1975 | Novak |
| 3,902,251 | A | 9/1975 | Ross |
| 3,948,587 | A | 4/1976 | Rubbert |
| 4,014,482 | A | 3/1977 | Esker et al. |
| 4,102,053 | A | 7/1978 | Colwell |
| 4,132,000 | A | 1/1979 | Dulude |
| 4,244,586 | A | 1/1981 | Gorrow |
| 4,247,161 | A | 1/1981 | Unertl, Jr. |
| 4,248,496 | A | 2/1981 | Akin, Jr. et al. |
| 4,255,013 | A | 3/1981 | Allen |
| 4,263,719 | A | 4/1981 | Murdoch |
| 4,285,137 | A | 8/1981 | Jennie |
| 4,389,791 | A | 6/1983 | Ackerman |
| 4,395,096 | A | 7/1983 | Gibson |
| 4,403,421 | A | 9/1983 | Shepherd |
| 4,408,842 | A | 10/1983 | Gibson |
| 4,458,436 | A | 7/1984 | Bohl |
| 4,497,548 | A | 2/1985 | Burris |
| 4,531,052 | A | 7/1985 | Moore |
| 4,561,204 | A | 12/1985 | Binion |
| 4,584,776 | A | 4/1986 | Shepherd |
| 4,616,421 | A | 10/1986 | Forsen |
| 4,618,221 | A | 10/1986 | Thomas |
| 4,627,171 | A | 12/1986 | Dudney |
| D288,465 | S | 2/1987 | Darnall et al. |
| 4,671,165 | A | 6/1987 | Heidmann et al. |
| 4,695,161 | A | 9/1987 | Reed |
| 4,777,352 | A | 10/1988 | Moore |
| 4,787,739 | A | 11/1988 | Gregory |
| 4,806,007 | A | 2/1989 | Bindon |
| H613 | H | 4/1989 | Stello et al. |
| 4,833,786 | A | 5/1989 | Shores, Sr. |
| D306,173 | S | 2/1990 | Reese |
| 4,912,853 | A | 4/1990 | McDonnell et al. |
| 4,949,089 | A | 8/1990 | Ruszkowski, Jr. |
| 4,957,357 | A | 9/1990 | Barns et al. |
| 4,965,439 | A | 10/1990 | Moore |
| 5,026,158 | A | 6/1991 | Golubic |
| 5,157,839 | A | 10/1992 | Beutler |
| 5,171,933 | A | 12/1992 | Eldering |
| 5,181,323 | A | 1/1993 | Cooper |
| 5,181,719 | A | 1/1993 | Cleveland, III |
| 5,194,908 | A | 3/1993 | Lougheed et al. |
| 5,223,560 | A | 6/1993 | Cipolli et al. |
| 5,223,650 | A | 6/1993 | Finn |
| 5,375,072 | A | 12/1994 | Cohen |
| 5,415,415 | A | 5/1995 | Mujic |
| 5,454,168 | A | 10/1995 | Langner |
| 5,469,414 | A | 11/1995 | Okamura |
| 5,491,546 | A | 2/1996 | Wascher et al. |
| 5,616,903 | A | 4/1997 | Springer |
| 5,631,654 | A | 5/1997 | Karr |
| 5,657,571 | A | 8/1997 | Peterson |
| 5,672,840 | A | 9/1997 | Sage et al. |
| 5,781,505 | A | 7/1998 | Rowland |
| D397,704 | S | 9/1998 | Reese |
| D403,686 | S | 1/1999 | Reese |
| 5,860,655 | A | 1/1999 | Starrett |
| 5,887,352 | A | 3/1999 | Kim |
| 5,920,995 | A | 7/1999 | Sammut |
| 5,960,576 | A | 10/1999 | Robinson |
| 6,025,908 | A | 2/2000 | Houde-Walter |
| 6,032,374 | A | 3/2000 | Sammut |
| 6,041,508 | A | 3/2000 | David |
| 6,049,987 | A | 4/2000 | Robell |
| 6,058,921 | A | 5/2000 | Lawrence et al. |
| 6,064,196 | A | 5/2000 | Oberlin et al. |
| 6,213,470 | B1 | 4/2001 | Miller |
| 6,252,706 | B1 | 6/2001 | Kaladgew |
| 6,269,581 | B1 | 8/2001 | Groh |
| 6,357,158 | B1 | 3/2002 | Smith, III |
| D455,811 | S | 4/2002 | Fedio, Jr. |
| D456,057 | S | 4/2002 | Smith, III |
| 6,453,595 | B1 | 9/2002 | Sammut |
| 6,516,551 | B2 | 2/2003 | Gaber |
| 6,516,699 | B2 | 2/2003 | Sammut et al. |

(56) References Cited

U.S. PATENT DOCUMENTS

| | | | | |
|---|---|---|---|---|
| 6,568,092 | B1 | 5/2003 | Brien | |
| D475,758 | S | 6/2003 | Ishikawa | |
| 6,574,900 | B1 | 6/2003 | Malley | |
| 6,591,537 | B2 | 7/2003 | Smith | |
| 6,681,512 | B2 | 1/2004 | Sammut | |
| 6,729,062 | B2 | 5/2004 | Thomas et al. | |
| 6,772,550 | B1 | 8/2004 | Leatherwood | |
| 6,813,025 | B2 | 11/2004 | Edwards | |
| 6,862,832 | B2 | 3/2005 | Barrett | |
| 6,886,287 | B1 | 5/2005 | Bell et al. | |
| D506,520 | S | 6/2005 | Timm et al. | |
| D517,153 | S | 3/2006 | Timm et al. | |
| D536,762 | S | 2/2007 | Timm et al. | |
| 7,171,776 | B2 | 2/2007 | Staley, III | |
| 7,185,455 | B2 | 3/2007 | Zaderey | |
| 7,325,353 | B2 | 2/2008 | Cole et al. | |
| 7,516,571 | B2 * | 4/2009 | Scrogin | F41G 1/38 42/114 |
| 7,603,804 | B2 * | 10/2009 | Zaderey | F41G 1/38 42/119 |
| 7,712,225 | B2 | 5/2010 | Sammut | |
| 7,748,155 | B2 | 7/2010 | Cole | |
| 7,832,137 | B2 * | 11/2010 | Sammut | F41G 1/473 235/404 |
| 7,905,046 | B2 * | 3/2011 | Smith, III | F41G 1/38 235/404 |
| 8,201,741 | B2 | 6/2012 | Bennetts et al. | |
| 8,353,454 | B2 * | 1/2013 | Sammut | F41G 1/38 235/404 |
| 8,584,944 | B2 * | 11/2013 | White | G06G 1/0057 235/380 |
| 9,091,507 | B2 | 7/2015 | Paterson et al. | |
| 9,482,516 | B2 | 11/2016 | McCarthy et al. | |
| 2002/0124452 | A1 | 9/2002 | Sammut | |
| 2002/0129535 | A1 | 9/2002 | Osborn, II | |
| 2004/0016168 | A1 | 1/2004 | Thomas et al. | |
| 2004/0020099 | A1 | 2/2004 | Osborn, II | |
| 2004/0088898 | A1 | 5/2004 | Barrett | |
| 2005/0005495 | A1 | 1/2005 | Smith | |
| 2005/0021282 | A1 | 1/2005 | Sammut et al. | |
| 2005/0229468 | A1 | 10/2005 | Zaderey et al. | |
| 2005/0257414 | A1 | 11/2005 | Zaderey et al. | |
| 2006/0260171 | A1 | 11/2006 | Cole et al. | |
| 2007/0044364 | A1 | 3/2007 | Sammut et al. | |
| 2008/0061509 | A1 | 3/2008 | Potterfield | |
| 2008/0098640 | A1 | 5/2008 | Sammut et al. | |
| 2009/0199451 | A1 | 8/2009 | Zaderey et al. | |
| 2010/0038854 | A1 | 2/2010 | Mraz | |

FOREIGN PATENT DOCUMENTS

| | | |
|---|---|---|
| DE | 20008101 | 9/2000 |
| GB | 2094950 | 9/1982 |
| GB | 2294133 | 4/1996 |
| JP | 55-036823 | 3/1980 |
| WO | 9601404 | 1/1996 |
| WO | 9737193 | 10/1997 |
| WO | 2103274 | 12/2002 |

OTHER PUBLICATIONS

Chung, Gregory K. W. K., Nagashima, Sam O., Delacruz, Girlie C., Lee, John J., Wainess, Richard and Baker, Eva L., Review of Rifle Marksmanship Training Research, Cresst Report 783, The National Center for Research on Evaluation, Standards, and Student Testing, Jan. 2011.

Johnson, Richard F., Statistical Measures of Marksmanship, USARIEM Technical Note TN-01/2, U.S. Army Research Institute of Environmental Medicine, Feb. 2001.

Military Handbook: Range Facilities and Miscellaneous Training Facilities Other than Buildings, http://www.everyspec.com, MIL-HDBK-1027/3A, Jan. 31, 1989.

Military Specification: Propellants for Small Arms Ammunition, http://www.everyspec.com, MIL-P-3984J Amendment 3, Jun. 12, 2000.

Military Specification: Rifle, 7.62MM, Sniper w/Day Optical Sight and Carrying Cases, M24, http://www.everyspec.com, MIL-R-71126 (AR), Sep. 24, 1992.

Northwinds Flags, RFC-USBR Windrose, https://sites.google.com/a/wildblue.net/northwind-flags/home/Wind-Rose-2.jpg, printed Dec. 30, 2011.

Performance Specification: Rifle, 7.62MM; Semi-Automatic Sniper System (SASS)—M110, MIL-PRF-32316 (W/Amendment 1), Oct. 5, 2009.

Rifle Marksmanship M16A1, M16A2/3, M16A4, and M4 Carbine, C 4, FM 3-22.9, Department of the Army, Sep. 13, 2006.

Von Wahlde, Raymond & Metz, Dennis, Sniper Weapon Fire Control Error Budget Analysis, US Army ARL-TR-2065, Aug. 1999—arl.army.mil.

"http://www.aircav.com/cobra/ballistic.html", printed Dec. 30, 2011, discussion of ballistics, interior, exterior, aerial, terminal and dispersion.

"http://www.hnsa.org/doc/firecontrol/partc.htm", printed Dec. 30, 2011, discussion of the projectile in flight-exterior ballistics.

Jonathan M. Weaver, Jr., LTC, USA Ret., Infantry, System Error Budgets, Target Distributions and Hitting Performance Estimates for General-Purpose Rifles and Sniper Rifles of 7.62x51 mm and Larger Calibers, AD-A228 398, TR-461, AMSAA, May 1990.

Kent, R.H. and E.J. McShane, An Elementary Treatment of the Motion of a Spinning Projectile About it's Center of Gravity, Aberdeen Proving Grounds ("APG"), MD, BRL Memorandum Report No. 85, Apr. 1944.

Leupold® America's Optics Authority®: Ballistics Aiming System®.

Leupold® Tactical Optics: Using the Tactical Reticle System—Mil Dot/TMR®/SPR®/CM-R$^{2TM}$ Usage Instructions.

Leupold®: Ballistics Reticle Supplement.

US Army FM-23-10, Sniper Training, United States Army Infantry School ATSH-IN-S3, Fort Benning, GA 31905-5596, Aug. 1994.

USMC MCWP 3-15.3 (formerly FMFM 1-3B), Sniping, PCN 143 000118 00, Doctrine Division (C42) US Marine Corps Combat Development Command, 2 Broadway Street Suite 210 Quantico, VA 22134-5021, May 2004.

* cited by examiner

FIG. 4 Sight Picture During LRF Range Sensing

DA Adaptability
Compare VELOCITY and BULLET PATH columns to see the effect varying DA has on the bullet
2K Trajectory for Sierra Bullets .308 dia. 175 gr. HPBT MatchKing at 2630 Feet per Second
At an Elevation Angle of: 0 degrees
Ballistic Coefficients of: 0.605 0.496 0.485 0.485 0.485
Velocity Boundaries (Feet per Second) of: 2800 1800 1800 1800
Wind Direction is: 3.0 o'clock and a Wind Velocity of 0.0 Cross Range: 0.0 Vertical: 0.0
The Firing Point speed of sound is :1111.05 fps
The bullet drops below the speed of sound on the trajectory (1111.27 fps) at: 1169 yards
Altitude: 0 feet Humidity: 0 Percent Pressure: 27.82 In/Hg
Temperature: 50.5 F
Data Printed in English Units

| Range (Yards) | VELOCITY (Ft/Sec) | Energy (Ft/Lbs) | Bullet Path (Inches) | BULLET PATH (1 MOA) | Wind Drift (Inches) | Wind Drift (1 MOA) | Wind Drift (Seconds) |
|---|---|---|---|---|---|---|---|
| 0 | 2630 | 2687.3 | -2.8 | 0 | 0 | 0 | 0 |
| 100 | 2460.4 | 2352 | 0 | 0 | 0 | 0 | 0.1179 |
| 200 | 2297.1 | 2050 | -2.95 | -1.4 | 0 | 0 | 0.2441 |
| 300 | 2140 | 1779.2 | -12.5 | -4 | 0 | 0 | 0.3794 |
| 400 | 1989 | 1537.1 | -29.65 | -7.1 | 0 | 0 | 0.5249 |
| 500 | 1844.7 | 1322.1 | -55.61 | -10.6 | 0 | 0 | 0.6815 |
| 600 | 1705.6 | 1130.2 | -91.8 | -14.6 | 0 | 0 | 0.8506 |
| 700 | 1573.9 | 962.4 | -139.97 | -19.1 | 0 | 0 | 1.0338 |
| 800 | 1451.9 | 818.9 | -202.2 | -24.1 | 0 | 0 | 1.2323 |
| 900 | 1340.9 | 698.6 | -280.96 | -29.8 | 0 | 0 | 1.4475 |
| 1000 | 1242.8 | 600.1 | -379.08 | -36.2 | 0 | 0 | 1.6801 |
| 1100 | 1159.4 | 522.2 | -499.74 | -43.4 | 0 | 0 | 1.9304 |
| 1200 | 1091.5 | 462.8 | -646.28 | -51.4 | 0 | 0 | 2.1976 |

FIG. 10A

DA Adaptability
Compare VELOCITY and BULLET PATH columns to see the effect varying DA has on the bullet
3K Trajectory for Sierra Bullets .308 dia. 175 gr. HPBT MatchKing at 2600 Feet per Second
At an Elevation Angle of: 0 degrees
Ballistic Coefficients of: 0.505 0.496 0.485 0.485 0.485
Velocity Boundaries (Feet per Second) of: 2800 1800 1800 1800
Wind Direction is: 3.0 o'clock and a Wind Velocity of 0.0 Cross Range: 0.0 Vertical: 0.0
The Firing Point speed of sound is :1106.8 fps
The bullet drops below the speed of sound on the trajectory (1107.02 fps) at: 1191 yards
Altitude: 0 feet Humidity: 0 Percent Pressure: 26.83 In/Hg
Temperature: 48.5999884741211 F
Data Printed in English Units

| Range (Yards) | VELOCITY (Ft/Sec) | Energy (Ft/Lbs) | Bullet Path (Inches) | BULLET PATH (1 MOA) | Wind Drift (Inches) | Wind Drift (1 MOA) | Wind Drift (Seconds) |
|---|---|---|---|---|---|---|---|
| 0 | 2600 | 2626.3 | -2.8 | 0 | 0 | 0 | 0 |
| 100 | 2436.5 | 2306.3 | 0 | 0 | 0 | 0 | 0.1192 |
| 200 | 2278.8 | 2017.5 | -3.06 | -1.5 | 0 | 0 | 0.2465 |
| 300 | 2126.9 | 1757.6 | -12.83 | -4.1 | 0 | 0 | 0.3828 |
| 400 | 1980.9 | 1524.6 | -30.3 | -7.2 | 0 | 0 | 0.529 |
| 500 | 1841.2 | 1317 | -56.64 | -10.8 | 0 | 0 | 0.6861 |
| 600 | 1706.1 | 1130.9 | -93.25 | -14.8 | 0 | 0 | 0.8553 |
| 700 | 1578 | 967.5 | -141.83 | -19.3 | 0 | 0 | 1.0382 |
| 800 | 1458.9 | 827 | -204.4 | -24.4 | 0 | 0 | 1.236 |
| 900 | 1350.2 | 708.2 | -283.33 | -30.1 | 0 | 0 | 1.4499 |
| 1000 | 1253.2 | 610.1 | -381.37 | -36.4 | 0 | 0 | 1.6808 |
| 1100 | 1169.8 | 531.6 | -501.57 | -43.5 | 0 | 0 | 1.9289 |
| 1200 | 1100.9 | 470.9 | -647.2 | -647.2 | 0 | 0 | 2.1937 |

FIG. 10B

DA Adaptability
Compare VELOCITY and BULLET PATH columns to see the effect varying DA has on the bullet
4K Trajectory for Sierra Bullets .308 dia. 175 gr. HPBT MatchKing at 2565 Feet per Second
At an Elevation Angle of: 0 degrees
Ballistic Coefficients of: 0.505 0.496 0.485 0.485 0.485
Velocity Boundaries (Feet per Second) of: 2800 1800 1800 1800
Wind Direction is: 3.0 o'clock and a Wind Velocity of 0.0 Cross Range: 0.0 Vertical: 0.0
The Firing Point speed of sound is :1103.95 fps
The bullet does not drop below the speed within the max range specified.
Altitude: 0 feet Humidity: 0 Percent Pressure: 25.48 In/Hg
Temperature: 44 F
Data Printed in English Units

| Range (Yards) | VELOCITY (Ft/Sec) | Energy (Ft/Lbs) | Bullet Path (Inches) | BULLET PATH (1 MOA) | Wind Drift (Inches) | Wind Drift (1 MOA) | Wind Drift (Seconds) |
|---|---|---|---|---|---|---|---|
| 0 | 2565 | 2556.1 | -2.8 | 0 | 0 | 0 | 0 |
| 100 | 2410.1 | 2256.8 | 0 | 0 | 0 | 0 | 0.1207 |
| 200 | 2260.6 | 1985.4 | -3.19 | -1.5 | 0 | 0 | 0.2492 |
| 300 | 2116.3 | 1740.1 | -13.2 | -4.2 | 0 | 0 | 0.3864 |
| 400 | 1977.4 | 1519.1 | -30.97 | -7.4 | 0 | 0 | 0.533 |
| 500 | 1844.1 | 1321.1 | -57.65 | -11 | 0 | 0 | 0.6901 |
| 600 | 1715 | 1142.8 | -94.57 | -15.1 | 0 | 0 | 0.8588 |
| 700 | 1592.1 | 984.8 | -143.33 | -19.6 | 0 | 0 | 1.040 |
| 800 | 1477.2 | 847.8 | -205.83 | -24.6 | 0 | 0 | 1.2361 |
| 900 | 1371.4 | 730.7 | -284.29 | -30.2 | 0 | 0 | 1.447 |
| 1000 | 1276 | 632.6 | -381.27 | -36.4 | 0 | 0 | 1.674 |
| 1100 | 1192.5 | 552.5 | -499.62 | -43.4 | 0 | 0 | 1.9175 |
| 1200 | 1122.1 | 489.2 | -642.45 | -51.1 | 0 | 0 | 2.1773 |

FIG. 10C

DA Adaptability
Compare VELOCITY and BULLET PATH columns to see the effect varying DA has on the bullet
5K Trajectory for Sierra Bullets .308 dia. 175 gr. HPBT MatchKing at 2550 Feet per Second
At an Elevation Angle of: 0 degrees
Ballistic Coefficients of: 0.505 0.496 0.485 0.485 0.485
Velocity Boundaries (Feet per Second) of: 2800 1800 1800 1800
Wind Direction is: 3.0 o'clock and a Wind Velocity of 0.0 Cross Range: 0.0 Vertical: 0.0
The Firing Point speed of sound is :1099.56 fps
The bullet does not drop below the speed within the max range specified.
Altitude: 0 feet Humidity: 0 Percent Pressure: 24.88 In/Hg
Temperature: 40 F
Data Printed in English Units

| Range (Yards) | VELOCITY (Ft/Sec) | Energy (Ft/Lbs) | Bullet Path (Inches) | BULLET PATH (1 MOA) | Wind Drift (Inches) | Wind Drift (1 MOA) | Wind Drift (Seconds) |
|---|---|---|---|---|---|---|---|
| 0 | 2550 | 2526.3 | -2.8 | 0 | 0 | 0 | 0 |
| 100 | 2398.3 | 2234.6 | 0 | 0 | 0 | 0 | 0.1224 |
| 200 | 2251.7 | 1969.9 | -3.25 | -1.6 | 0 | 0 | 0.2525 |
| 300 | 2110.2 | 1730.1 | -13.37 | -4.3 | 0 | 0 | 0.3909 |
| 400 | 1973.9 | 1513.8 | -31.3 | -7.5 | 0 | 0 | 0.5384 |
| 500 | 1843 | 1319.7 | -58.17 | -11.1 | 0 | 0 | 0.696 |
| 600 | 1716.1 | 1144.2 | -95.29 | -15.2 | 0 | 0 | 0.8646 |
| 700 | 1595.1 | 988.5 | -144.23 | -19.7 | 0 | 0 | 1.0455 |
| 800 | 1481.1 | 853 | -206.86 | -24.7 | 0 | 0 | 1.2398 |
| 900 | 1377.1 | 736.7 | -285.36 | -30.3 | 0 | 0 | 1.4485 |
| 1000 | 1282.2 | 635.8 | -382.21 | -36.5 | 0 | 0 | 1.6726 |
| 1100 | 1198.7 | 558.3 | -500.24 | -43.4 | 0 | 0 | 1.9124 |
| 1200 | 1127.8 | 494.1 | -642.5 | -51.5 | 0 | 0 | 2.1682 |

FIG. 10D

DA Adaptability
Compare VELOCITY and BULLET PATH columns to see the effect varying DA has on the bullet
6K Trajectory for Sierra Bullets .308 dia. 175 gr. HPBT MatchKing at 2525 Feet per Second
At an Elevation Angle of: 0 degrees
Ballistic Coefficients of: 0.505 0.496 0.485 0.485 0.485
Velocity Boundaries (Feet per Second) of: 2800 1800 1800 1800
Wind Direction is: 3.0 o'clock and a Wind Velocity of 0.0 Cross Range: 0.0 Vertical: 0.0
The Firing Point speed of sound is :1095.15 fps
The bullet does not drop below the speed within the max range specified.
Altitude: 0 feet Humidity: 0 Percent Pressure: 23.97 In/Hg
Temperature: 36 F
Data Printed in English Units

| Range (Yards) | VELOCITY (Ft/Sec) | Energy (Ft/Lbs) | Bullet Path (Inches) | BULLET PATH (1 MOA) | Wind Drift (Inches) | Wind Drift (1 MOA) | Wind Drift (Seconds) |
|---|---|---|---|---|---|---|---|
| 0 | 2525 | 2477 | -2.8 | 0 | 0 | 0 | 0 |
| 100 | 2378.7 | 2198.2 | 0 | 0 | 0 | 0 | 0.1224 |
| 200 | 2237.2 | 1944.4 | -3.35 | -1.6 | 0 | 0 | 0.2425 |
| 300 | 2100.4 | 1714 | -13.66 | -4.3 | 0 | 0 | 0.3909 |
| 400 | 1968.5 | 1505.5 | -31.85 | -7.6 | 0 | 0 | 0.5384 |
| 500 | 1841.7 | 1317.8 | -59.03 | -11.3 | 0 | 0 | 0.696 |
| 600 | 1718.6 | 1147.5 | -96.47 | -15.4 | 0 | 0 | 0.8646 |
| 700 | 1600.9 | 995.7 | -145.7 | -19.9 | 0 | 0 | 1.0455 |
| 800 | 1490.3 | 862.9 | -208.52 | -24.9 | 0 | 0 | 1.2398 |
| 900 | 1387.8 | 748.2 | -287.021 | -30.5 | 0 | 0 | 1.4485 |
| 1000 | 1294.3 | 650.8 | -383.59 | -36.6 | 0 | 0 | 1.6726 |
| 1100 | 1211.1 | 569.9 | -500.95 | -43.5 | 0 | 0 | 1.9124 |
| 1200 | 1139.6 | 504.6 | -642.05 | -51.1 | 0 | 0 | 2.1682 |

FIG. 10E

DA Adaptability

Another facet to contemplate: let us imagine you shot all your M118LR (175 gr. Sierra) and all that is left is G.I. M80 147-150 grain ball ammunition. Assigning a 4KDA to this round at 2740 fps we see it is useable to 900 yards with the DTAC reticle, other velocity assigned DA numbers also match.

Trajectory for Sierra Bullets .308 dia. 150 gr. HPBT MatchKing at 2740 Feet per Second
At an Elevation Angle of: 0 degrees
Ballistic Coefficients of: 0.417 0.397 0.355 0.355 0.355
Velocity Boundaries (Feet per Second) of: 2800 1800 1800 1800
Wind Direction is: 3.0 o'clock and a Wind Velocity of 0.0 Cross Range: 0.0 Vertical: 0.0
The Firing Point speed of sound is :1102.86 fps
The bullet does not drop below the speed within the max range specified.
Altitude: 0 feet Humidity: 0 Percent Pressure: 25.84 In/Hg
Temperature: 43 F
Data Printed in English Units

| Range (Yards) | VELOCITY (Ft/Sec) | Energy (Ft/Lbs) | Bullet Path (Inches) | BULLET PATH (1 MOA) | Wind Drift (Inches) | Wind Drift (1 MOA) | Wind Drift (Seconds) |
|---|---|---|---|---|---|---|---|
| 0 | 2740 | 2500.1 | -2.5 | 0 | 0 | 0 | 0 |
| 100 | 2536.6 | 2142.7 | 0 | 0 | 0 | 0 | 0.1138 |
| 200 | 2342.2 | 1826.9 | -2.91 | -1.4 | 0 | 0 | 0.2369 |
| 300 | 2156.4 | 1548.5 | -12.18 | -3.9 | 0 | 0 | 0.3704 |
| 400 | 1979 | 1304.3 | -28.94 | -6.9 | 0 | 0 | 0.5156 |
| 500 | 1810.8 | 1091.9 | -54.6 | -10.4 | 0 | 0 | 0.6741 |
| 600 | 1635.9 | 891.2 | -90.92 | -14.5 | 0 | 0 | 0.8484 |
| 700 | 1474.4 | 723.9 | -140.28 | -19.1 | 0 | 0 | 1.0417 |
| 800 | 1330.5 | 589.5 | -205.69 | -24.6 | 0 | 0 | 1.256 |
| 900 | 1207.8 | 485.8 | -290.78 | -30.9 | 0 | 0 | 1.493 |

FIG. 11

RANGE-FINDING AND COMPENSATING SCOPE WITH BALLISTIC EFFECT COMPENSATING RETICLE, AIM COMPENSATION METHOD AND ADAPTIVE METHOD FOR COMPENSATING FOR VARIATIONS IN AMMUNITION OR VARIATIONS IN ATMOSPHERIC CONDITIONS

PRIORITY CLAIMS AND CROSS-REFERENCE TO RELATED APPLICATIONS

This application is related to and claims priority from:
(1) commonly owned U.S. provisional patent application No. 62/650,602, filed Mar. 30, 2018,
(2) and is also a continuation in part of commonly owned U.S. non-provisional patent application Ser. No. 16/253,169, filed Jan. 21, 2019, which is a continuation of
(3) Ser. No. 15/224,646 filed Jul. 31, 2016, now patented (U.S. Pat. No. 10,184,752) which claims Priority from
(4) Provisional Application 62/274,054, filed Dec. 31, 2015, and
(5) Provisional Application 62/199,139, filed Jul. 30, 2015,
(6) and is also a continuation in part of commonly owned U.S. non-provisional patent application Ser. No. 15/419,793, filed Jan. 30, 2017, which is a continuation of
(7) Ser. No. 14/216,674, filed Mar. 17, 2014, now patented (U.S. Pat. No. 9,581,415) which is a continuation of
(8) Ser. No. 13/947,858, filed Jul. 22, 2013, now patented (U.S. Pat. No. 9,557,142) which is a continuation of
(9) Ser. No. 13/342,197, filed Jan. 2, 2012, now patented (U.S. Pat. No. 8,701,330) which claims Priority from
(10) Provisional Application 61/437,990, filed Jan. 31, 2011, and
(11) Provisional Application 61/429,128, filed Jan. 1, 2011, the entire disclosures of which are all incorporated herein by reference.

BACKGROUND OF THE INVENTION

Field of the Invention

The present invention relates to instruments and methods for measuring range to a target object surface, aiming a rifle, external ballistics and methods for predicting projectile's trajectory. This application also relates to projectile weapon aiming systems such as rifle scopes, to sensors for measuring range, reticle configurations for projectile weapon aiming systems, and to associated methods of compensating for a projectile's external-ballistic behavior while developing a field expedient firing solution.

Discussion of the Prior Art

Rifle marksmanship has been continuously developing over the last few hundred years, and now refinements in materials and manufacturing processes have made increasingly accurate aimed fire possible. These refinements have made previously ignored environmental and external ballistics factors more significant as sources of aiming error.

The term "rifle" as used here, means a projectile controlling instrument or weapon configured to aim and propel or shoot a projectile, and rifle sights or projectile weapon aiming systems are discussed principally with reference to their use on rifles and embodied in telescopic sights commonly known as rifle scopes. It will become apparent, however, that projectile weapon aiming systems may include aiming devices other than rifle scopes, and may be used on instruments or weapons other than rifles which are capable of controlling and propelling projectiles along substantially pre-determinable trajectories (e.g., rail guns or cannon). The prior art provides a richly detailed library documenting the process of improving the accuracy of aimed fire from rifles (e.g., as shown in FIG. 1A) and other firearms or projectile weapons.

Most shooters or marksmen, whether hunting or target shooting, understand the basics. The primary factors affecting aiming accuracy are (a) the range or distance to the target which determines the arcuate trajectory or "drop" of the bullet in flight and the time of flight ("TOF"), and (b) the windage, wind deflection factors or lateral drift due to transverse or lateral forces acting on the bullet during TOF. Experienced marksmen account for these two factors when aiming. Precision long-range shooters such as military and police marksmen (or "snipers") often refer to references including military and governmental technical publications such as the following:

(Ref 1) Jonathan M. Weaver, Jr., LTC, USA Ret., Infantry, System Error Budgets, Target Distributions and Hitting Performance Estimates for General-Purpose Rifles and Sniper Rifles of 7.62×51 mm and Larger Calibers, AD-A228 398, TR-461, AMSAA, May, 1990;

(Ref 2) McCoy, Robert L., A Parametric Study of the Long Range, Special Application Sniper Rifle, Aberdeen Proving Grounds ("APG"), MD, BRL Memorandum Report No. 3558, December 1986;

(Ref 3) Brophy, William S., Maj., Ord., A Test of Sniper Rifles, 37th Report of Project No. TS2-2015, APG, MD D&PS, 27 Jul. 1955;

(Ref 4) Von Wahlde, Raymond & Metz, Dennis, Sniper Weapon Fire Control Error Budget Analysis, US Army ARL-TR-2065, August, 1999—arl.army.mil;

(Ref 5) US Army FM-23-10, Sniper Training, United States Army Infantry School ATSH-IN-S3, Fort Benning, Ga. 31905-5596, August 1994; and (Ref 6) USMC MCWP 3-15.3 (formerly FMFM 1-3B), Sniping, PCN 143 000118 00, Doctrine Division (C42) US Marine Corps Combat Development Command, 2 Broadway Street Suite 210 Quantico, Va. 22134-5021, May 2004.

For nomenclature purposes and to provide a more complete background and foundation for what follows, these published references are incorporated herein by reference.

A number of patented rifle sights or projectile weapon aiming systems have been developed to help marksmen account for the elevation/range and windage factors when aiming. For example, U.S. Pat. No. 7,603,804 (to Zadery et al) describes a riflescope made and sold by Leupold & Stevens, Inc., with a reticle including a central crosshair defined as the primary aiming mark for a first selected range (or "zero range") and further includes a plurality of secondary aiming marks spaced below the primary aiming mark on a primary vertical axis. Zadery's secondary aiming marks are positioned to compensate for predicted ballistic drop at selected incremental ranges beyond the first selected range, for identified groups of bullets having similar ballistic characteristics.

Zadery's rifle scope has variable magnification, and since Zadery's reticle is not in the first focal plane ("F1") the angles subtended by the secondary aiming marks of the reticle can be increased or decreased by changing the optical power of the riflescope to compensate for ballistic characteristics of different ammunition. The rifle scope's crosshair is defined by the primary vertical line or axis which is intersected by a perpendicular horizontal line or primary horizontal axis. The reticle includes horizontally projecting windage aiming marks on secondary horizontal axes intersecting selected secondary aiming marks, to facilitate compensation for the effect of crosswinds on the trajectory of the projectile at the selected incremental ranges At each secondary aiming mark on the primary vertical axis, the laterally or horizontally projecting windage aiming marks project symmetrically (left and right) from the vertical axis, indicating a windage correction for wind from the shooter's right and left sides, respectively. That windage correction is wrong, however, as will be illustrated and described below.

Beyond bullet drop over a given range and basic left-right or lateral force windage compensation, there are several other ballistic factors which result in lesser errors in aiming. As the inherent precision of rifles and ammunition improves, it is increasingly critical that these other factors be taken into consideration and compensated for, in order to make an extremely accurate shot. These factors are especially critical at very long ranges, (e.g., approaching or beyond one thousand yards). Many of these other factors were addressed in this applicant's U.S. Pat. No. 7,325,353 (to Cole & Tubb) which describes a riflescope reticle including a plurality of charts, graphs or nomogrpahs arrayed so a shooter can solve the ranging and ballistic problems required for correct estimation and aiming at a selected target. The '353 patent's scope reticle includes at least one aiming point field to allow a shooter to compensate for range (with elevation) and windage, with the "vertical" axis precisely diverging to compensate for "spin drift" and precession at longer ranges. Stadia for determining angular target dimension(s) are included on the reticle, with a nomograph for determining apparent distance from the apparent dimensions being provided either on the reticle or external to the scope. Additional nomographs are provided for the determination and compensation of non-level slopes, non-standard density altitudes, and wind correction, either on the reticle or external to the riflescope.

The elevation and windage aim point field (50) in the '353 patent's reticle was comparable, in one respect, to traditional bullet drop compensation reticles such as the reticle illustrated in the Zaderey '804 patent, but includes a number of refinements such as the compensated elevation or "vertical" crosshair 54, which can be seen to diverge laterally away from a true vertical reference line 56 (e.g., as shown in FIG. 3 of the '353 patent), to the right (i.e., for a rifle barrel with rifling oriented for right hand twist). The commercial embodiment of the '353 patent reticle was known as the DTAC™ Reticle, and the RET-2 version of the DTAC reticle is illustrated in FIG. 1C.

The compensated elevation or "vertical" crosshair of the DTAC™ reticle was useful for estimating a ballistic effect of the bullet's gyroscopic precession known as "spin drift" caused by the bullet's stabilizing axial rotation or spin, which is imparted on the bullet by the rifle barrel's inwardly projecting helical "lands" which bear upon the bullet's circumferential surfaces as the bullets accelerates distally down the barrel. Spin drift is due to an angular change of the axis of the bullet in flight as it travels downrange in an arcuate ballistic flight path. While various corrections have been developed for most of these factors, the corrections were typically provided in the form of programmable electronic devices or earlier in the form of logbooks developed over time by precision shooters. Additional factors affecting exterior ballistics of a bullet in flight include atmospheric variables, specifically altitude and barometric pressure, temperature, and humidity.

Traditional telescopic firearm sight reticles have been developed with markings to assist the shooter in determining the apparent range of a target. A nearly universal system has been developed by the military for artillery purposes, known as the "mil-radian," or "mil," for short. This system has been adopted by most of the military for tactical (e.g., sniper) use, and was subsequently adopted by most of the sport shooting world. The mil is an angle having a tangent of 0.001. A mil-dot scale is typically an array of dots (or similar indicia) arrayed along a line which is used to estimate or measure the distance to a target by observing the apparent target height or span (or the height or span of a known object in the vicinity of the target). For example, a target distance of one thousand yards would result in one mil subtending a height of approximately one yard, or thirty six inches, at the target. This is about 0.058 degree, or about 3.5 minutes of angle. It should be noted that although the term "mil-radian" implies a relationship to the radian, the mil is not exactly equal to an angle of one one thousandth of a radian, which would be about 0.057 degree or about 3.42 minutes of angle. The "mil-dot" system, based upon the mil, is in wide use in scope reticle marking, but does not provide a direct measure for determining the distance to a target without first having at least a general idea of the target size, and then performing a mathematical calculation involving these factors. Confusingly, the US Army and the US Marine Corps do not agree on these conversions exactly (see, e.g., Refs 5 and 6), which means that depending on how the shooter is equipped, the shooter's calculations using these conversions may change slightly.

The angular measurement known as the "minute of angle," or MOA is used to measure the height or distance subtended by an angle of one minute, or one sixtieth of one degree. At a range of one hundred yards, this subtended angle spans slightly less than 1.05 inches, or about 10.47 inches at one thousand yards range. It will be seen that the distance subtended by the MOA is substantially less than that subtended by the mil at any given distance, i.e. thirty six inches for one mil at one thousand yards but only 10.47 inches for one MOA at that range. Thus, shooters have developed a rather elaborate set of procedures to calculate required changes to sights (often referred to as "clicks") based on a required adjustment in a bullet's point of impact (e.g., as measured in "inches" or "minutes").

Sight adjustment and ranging methods have been featured in a number of patents Assigned to Horus Vision, LLC, including U.S. Pat. Nos. 6,453,595 and 6,681,512, each entitled "Gunsight and Reticle therefore" by D. J. Sammut and, more recently, U.S. Pat. No. 7,832,137, entitled "Apparatus and Method for Calculating Aiming Point Information" by Sammut et al. These patents describe several embodiments of the Horus Vision™ reticles, which are used in conjunction with a series of calculations to provide predicted vertical corrections (or holdovers) for estimated ranges and lateral corrections (or windage adjustments), where a shooter calculates holdover and windage adjustments separately, and then selects a corresponding aiming point on the reticle.

In addition to the general knowledge of the field of the present invention described above, the applicant is also aware of certain foreign references which relate generally to the invention. Japanese Patent Publication No. 55-36,823 published on Mar. 14, 1980 to Raito Koki Seisakusho KK describes (according to the drawings and English abstract) a variable power rifle scope having a variable distance between two horizontally disposed reticle lines, depending upon the optical power selected. The distance may be adjusted to subtend a known span or dimension at the target, with the distance being displayed numerically on a circumferential external adjustment ring. A prism transmits the distance setting displayed on the external ring to the eyepiece of the scope, for viewing by the marksman.

GENERAL & SPECIALIZED NOMENCLATURE

In order to provide a more structured background and a system of nomenclature, we refer again to FIGS. 1A-1E. FIG. 1A illustrates a projectile weapon system 4 including a rifle 6 and a telescopic rifle sight or projectile weapon aiming system 10. Telescopic rifle sight or rifle scope 10 are illustrated in the standard configuration where the rifle's barrel terminates distally in an open lumen or muzzle and rifle scope 10 is mounted upon rifle 6 having a rifled barrel 7 in a configuration which allows the rifle system 4 to be "zeroed" or adjusted such that a user or shooter sees a Point of Aim ("POA") in substantial alignment with the rifle's Center of Impact ("COI") when shooting or firing selected ammunition (not shown) at a selected target (not shown).

FIG. 1B schematically illustrates exemplary internal components for telescopic rifle sight or rifle scope 10. The scope 10 generally includes a distal objective lens 12 opposing a proximal ocular or eyepiece lens 14 at the ends of a rigid and substantially tubular body or housing, with a reticle screen or glass 16 disposed there-between. Variable power (e.g., 5-15 magnification) scopes also include an erector lens 18 and an axially adjustable magnification power adjustment (or "zoom") lens 20, with some means for adjusting the relative position of the zoom lens 20 to adjust the magnification power as desired, e.g. a circumferential adjustment ring 22 which threads the zoom lens 20 toward or away from the erector lens 18. Variable power scopes, as well as other types of telescopic sight devices, also often include a transverse position control 24 for transversely adjusting the reticle screen 16 to position an aiming point or center of the aim point field thereon (or adjusting the alignment of the scope 10 with the firearm 6), to adjust vertically for elevation (or bullet drop) as desired. Scopes also conventionally include a transverse windage adjustment for horizontal reticle screen control as well (not shown).

While an exemplary conventional variable power scope 10 is used in the illustrations, fixed power (e.g., 10×, such as the M3A scope) are often used. Such fixed power scopes have the advantages of economy, simplicity, and durability, in that they eliminate at least one lens and a positional adjustment for that lens. Such a fixed power scope may be suitable for many marksmen who generally shoot at relatively consistent ranges and targets.

Variable power scopes include two focal planes. The reticle screen or glass 16 used in connection with the reticles of the present invention is preferably positioned at the first or front focal plane ("FP1") between the distal objective lens 12 and erector lens 18, in order that the reticle thereon will change scale correspondingly with changes in magnification as the power of the scope is adjusted. This results in reticle divisions subtending the same apparent target size or angle, regardless of the magnification of the scope. In other words, a target subtending two reticle divisions at a relatively low magnification adjustment, will still subtend two reticle divisions when the power is adjusted, to a higher magnification, at a given distance from the target. This reticle location is often preferred when used in combination with a variable power firearm scope.

Alternatively, reticle screen 16 may be placed at a second or rear focal plane between the zoom lens 20 and proximal eyepiece 14. Such a second focal plane reticle will remain at the same apparent size regardless of the magnification adjustment to the scope, which has the advantage of providing a full field of view to the reticle at all times. However, the reticle divisions will not consistently subtend the same apparent target size with changes in magnification, when the reticle is positioned at the second focal plane in a variable power scope.

FIG. 1C illustrates an earlier revision of applicant's prior DTAC™ rifle scope reticle, and provides a detailed view of an exemplary elevation and windage aim point field 30, with the accompanying horizontal and vertical angular measurement stadia 31. The aim point field 30 was located on the scope reticle 16, as the marksman used the aim point field 30 for aiming at the target as viewed through the scope and its reticle. Aim point field 30 comprises at least a main horizontal line or crosshair 32 and a substantially vertical main line or crosshair 34, which in the case of the field 30 is represented by a substantially vertical line of dots. A true vertical reference line (not shown) on aim point field 30 would be exactly vertical and perpendicular to the main crosshair 32. Instead, substantially vertical central aiming dot line 34 is skewed somewhat to the right of a true vertical reference line (not shown) to compensate for gyroscopic precession's "spin drift" of the bullet in its trajectory. Most rifle barrels manufactured in the U.S. have "right hand twist" rifling which spirals to the right, or clockwise, from the proximal chamber to the distal muzzle of the rifle's barrel 7. This rifling imparts a corresponding clockwise axial spin to a fired bullet as an aid to stability and accuracy. Due to the earthward pull of gravity, the fired bullet travels an arcuate trajectory in its ballistic flight between the rifle's muzzle and the target, and the longitudinal axis of the bullet deflects angularly to follow that arcuate trajectory. The axial spin of the bullet results in gyroscopic precession forces which act in a vector ninety degrees to the bullet's central axis along the arcuate trajectory, causing the bullet to deflect to the right (for right hand twist barrels). This deflection effect is referred to as "spin drift" and is seen most clearly at relatively long ranges, where there is substantial arc to the trajectory of the bullet, as shown in FIG. 1E. The offset or skewing of the DTAC™ scope's vertical aiming dot line 34 to the right, in use, results in the marksman correspondingly moving the alignment slightly to the left in order to position one of the dots of the line 34 on the target (assuming no windage correction). This has the effect of correcting for the rightward deflection of the bullet due to spin drift.

The horizontal crosshair 32 and central aiming dot line 34 define a single aim point 38 at their intersection. The multiple aim point field 30 was formed of a series of horizontal rows which are seen in FIG. 1C to be exactly parallel to horizontal crosshair 32 and provide angled columns which are generally vertical (but spreading as they descend) to provide left side columns and right side columns of aiming dots (which may be small circles or other shapes, in order to minimize the obscuration of the target). The first and second uppermost horizontal rows actually comprise only a single dot each (including 38), as they provide relatively close-in aiming points for targets at only one hundred and two hundred yards, respectively. FIG. 1C's aim point field 30 was configured for a rifle and scope system which has initially been "zeroed" (i.e., adjusted to exactly compensate for the drop of the bullet during its flight) at a distance of two hundred yards, as evidenced by the primary horizontal crosshair 32. Thus, a marksman aiming at a closer target lowered his aim point to one of the dots slightly above the horizontal crosshair 32, as relatively little drop occurs to the bullet in such a relatively short flight.

Most of the horizontal rows in FIG. 1C's aim point field 30 are numbered along the left edge of the aim point field to indicate the range in hundreds of yards for an accurate shot using the dots of that particular row (e.g., "3" for 300 yards and "4" for 400 yards). The spacing between each horizontal row gradually increases as the range becomes longer and longer. This is due to the slowing of the bullet and increase in vertical speed due to the acceleration of gravity during the bullet's flight, (e.g., as illustrated in FIG. 1E). The alignment and spacing of the horizontal rows was intended to compensate for these factors at the selected ranges. In a similar manner, the angled, generally vertical columns spread as they extend downwardly to greater and greater ranges. These generally vertical columns were intended to provide aim points to compensate for windage (i.e. the lateral drift of a bullet due to any crosswind component). A crosswind has an ever greater effect upon the path of a bullet with longer and longer ranges or distances.

In order to use the Tubb™ DTAC™ elevation and windage aim point field 30, the marksman needed a reasonably close estimate of the range to the target (see, e.g., FIG. 1F). This range estimate was usually provided by optical tools such as spaced mil-dots or the evenly spaced horizontal and vertical angular measurement stadia 31 disposed upon aim point field 30. The stadia 31 comprise a vertical row of alignment markings and a horizontal row of alignment markings disposed along the horizontal reference line or main crosshair 32. Each adjacent stadia mark was evenly spaced and subtended precisely the same angle therebetween, e.g. one mil, or a tangent of 0.001. The DTAC™ stadia system 31 was used by estimating some dimension of the target, or of an object close to the target. These estimation techniques were prone to some error, however, so errors in subtended angle estimation could easily lead to errors in estimating the range or distance to the target.

FIG. 1D illustrates another rifle scope reticle which is similar in many respects to the reticle of FIG. 1C, as described and illustrated in applicant's own U.S. Pat. No. 7,325,353, in the prior art. FIG. 1D provides a detailed view of another exemplary elevation and windage aim point field 50, with the accompanying horizontal and vertical angular measurement stadia 100. The aim point field 50 had a main horizontal line or crosshair 52 and a nearly vertical central main aiming dot line or crosshair, which in the case of the field 50 is represented by a substantially or nearly vertical line of dots 54. A true vertical reference line 56 is shown on the aim point field 50 of FIG. 1D, for comparison. The substantially vertical central aiming dot line 54 is skewed somewhat to the right of the true vertical reference line 56 to compensate for spin drift of a spin-stabilized bullet or projectile in its trajectory.

FIG. 1D shows how horizontal crosshair 52 and substantially vertical central aiming dot line 54 define a single aim point 58 at their intersection. The multiple aim point field 50 is formed of a series of horizontal rows which are exactly parallel to main horizontal crosshair 52 (shown as wind dot lines 60*a*, 60*b*, 60*c*, etc.). Those wind dots are also aligned along an angled but nearly vertical axes (each axis spreading as they descend) to provide left side columns 62*a*, 62*b*, 62*c*, etc. and right side columns 64*a*, 64*b*, 64*c*, etc. of aiming dots. FIG. 1D's aim point field 50 is configured for a rifle and scope system (e.g., 4) which has been "zeroed" (i.e., adjusted to exactly compensate for the drop of the bullet during its flight) at aiming dot 58 for a target at a distance of three hundred (300) yards, as evidenced by the primary horizontal crosshair 52. Thus, a marksman aiming at a closer target was required to lower his aim point to one of the higher dots (i.e., 60*a* or 60*b*) located slightly above the horizontal crosshair 52, as relatively little drop occurs to the bullet in such a relatively short flight.

In FIG. 1D, most of the horizontal rows, e.g. rows 60*d*, 60*e*, 60*f*, 60*g*, down to row 60*n*, are numbered to indicate the range in hundreds of yards for an accurate shot using the dots of that particular row. The row 60*i* has a horizontal mark to indicate a range of one thousand yards. The spacing between each horizontal row 60*c*, 60*d*, 60*e*, 60*f*, etc., gradually increases as the range becomes longer and longer, due to the slowing of the bullet and increase in vertical speed due to the acceleration of gravity during its flight. In a similar manner, the nearly vertical columns 62*a*, 62*b*, 64*a*, 64*b*, etc., spread as they extend downwardly to greater and greater ranges. And since any crosswind will have an ever greater effect upon the path of a bullet with longer and longer range or distance, so the vertical columns spread with greater ranges or distances, with the two inner columns 62*a*, 64*a* closest to the central column 54 being spaced to provide correction for a five mile per hour crosswind component, while the next two adjacent columns 62*b*, 64*b* providing an estimated correction for a ten mile per hour crosswind component. Long range, high wind aim point estimation is known to the most difficult problem among experienced marksman, even if the wind is relatively steady over the entire flight path of the bullet.

Both of the reticles discussed above (30 and 50) represented significant aids for precision shooting over long ranges, such as the ranges depicted in FIG. 1E, (which duplicates the information in FIG. 3-25 of Ref 5). As noted above, FIG. 1E is a trajectory chart taken from a U.S. Gov't publication which illustrates the trajectory of a selected 7.62×51 (or 7.62 NATO) projectile fired from an M24 SWS rifle for sight adjustment or "zero" settings from 300 meters to 1000 meters. This chart was originally developed as a training aid for military marksmen (e.g., snipers) and illustrates the "zero wind" trajectory for the US M118 7.62 NATO (173 gr FMJBT) projectile. The chart was intended to illustrate the arcuate trajectory of the bullet, in flight, and shows the relationship between a "line of sight" and the bullet's trajectory between the shooter's position and a target, for eight different "zero" or sight adjustment ranges, namely, 300M, 400M, 500M, 600M, 700M, 800M, 900M, and 1000M. As illustrated in FIG. 1E, if a shooter is "zeroed" for a target at 300M and shoots a target at 300M, then the highest point of flight in the bullet's trajectory (or "max ord") is 8.2 inches and the bullet will strike a target at 400M 14 inches low. This is to be contrasted with a much longer range shot. For example, as illustrated in FIG. 1E, if a shooter is "zeroed" for a target at 900M and shoots a target at 900M, then the highest point of flight in the bullet's trajectory is 96.8 inches (over 8 feet) and the bullet will strike a target at 1000M (or 1.0 KM) 70 inches low. For a target at 1000M the highest point of flight in the bullet's trajectory is 129 inches (almost 11 feet) above the line of sight, and, at these ranges, the bullet's trajectory is clearly well above the line of sight for a significant distance, and the bullet's time of flight ("TOF") is long enough that the time for the any cross wind to act on the bullet is a more significant factor.

The above described systems are now in use in scope reticles, but these prior art systems have been discovered to include subtle but significant errors arising from recently observed external ballistic phenomena, and the observed error has been significant enough (e.g., exceeding one MOA) at ranges well within the operationally significant military or police sniping range limits (e.g., 1000-1400 yards) to require further improvements.

The prior art systems often require the marksman or shooter to bring a companion (e.g., a coach or spotter) who may be required to bring additional optics or instruments for observation and measurement and may also be required to bring along computer-like devices such as a transportable personal digital assistant ("PDA") or a smart phone (e.g., an iPhone™ or a Blackberry™ programmed with an appropriate software application or "app") for solving ballistics problems while in the field.

These prior art systems also require the marksman or their companion to engage in too many evaluations and calculations while in the field, and even for experienced long-range shooters, those evaluations and calculations usually take up a significant amount of time. If the marksman is engaged in military or police tactical or sniping operations, lost time when aiming may be extremely critical, (e.g., as noted in Refs 5 and 6). Another complicating factor is that accurately estimating or measuring the distance or range to a selected target can be difficult in certain situations. In response, many shooters have begun using Laser Range Finder ("LRF") instruments to measure Line of Sight ("LOS") range (see, e.g., 29 in FIG. 1F).

The prior art includes a number of gun and rifle scope assemblies which incorporate a form of range sensing or range-finding mechanism which are configured to address bullet drop over a given trajectory. For example, U.S. Pat. No. 6,269,581, issued to Groh, describes a range compensating rifle scope which utilizes laser range-finding and microprocessor technology to compensate for bullet drop over a given trajectory range. The scope includes a laser rangefinder which senses the distance between the user and a target that is centered in the scope crosshairs. The user enters a muzzle velocity value together with input for bullet weight and altitude, following which the microprocessor is programmed to calculate a distance that the bullet traveling at the selected velocity will drop while traversing the distance calculated by the laser rangefinder, taking into consideration reduced drag at higher altitudes and the weight of the bullet (but not taking into consideration the effects of slope angle or the effects of crosswinds with gyroscopic precession). Based upon Groh's calculated value, a second LCD image crosshair is superimposed in the scope's viewfinder, indicating the proper elevation at which to aim the rifle to compensate for calculated bullet drop.

Exemplary LRF Scope Technical Background and Nomenclature:

U.S. Pat. No. 7,516,571, issued to Scrogin, is an improvement over Groh's work in that the scope assembly couples the Laser Range Finder ("LRF") electronics display driver and optics (e.g., prism) to provide a reticle display field as a horizontal line, as illustrated in this Application's Prior Art FIGS. 1G-1M, which show Scrogin's Laser Range Finder (LRF) equipped scope system L10. Scrogin's erect image LRF scope L12 includes eyepiece lenses L20, an intermediately disposed erector lens L22 (either fixed or zoom), a reticle L24 and field lens L26 disposed between the erector lens L22 and a prism L28, all aligned axially with an objective lens L30. The prism performs the functions of tapping off the infrared light to the detector L46 and bringing the light from the display L48 into the optical field. Objective lens 30 is aligned along an axis which is parallel to the central or aiming axis of laser range-finding scope sensor subassembly L16 which includes a collimating lens L32 in substantially collinear position relative to the objective lens L30 and rifle barrel L18.

Scrogin's range-finding component subassembly L16 is, as illustrated in FIGS. 1G, 1H and 1I, a near infrared laser projector consisting of a laser diode L34 in communication with the collimating lens L32, again mounted in adjacent fashion relative to the objective lens L30 of the erect image telescope L12 to produce a small spot of light (e.g., at a range of 1000 yards or more). As best shown in FIG. 1G, a pulse generator L36 operates the laser diode L34 and is in communication with a microprocessor L38 and timer control circuit L40. Microprocessor L38 is activated upon closing a switch L41, also referenced by pushbutton L42 located upon the riflescope housing L12 in FIG. 1H, to engage the timer control circuit L40 and pulse generator L36, where a suitable switch or pushbutton can be located upon a forestock portion associated with the projectile firing device (e.g., rifle 4) or another user accessible location. Following the steps of laser projection, detection and timer measurement, information is inputted to the microprocessor. A serial interface L43 is also in operative communication with the microprocessor L38 which permits the downloading of external bullet trajectory data for access by the microprocessor. Following the above steps, the calculated drop values are displayed in an aimpoint line, as shown in FIGS. 1J-1M.

Scrogin's system L10 includes amplifier L44 in operative communication at one end with an infrared detector L46, located in proximity to the prism L28, as well as communicating with the timer control circuit L40. The infrared detector L46 is constructed such that it is capable of being illuminated through the objective lens L30, thus offering the advantage of a relatively large lens for the IR detector to "see through", and both the IR laser projector and IR detector to be "zeroed" in relationship to the mechanical reticle L24. The pulse generator L36 and control circuit L40 progress through a number of iterations until a constant time delay value is obtained and which is indicative of a valid range measurement. Upon communicating this range measurement information to the microprocessor, an output thereof is communicated to a display driver L47 and which is in turn communicated to a light emitting display L48. Angled mirror L50 redirects the projected light or image from display L48, which is then passed through a display lens L52 and into the prism L28.

Turning now to FIGS. 1J-1M, Scrogin's LRF scope system L10 provides a long distance configuration sight display line placed upon a reticle display field (see crosshairs L56 and L58) defined at a specified vertical position (such as relative vertical crosshair L58). The sight display line is projected as a horizontal red line upon a visual field (dichroic projection) and defines a vertical shift in the aiming point and which is required by the user to compensate for the gravitational effects upon the bullet at a specified laser defined range. Scrogin's display line is elongated with spaced apart pairs of reference markings, this in turn defining Scrogin's best estimate for left or right aiming point shifts required to compensate for 10 and 20 mile per hour wind velocity components normal to the trajectory pattern of the bullet. Also illustrated at L62 is a range marking (such as 800 yards) which can be projected by the light emitting display as an additional image upon the reticle display field. FIG. 1K illustrates a second example of a combination sight display line L64 exhibiting a further suitable set of crosswind adjustment markings and a range marking L66 (275 yards), which corresponds generally with an intermediate range sighting configuration. FIG. 1L illustrates a third example of a sight line L68 and range marking L70 (95 yards) combination corresponding to a very short range sighting configuration. Finally, FIG. 1M illustrates a variation of a long range sighting display such as an OLED generated display, referenced by dichroic projected sight line L72 with cross wind markings. Also displayed in colored fashion (such as again red which contrasts best with the background viewed through the scope) is an added line L74 which indicates how far the aiming point needs to be shifted at the measured range if the rifle is aimed at a substantial up or down slope angle (e.g., 27, as seen in FIG. 1F) such as 30 degrees in the example shown in FIG. 1M. Scrogin's optional display function is useful for hunting in terrain with steep slopes and where a hunter can estimate the slope at a given spot and make a reasonable correction. This option, along with an added switch on the forearm grip and data storage for multiple cartridges (see again pushbutton L41) can be used when hunting objectives are changed in the field. Also illustrated in FIG. 1M at L76 is a dichroic projection referencing the range determination (again 975 yards) and a further image may be projected at L78 representative of a cartridge (bullet) identification script.

Burris Corporation's U.S. Pat. Nos. 8,201,741, 9,091,507 and 9,482,516 describe further refinements in Laser Range Finding ("LRF") rifle scopes and methods for their use, but all of the foregoing references are less than ideal for actual precision, Long Range marksmanship, because none of them properly account for external ballistic effects actually acting on the bullet, when in flight (including the effects of gyroscopic precession).

None of the above cited references or patents, alone or in combination, adequately address the combined atmospheric and ballistic problems identified by the applicant of the present invention or provide a workable and time-efficient way of developing an accurate firing solution, while in the field. Thus, there is an unmet need for a rapid, accurate and effective rifle sight or projectile weapon aiming system and method for more precisely sensing range to and then estimating a correct point of aim when shooting or engaging targets at long distances, especially in windy conditions.

OBJECTS AND SUMMARY OF THE INVENTION

Accordingly, it is an object of the present invention to overcome the above mentioned difficulties by providing an enhanced system and method for sensing or measuring the range to a selected target and then compensating for a projectile's ballistic behavior while developing a field expedient firing solution, and calculating and displaying a correct point of aim when shooting or engaging targets at long distances. The applicant's initial work was directed to determining an aim point for one specific type of ammunition, and the invention now includes an adaptive method allowing a shooter in the field to adapt to changes in available ammunition and compensate for variations in ammunition or atmospheric conditions.

The applicant has engaged in a rigorous study of precision shooting and external ballistics and observed what initially appeared to be external ballistics anomalies when engaged in carefully controlled experiments in precise shooting at long range. The anomalies were observed to vary with environmental or atmospheric conditions, especially crosswinds. The variations in the anomalies were observed to be repeatable, and so a precise evaluation of the anomalies was undertaken and it was discovered that all of the long range reticles presently employed in the prior art rifle scopes and LRF equipped scopes are essentially wrong.

A refined method and aiming reticle has been developed which allows a more precise estimate of external ballistic behavior for a given projectile when a given set of environmental or atmospheric conditions are observed to be momentarily present. Expressed most plainly, the range finding and aim compensating system and reticle of the present invention differs from prior art long range reticles and LRF equipped scopes in two significant and easily perceived ways:

first, the reticle and system of the present invention is configured to compensate for effects of ALL of the effects gyroscopic precession, including Crosswind Jump, and so the lateral or windage aim point adjustment axes are not horizontal, meaning that they are not simply horizontal straight lines which are perpendicular to a vertical straight line crosshair; and second, the reticle and system of the present invention is configured to compensate for Dissimilar Wind Drift, and so the arrayed aim point indicators on each windage adjustment axis are not spaced symmetrically about the vertical crosshair, meaning that a given wind speed's full value windage offset indicator on the left side of the vertical crosshair is not spaced from the vertical crosshair at the same lateral distance as the corresponding given wind speed's full value windage offset indicator on the right side of the vertical crosshair.

Apart from the Tubb™ DTAC™ reticle discussed above, the reticles of the prior art have a vertical crosshair or post intended to be seen (through the riflescope) as being exactly perpendicular to a horizontal crosshair that is parallel to the horizon when the rifle is held level with no angular variation from vertical (or "rifle cant"). Those prior art reticles also include a plurality of "secondary horizontal crosshairs" (e.g., 24 in FIG. 2 of Sammut's U.S. Pat. No. 6,453,595). The secondary horizontal crosshairs are typically divided with evenly spaced indicia on both sides of the vertical crosshair (e.g., 26 in FIG. 2 of Sammut's U.S. Pat. No. 6,453,595 or as shown in FIG. 3 of this applicant's U.S. Pat. No. 7,325,353). These prior art reticles represent a prediction of where a bullet will strike a target, and that prior art prediction includes an assumption or estimation that a windage offset to the left is going to be identical to and symmetrical with a windage offset to the right, and that assumption is plainly, provably wrong, for reasons supported in the more arcane technical literature on ballistics and explained below.

Another assumption built into the prior art reticles pertains to the predicted effect on elevation arising from increasing windage adjustments, because the prior art reticles effectively predict that no change in elevation (i.e., holdover) should be made, no matter how much windage adjustment is needed. This second assumption is demonstrated by the fact that the prior art reticles all have straight and parallel "secondary horizontal crosshairs" (e.g., 24 in FIG. 2 of Sammut's U.S. Pat. No. 6,453,595 or as shown in FIG. 3 of this applicant's U.S. Pat. No. 7,325,353), and that assumption is also plainly, provably wrong.

The applicant of the present invention first questioned and then discarded these assumptions, choosing instead to empirically observe, record and plot the actual ballistic performance for a series of carefully controlled shots at selected ranges, and the plotted observations have been used to develop an improved range finding and aim compensating system and method which provides a more accurate predictor of the effects of observed atmospheric and environmental conditions on a bullet's external ballistics, especially at longer ranges. The applicant's discoveries are combined into a LRF and rifle scope system and in the method of the present invention a measured range is used to highlight part of a reticle which provides easy to use and accurate estimations of the external ballistic effects of (a) spin drift, (b) crosswind jump or aeronautical jump and (c) dissimilar wind drift.

The range-finding rifle sight or projectile weapon aiming system of the present invention preferably includes a Laser Range Finder (e.g., "LRF") equipped rifle scope assembly with a reticle defining an array of aiming dots with a nearly but not exactly vertical array of aiming indicia which intersect a main horizontal crosshair to define a central or primary aiming point. The reticle of the present invention also includes a plurality of nearly horizontal downrange windage adjustment axes arrayed beneath the main horizontal crosshair. The downrange windage adjustment axes are not horizontal lines, meaning that they are not secondary horizontal crosshairs each being perpendicular to a vertical crosshair. Instead, each downrange windage axis defines an angled or sloped array of windage offset adjustment indicia or aim points. If a downrange windage axis line were drawn left to right through all of the windage offset adjustment indicia corresponding to a selected range (e.g., 800 yards), that 800 yard downrange windage axis line would slope downwardly from horizontal at a small angle (e.g., five degrees or greater), for a rifle barrel with right-hand twist rifling and a right-spinning projectile. The range-finding (e.g., LRF) and ballistic effect compensating system of the present invention includes a reticle aim point field and an ammunition adaptive aim compensation method. The range finding and aim compensating system of the present invention includes a ballistic effect compensating reticle with a multiple point elevation and windage aim point field that has a primary aiming mark indicating (a) a primary aiming point adapted to be sighted-in at a first selected range and (b) the locus of the LRF beam for sensing Line of Sight ("LOS") range 29 to a selected target 28.

The aim point field also includes a plurality of secondary aiming points arrayed beneath the primary aiming mark illustrating aim points for a plurality of crosswind conditions at selected ranges. The method for compensating for a projectile's ballistic behavior while developing a field expedient firing solution permits the shooter to sense or measure the LOS range to target, (29, e.g., corresponding to an adjusted range call of 800 yards), and sense or input the slope angle, local or nominal air density ballistic characteristics and crosswind velocity (e.g., in mph), which is then used to designate an optimum sloped row of downrange windage hold points. The adaptive method allows a shooter in the field to adapt to changes in available ammunition (e.g., when changing from M118LR ammo to M80 ammo) and compensate for variations in ammunition as well as changes in atmospheric conditions.

In the range finding and aim compensating system and method of the present invention, the windage offset adjustment indicia (or wind dots) on each sloped downrange wind dot line are not symmetrical about the vertical crosshair, meaning that for a given crosswind speed (e.g., 5 mph) the selected windage offset adjustment indicator or wind dot on the left side of the vertical crosshair is not spaced from the vertical crosshair at the same lateral distance as the corresponding windage offset adjustment indicator on the right side of the vertical crosshair. Instead, the reticle and method of the present invention define differing windage offsets for (a) wind from the left and (b) wind from the right. Those windage offsets refer to an elevation adjustment axis which diverges laterally from the vertical crosshair. The elevation adjustment axis defines the diverging array of elevation offset adjustment indicia for selected ranges (e.g., 300 to 1600 yards, in 100 yard increments). An elevation offset adjustment axis line could be drawn through all of the elevation offset adjustment indicia (corresponding to no wind) to define only the predicted effect of spin drift and precession, as described in this applicant's U.S. Pat. No. 7,325,353 (which is incorporated herein by reference).

In accordance with the present invention, a range finding and aim compensating system and aiming method are provided to account for the previously ill-defined effects of the newly observed interaction between ballistic and atmospheric effects. Careful research of technical journals was used to find reports of identified effects in disparate sources, but those effects were never addressed in a comprehensive system to provide a range finding and aim compensating system and aiming solution or estimating method which can be easily and quickly used by a marksman in the field.

The traditional range-finding (e.g., LRF) system or scope (e.g. L12 of FIGS. 1G-1I) is substantially reconfigured and reprogrammed in the present invention to include an updated version of applicant's ballistic effect compensating system and reticle with a multiple point windage aim point field including a primary aiming mark indicating (a) a primary aiming point adapted to be sighted-in at a first selected range and (b) the locus of the LRF beam for use in sensing range to a target the user selects when in the field. The reticle's aim point field also includes a plurality of sloped rows of selectively illuminated or highlighted secondary aiming points arrayed beneath the primary aiming mark which designate aim points for a plurality of crosswind conditions at the measured range. The method for compensating for a projectile's ballistic behavior while developing a field expedient firing solution permits the shooter to sense or measure the LOS range to target, (e.g., 800 yards), and (optionally) sense or input the local or nominal air density ballistic characteristics, so that the system can generate an optimal Effective Hold Point ("EHP") and display or illuminate at least one sloped row of windage hold points nearest the sensed EHP range. The adaptive method allows a shooter in the field to adapt to changes in available ammunition (e.g., from M118LR to M80) and adjust the computed EHP to compensate for variations in ammunition as well as changes in atmospheric conditions. In the method of the present invention, the shooter first sets the range finding and compensating scope to a first LRF display mode and aims or aligns the primary aiming mark directly at the target surface whereupon the LRF can sense the LOS range; once the EHP is determined, the scope then switches to a second shooting display mode where the shooter then sees at least one illuminated or displayed sloped row of wind dots which are configured to provide the shooter with a very indication of the hold points for a range of left wind and right wind holds for the EHP range.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

BRIEF DESCRIPTION OF THE DRAWINGS

FIG. 1E is a diagram illustrating a projectile weapon aiming system in use, when aiming at a selected target, as found in the prior art.

FIGS. 10A, 10B, 10C, 10D and 10E illustrate tabular data on exemplary transportable placards summarizing ballistics information about a selected projectile for use in finding Density Altitude ("DA") adaptability factors which are preferably also programmed into the Micro Processor of the range finding and aim compensating system scope of FIG. 2C as part of the aim compensation method of the present invention.

FIG. 11 illustrates tabular data on an exemplary transportable placard summarizing ballistics information about a second selected projectile which allows use of the Density Altitude ("DA") adaptability factors which are preferably also programmed into the Micro Processor of the range finding and aim compensating system scope of FIG. 2C as part of the aim compensation method of the present invention. These ammunition dependent ballistic factors are part of the adaptive variation in the aim compensation method allowing a shooter in the field to adapt to changes in available ammunition and compensate for those variations as if they were variations in atmospheric conditions, in accordance with the present invention.

DETAILED DESCRIPTION OF THE PREFERRED EMBODIMENTS

Figure 1A:
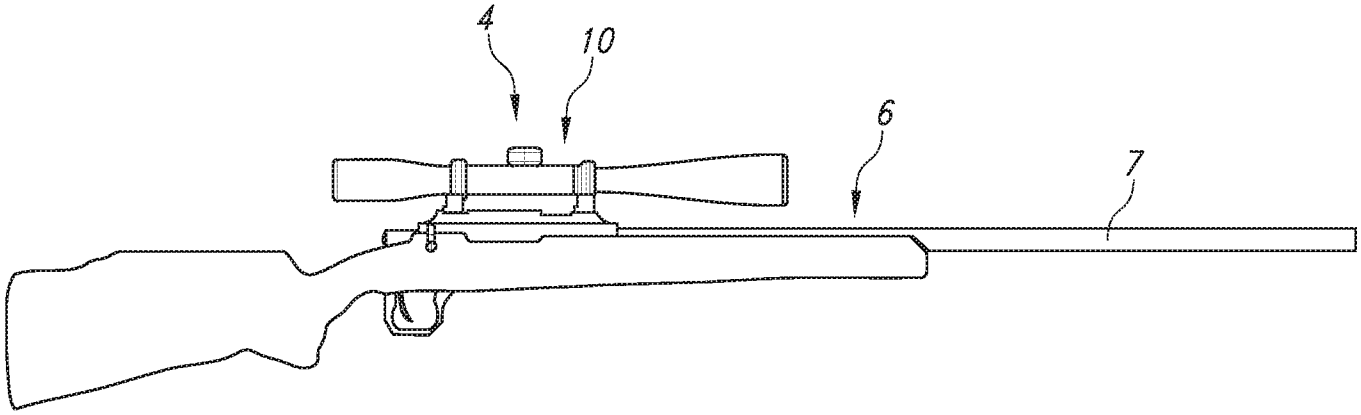
(PRIOR ART) FIG. 1A
FIG. 1A illustrates a typical rifle 6 with a rifle scope 10, or more generally, a sight or projectile weapon aiming system 4, in accordance with the prior art.
Figure 1B:
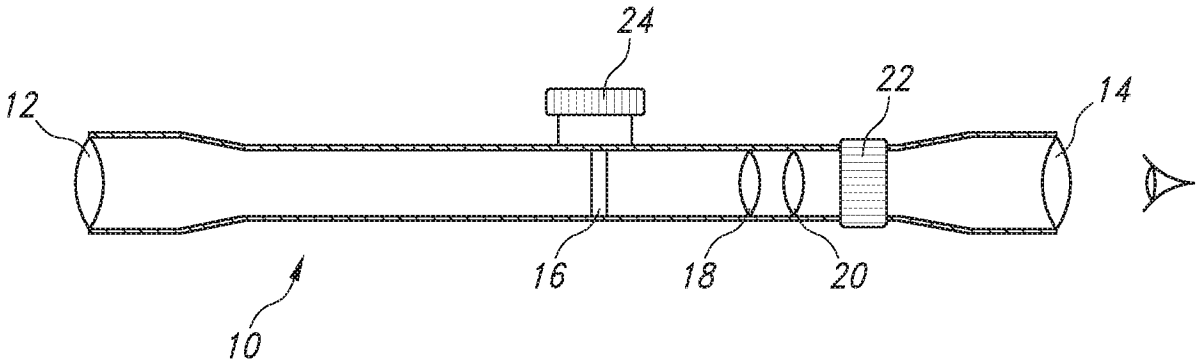
(PRIOR ART) FIG. 1B
FIG. 1B illustrates a schematic view in cross section of the basic internal elements of a typical rifle scope such as the rifle scope 10 of FIG. 1A, in accordance with the prior art.

In order to provide context for the present invention, please refer again to Prior Art FIGS. 1A-1M. FIG. 1A's projectile weapon system 4 including a rifle 6 with a barrel 7 and a telescopic rifle sight or projectile weapon aiming system 10 are illustrated in the standard configuration where the rifle's barrel 7 terminates distally in an open lumen or muzzle and rifle scope 10 is mounted upon rifle 6 in a configuration which allows the rifle system 4 to be adjusted such that a user or shooter sees a Point of Aim ("POA") in substantial alignment with the rifle's Center of Impact ("COI") when shooting or firing selected ammunition (not shown) at a selected target (e.g., 28). FIG. 1B schematically illustrates exemplary internal components for telescopic rifle sight or projectile weapon aiming system 10. As noted above, rifle scope 10 generally includes a distal objective lens 12 aligned with a proximal ocular or eyepiece lens 14 at the ends of a rigid and substantially tubular body or housing, with a reticle screen or glass 16 disposed therebetween. Variable power (e.g., 5-15 magnification) scopes also include an erector lens 18 and an axially adjustable magnification power adjustment (or "zoom") lens 20, with some means for adjusting the relative position of the zoom lens 20 to adjust the magnification power as desired (e.g., a circumferential adjustment ring 22 which moves zoom lens 20 toward or away from the erector lens 18). Variable power scopes, as well as other types of telescopic sight devices, also often include a transverse position control 24 for transversely adjusting the reticle screen 16 to position an aiming point or center of the aim point field thereon (or adjusting the alignment of the scope 10 with the firearm 6), to adjust vertically for elevation (or bullet drop) as desired. Scopes also conventionally include a transverse windage adjustment for horizontal reticle screen control as well (not shown).

Figure 4:
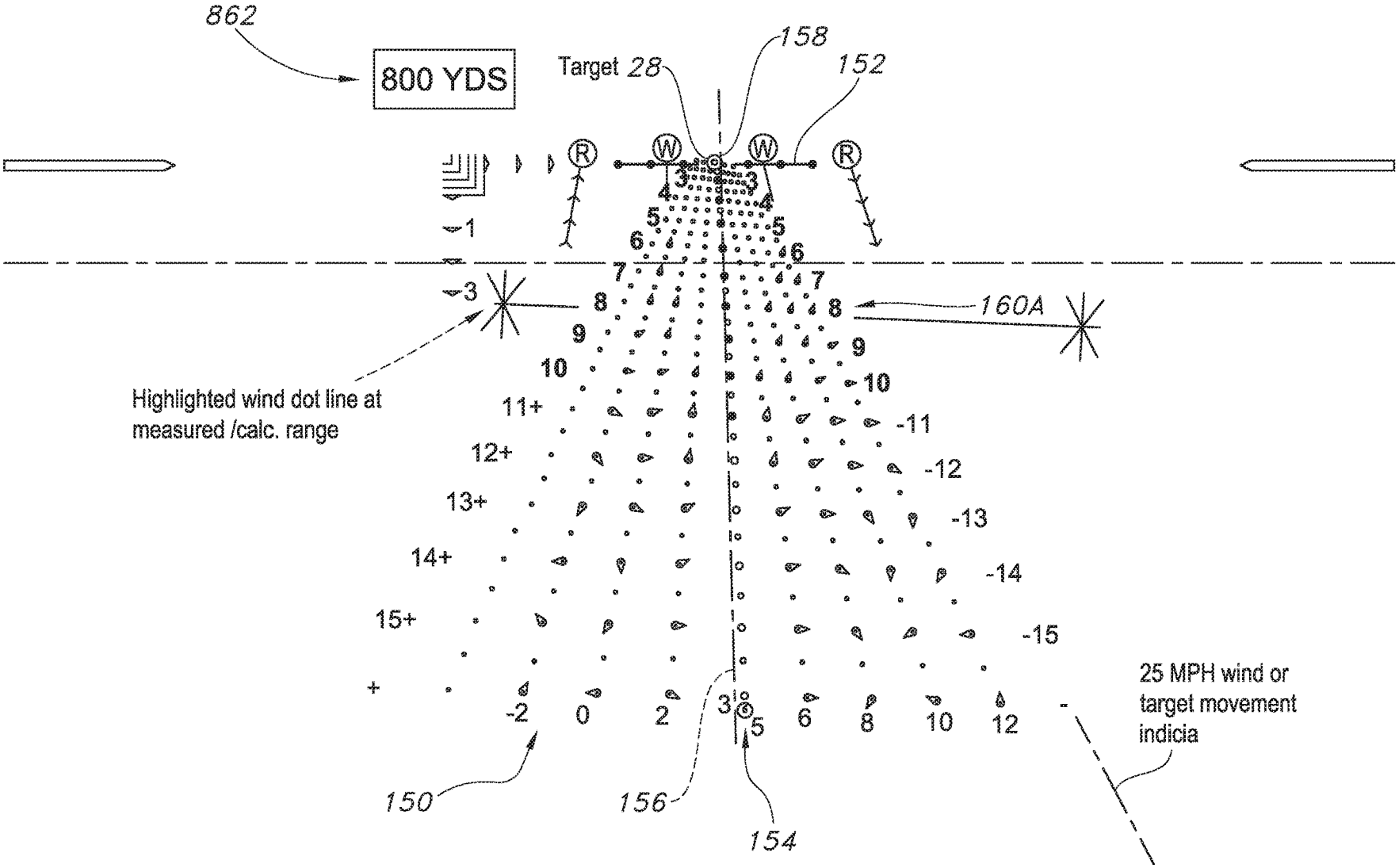
FIG. 4 illustrates the reticle of FIG. 2D of the range finding and aim compensating system of FIGS. 2A, 2B, 2C and FIG. 3, when designating an optimal Effective Hold Point's sloped row of wind dots for a selected target 28 using the sensing and aim compensation method, in accordance with the present invention.

While an exemplary variable power LRF equipped scope 804 (see, e.g., FIG. 2A) is used in the illustrations, it will be understood that the range-finding and compensating scope with a ballistic effect compensating reticle and system of the present invention may be used with other types of sighting systems or scopes in lieu of the variable power scope shown. For example, a LRF scope system such as L10 (illustrated in FIG. 1G) may be modified to include the reticle of the present invention (e.g., 150, 350 or 650). Alternatively, an LRF subassembly and microprocessor may be incorporated into a digital electronic scope which operates using the same general principles as digital electronic cameras, with an electronic display providing the reticle image for the shooter. The range finding and aim compensating system and aim compensation method for rifle sights or projectile weapon aiming systems of the present invention (and as set forth below and in the appended claims) may be employed with these other types of sighting systems or scopes, using a modified version of the variable power LRF scope L12 of FIG. 1H (e.g., 804 as illustrated in FIGS. 2A-2D). The modification includes incorporating the applicant's reticles (e.g., with applicant's DTR™ aim point fields 150, 350 or 650) or 350) which are configured to be selectively actuable to illuminate or designate two new features, namely, a LRF aim point (for ranging) and one or more selected slanted rows of downrange wind dot lines (e.g., for 800 yds, as illustrated in FIGS. 2D and 4).

Figure 2A:
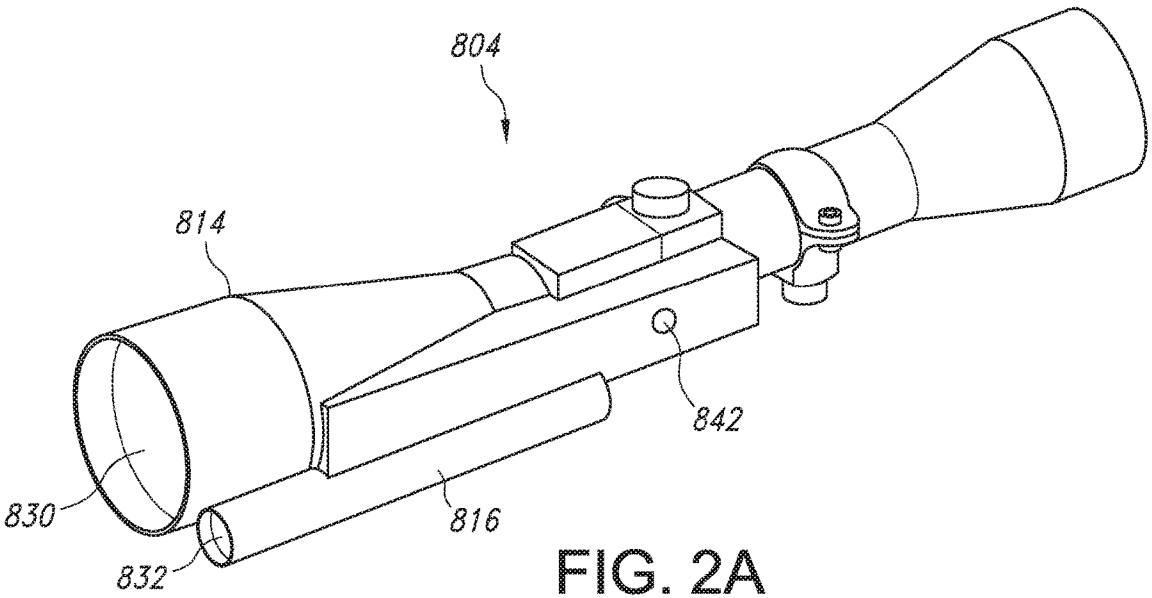
FIG. 2A is a perspective view, in elevation, illustrating an exemplary external configuration for a range finding and aim compensating rifle scope system including a LRF sensing and ballistic effect compensating reticle, in accordance with the present invention.
Figure 2B:
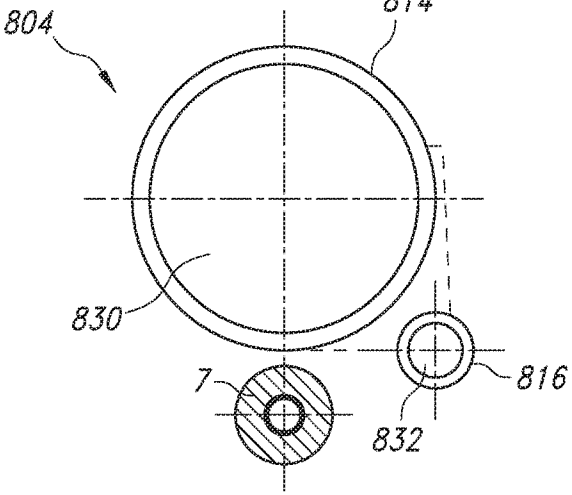
FIG. 2B is a distal or objective lens and view, in elevation, illustrating an exemplary external configuration for the range finding and aim compensating rifle scope system including the LRF sensing and ballistic effect compensating reticle of FIG. 2A, in accordance with the present invention.
Figure 2C:
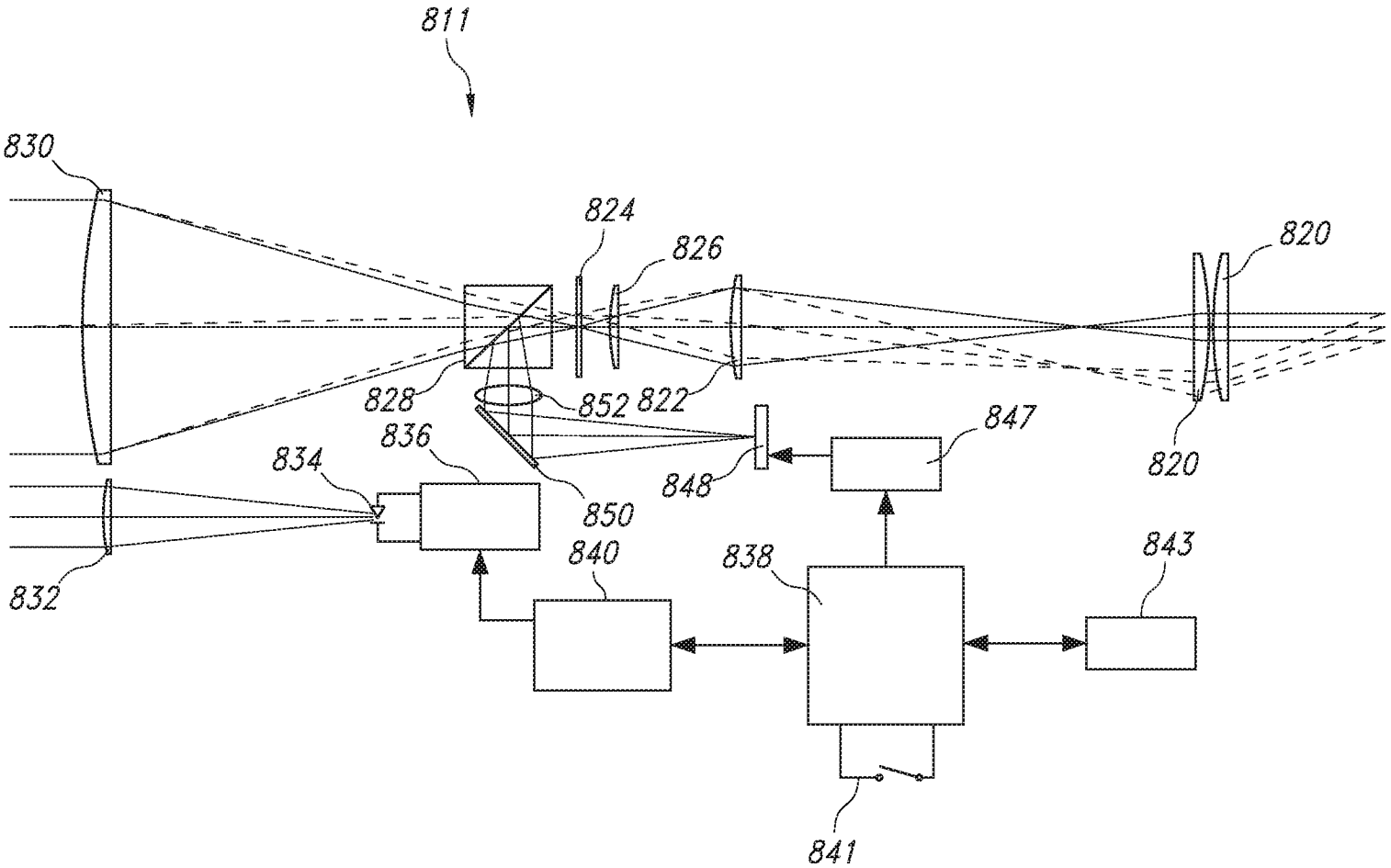
FIG. 2C is a schematic diagram illustrating an exemplary system element configuration for the range finding and aim compensating rifle scope system including the LRF sensing and ballistic effect compensating reticle of FIGS. 2A and 2B, in accordance with the present invention.
Figure 2D:
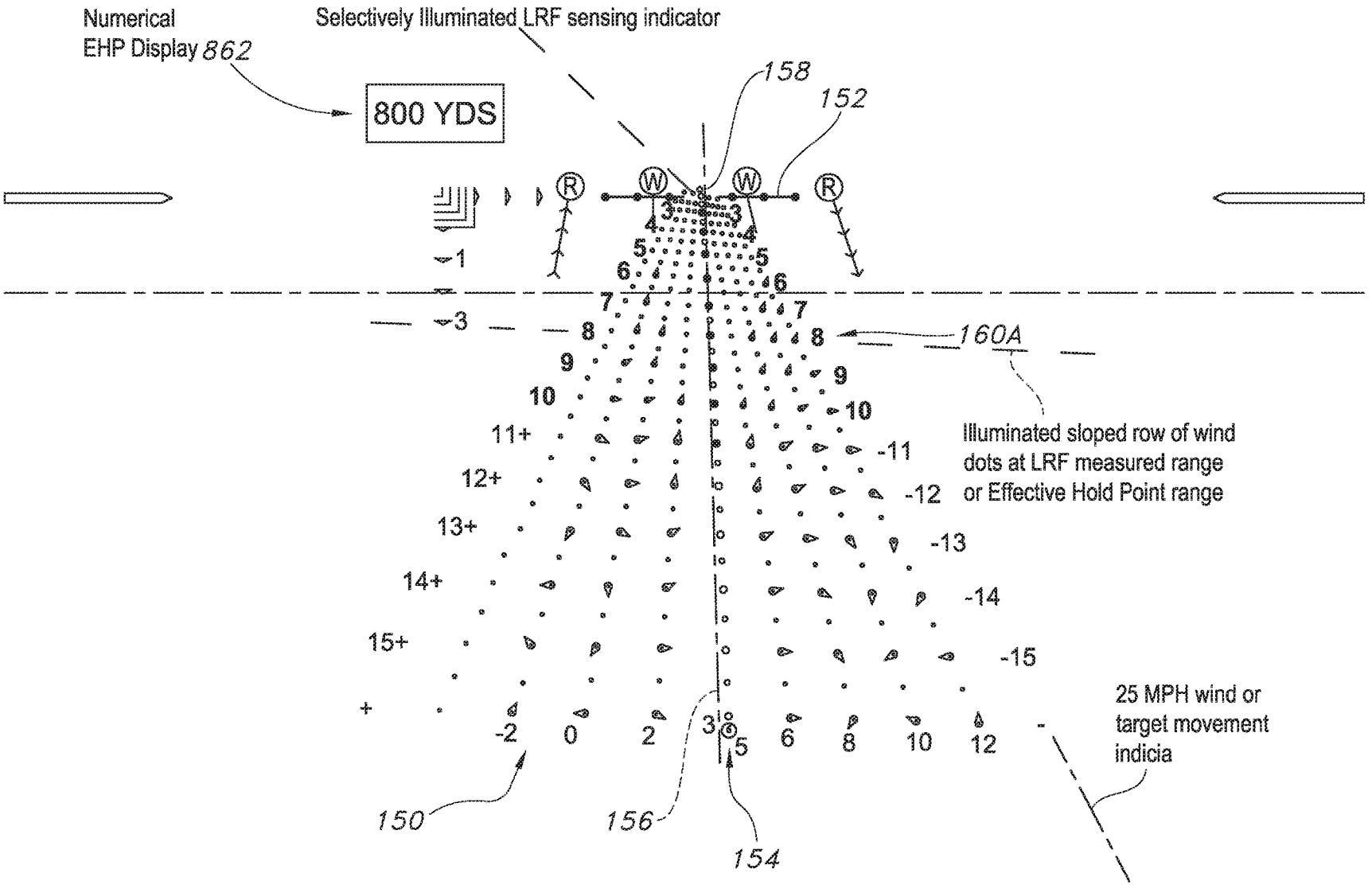
FIG. 2D illustrates a first exemplary embodiment of the ballistic effect compensating reticle configuration for use with the range finding and aim compensating rifle scope system of FIGS. 2A, 2B and 2C, for use in the target range sensing and aiming method of the present invention.

Turning next to FIGS. 2A-2C, an exemplary embodiment for a range finding and aim compensating rifle scope 804 includes LRF sensing and the ballistic effect compensating reticle of the present invention. FIG. 2B is a distal or objective lens and view of range finding and aim compensating rifle scope 804 and FIG. 2C is a schematic diagram illustrating an exemplary system element configuration 811 for the range finding and aim compensating rifle scope 804, in the illustrated example. Range finding and ballistic effect compensating rifle scope 804 includes eyepiece lenses 820, an intermediately disposed erector lens 822 (either fixed or zoom), a DTR™ reticle 824 and field lens 826 disposed between the erector lens 822 and a prism 828, all aligned axially with an objective lens 830. Prism 828 performs the functions of tapping off the infrared light to a detector (not shown) and bringing the light from the display 848 into the optical field visible by the user behind the ocular lenses 820. Objective lens 830 is aligned along an axis which is parallel to the central or aiming axis of laser range-finding scope sensor subassembly 816 which includes a collimating lens 832 in substantially collinear position relative to the objective lens 830 and rifle barrel 7 (as best seen in FIG. 2B).

Range-finding component subassembly 816 may be a near infrared laser projector consisting of a pulsed laser diode 834 in communication with the collimating lens 832, again mounted in an aligned or adjacent fashion relative to the objective lens 830 of the erect image telescope 804 to produce a small spot of light (e.g., at a range of 1000 yards or more). Range-finding component subassembly 816 is aligned or connected to scope body 814 and is shown in dashed lines in FIG. 2B because it may be housed in a separate housing which is mounted elsewhere on the rifle. The operating requirement for the range finding and aim compensating system 810 and method of the present invention is that Objective lens 830 is aligned along an axis which is parallel to the central or aiming axis of laser range-finding scope sensor subassembly 816 (which may be housed with or separate from scope housing 814) so long as collimating lens 832 is in substantially collinear position relative to the objective lens 830 and rifle barrel 7 (as best seen in FIG. 2B).

Returning to the exemplary embodiment of FIG. 2C, a pulse generator 836 operates the laser diode 834 and is in communication with a pre-programmed microprocessor 838 and control circuit 840. Microprocessor 838 is preferably activated upon closing a switch 841, also referenced by pushbutton 842 located upon the riflescope housing 814 in FIG. 2A, to engage and actuate control circuit 840 and laser generator 836, where a suitable switch or pushbutton can optionally be located upon a forestock portion associated with the projectile firing device (e.g., similar to rifle 6) or another user accessible location. Following the steps of laser projection, detection and timer measurement, information is input to microprocessor 838. A data interface 843 is configured to receive commands and data by physical connection or wirelessly from user provided tablet or smart phone devices (not shown) and is also in operative communication with the microprocessor 838 which permits the downloading of external ballistic and environmental data for access by microprocessor 838.

In the illustrated example, LRF scope system 811 includes circuitry connected and responsive to a laser or IR detector (not shown) located in proximity to the prism 828 and communicating with control circuit 840. The laser or IR detector (not shown) is preferably capable of being illuminated through the scope's objective lens 830, so both the laser projector and the laser or IR detector are "zeroed" in relationship to the DTR™ reticle 824. The laser generator 836 and control circuit 840, in operation, progress through a number of pulse timing iterations until a constant time delay value is obtained and which is indicative of a valid range measurement (in a known manner). Upon communicating this range measurement information to the microprocessor 838, an output thereof is communicated to a display driver 847 and which is in turn communicated to a light emitting display 848. Angled mirror 850 redirects the projected light or image from display 848, which is then passed through a display lens 852 and into prism 828 in response to an Effective Hold Point ("EHP") range calculation undertaken in response to a program which controls microprocessor 838. In a preferred embodiment, the EHP range is displayed numerically in the reticle image for the user (e.g., "800 YDS" as seen in FIG. 2D). Display 848 is preferably configured to display an illuminated or highlighted sloped row of wind dot indicia (e.g., aligned along the sloped axis near the numeral "8", as shown in FIG. 2D) corresponding to the calculated, adjusted or optimal EHP range to be used by the shooter when actually aiming at the target.

While variable power scopes typically include two focal planes, the reticle screen or glass (e.g. 16 or 824) used in connection with the reticles of the present invention (e.g., with aim point fields 150, 350 or 650) is preferably positioned at the first or front focal plane ("FP1") between the distal objective lens (e.g. 12 or 830) and the erector lens (e.g. 18 (or 822 as seen in FIG. 2C)), in order that the reticle thereon will change scale correspondingly with changes in magnification as the power of the scope is adjusted. This results in reticle divisions subtending the same apparent target size or angle, regardless of the magnification of the scope. In other words, a target subtending two reticle divisions at a relatively low magnification adjustment, will still subtend two reticle divisions when the power is adjusted, to a higher magnification, at a given distance from the target. This reticle location is preferred for the present system when used in combination with a variable power firearm scope. Alternatively, the reticle screen (e.g. 16 or 824) may be placed at a second or rear focal plane between the zoom lens 20 and proximal eyepiece 14, if so desired, since the stadia lines usually used for range estimation become less important with the addition of the LRF feature in the range finding and aim compensating system of the present invention. Such a second focal plane reticle will remain at the same apparent size regardless of the magnification adjustment to the scope, which has the advantage of providing a full field of view to the reticle at all times. However, the reticle divisions will not consistently subtend the same apparent target size with changes in magnification, when the reticle is positioned at the second focal plane in a variable power scope.

Figure 1C:
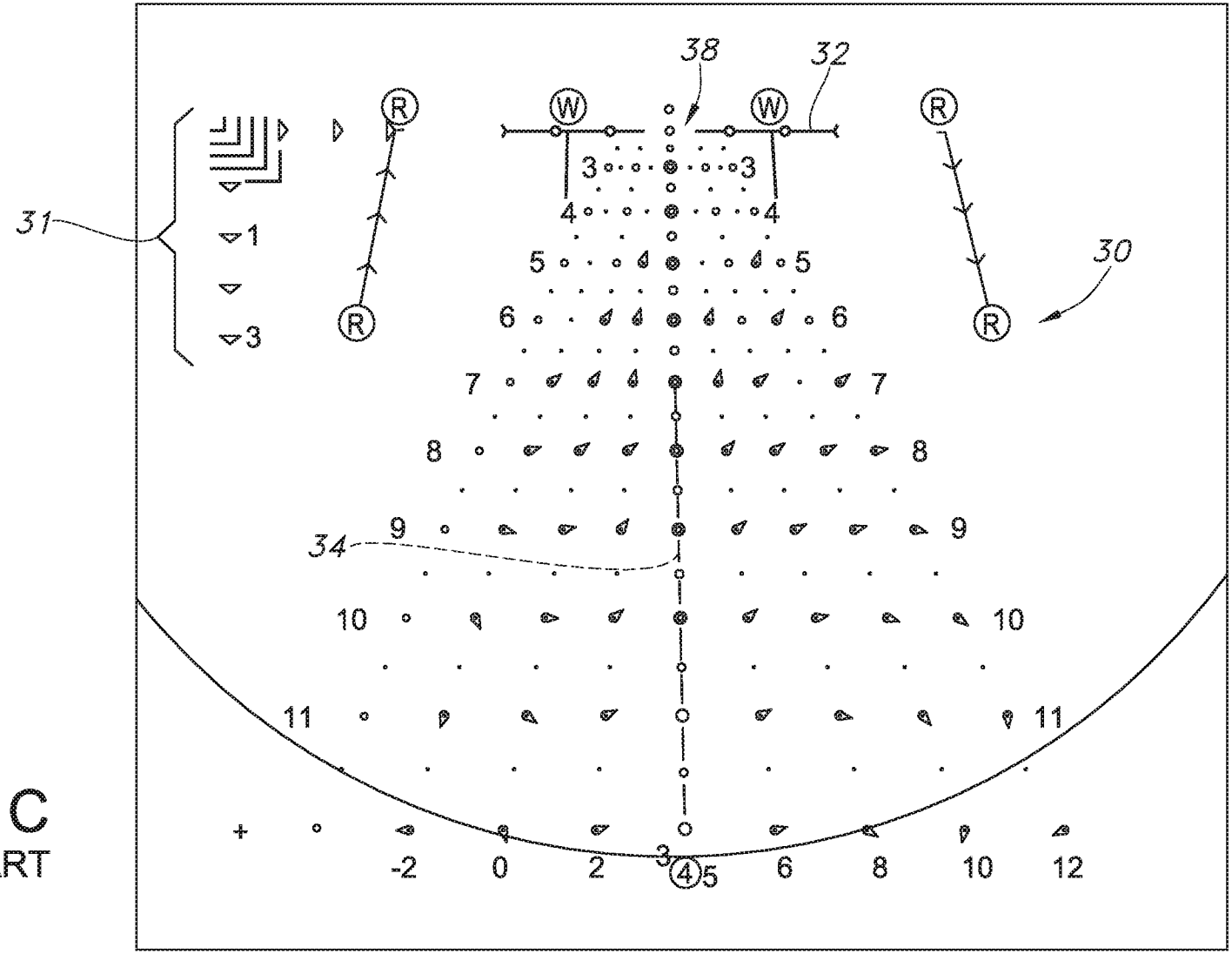
FIG. 1C PRIOR ART
FIG. 1C illustrates a rifle scope reticle for use in the rifle scope 10 of FIGS. 1A and 1B, and having an earlier revision of applicant's DTAC™ reticle elevation and windage aim point field, as seen in the prior art.
Figure 1D:
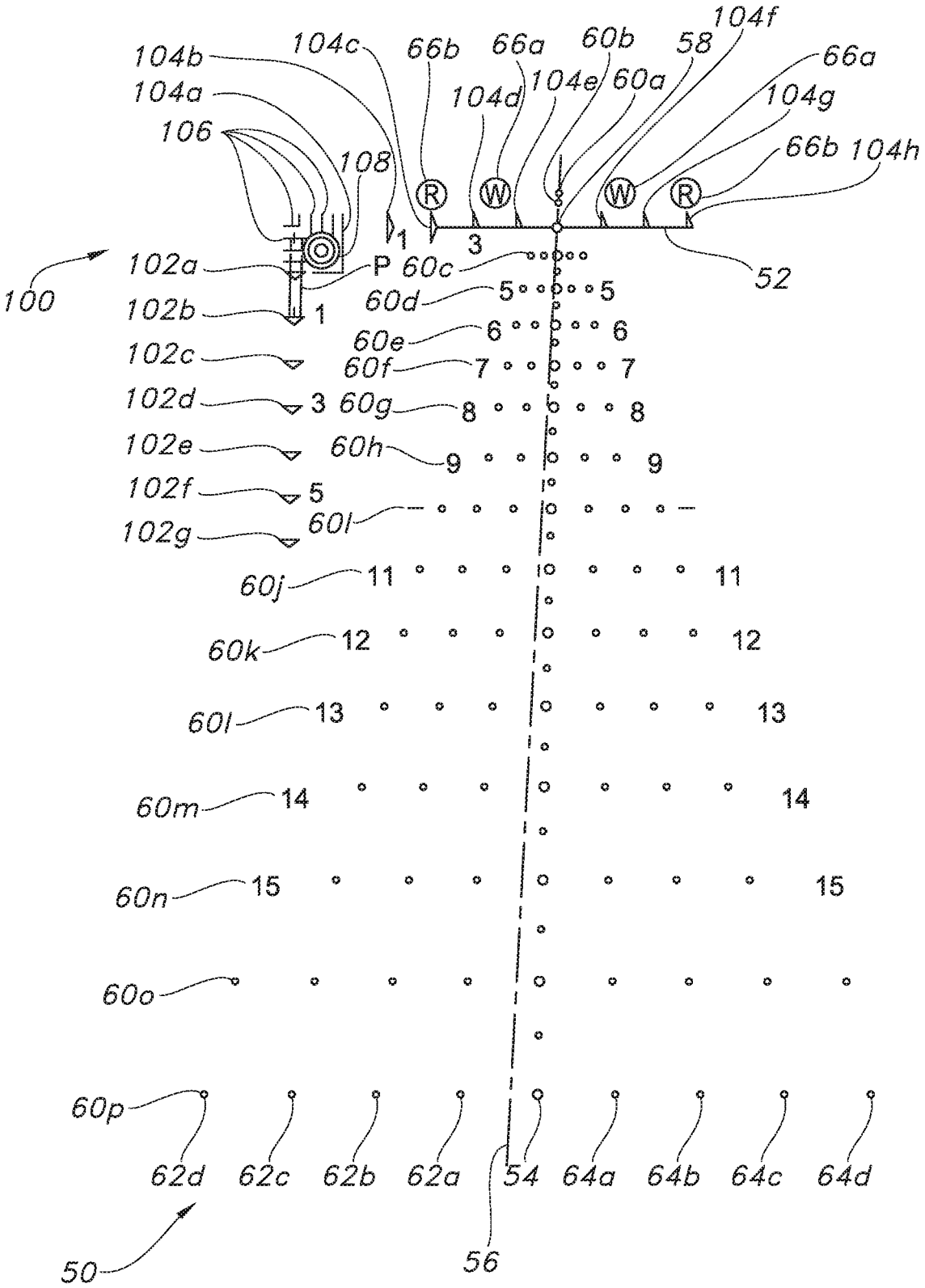
FIG. 1D PRIOR ART
FIG. 1D illustrates a rifle scope reticle for use in the rifle scope of FIGS. 1A and 1B, and applicant's previous DTAC™ Reticle, as described and illustrated in applicant's own U.S. Pat. No. 7,325,353, in the prior art.
Figure 1E:
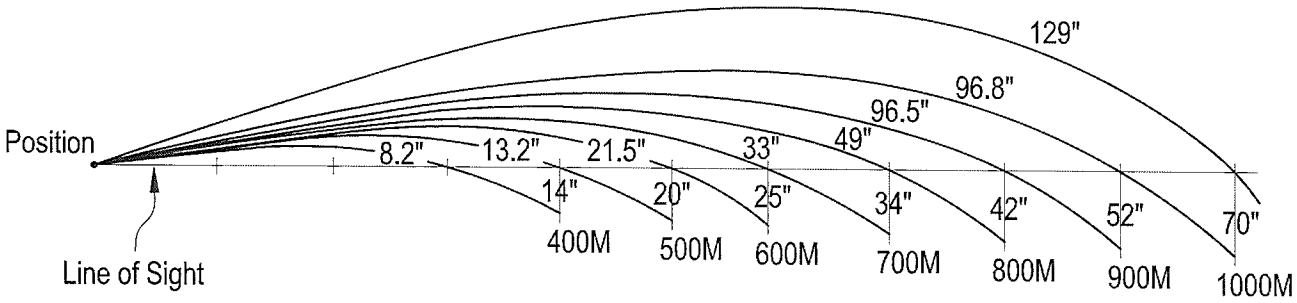
FIG. 1E PRIOR ART
FIG. 1E is a chart taken from a U.S. Gov't publication which illustrates the trajectory of a selected 7.62×51 (or 7.62 NATO) projectile for sight adjustment or "zero" settings from 300 meters to 1000 meters
Figure 1F:
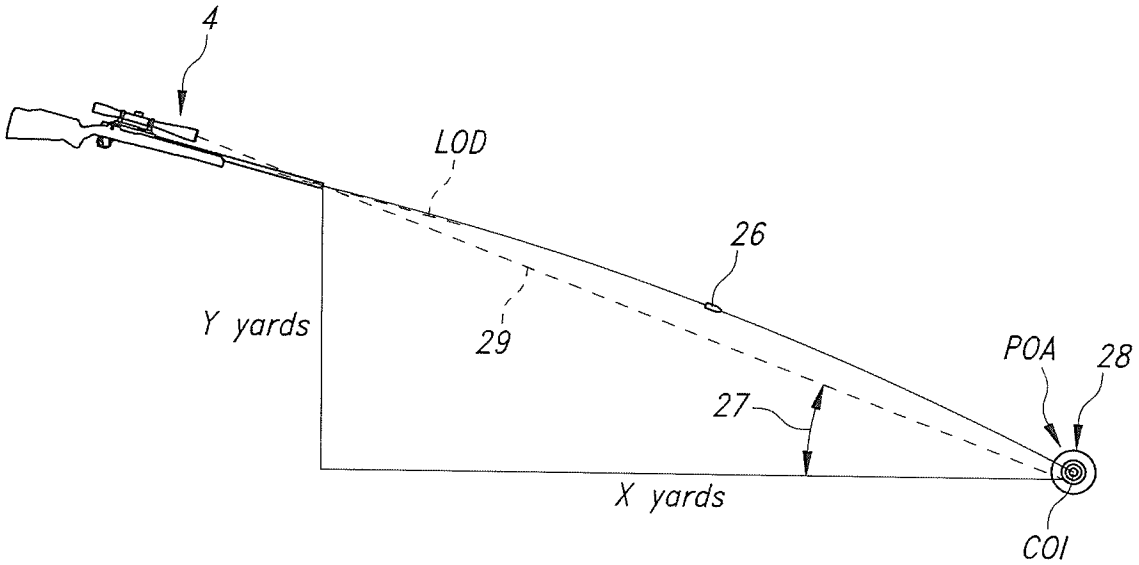
FIG. 1F PRIOR ART
FIGS. 1G-1M illustrate Scrogin's LRF rifle scope system, as described and illustrated in prior art U.S. Pat. No. 7,516,571, which provide useful background and nomenclature for the components used in prior art LRF rifle scopes.
Figure 1G:
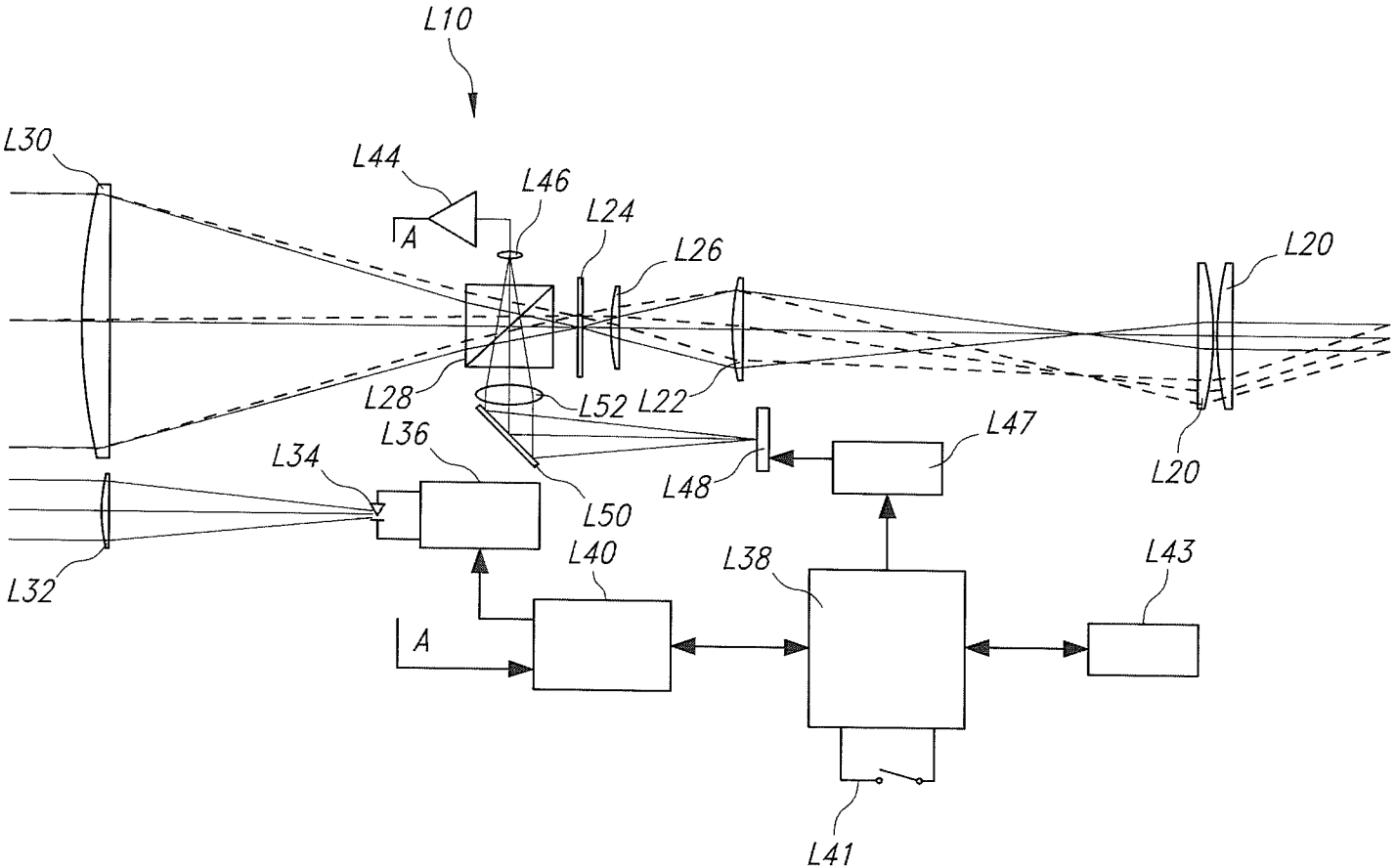
FIG. 1G PRIOR ART
Figure 1H:
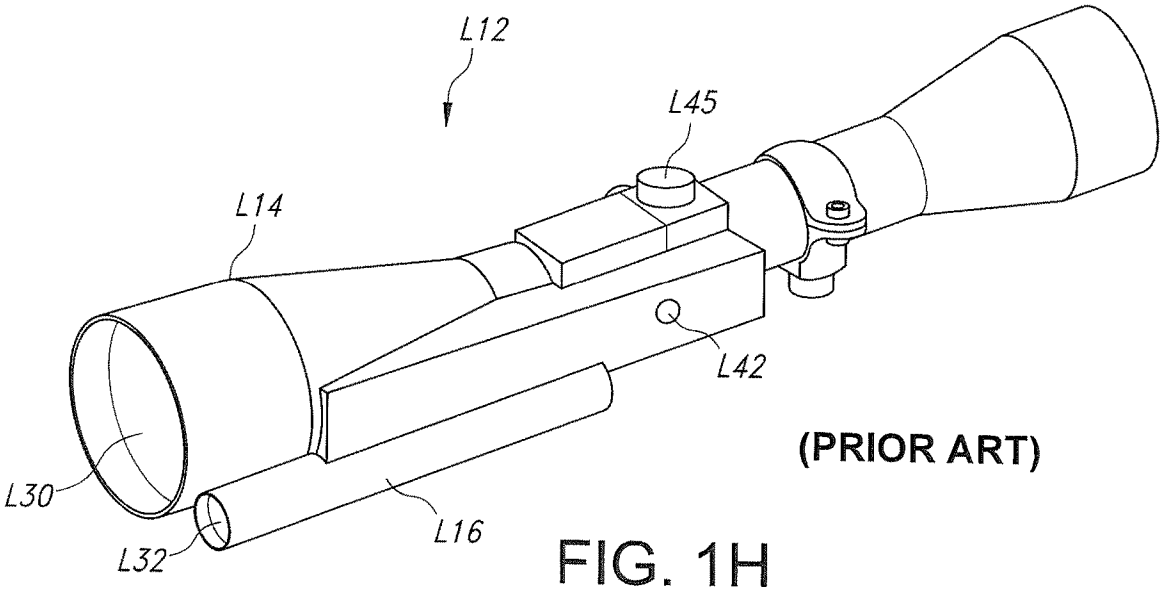
(PRIOR ART) FIG. 1H
Figure 1I:
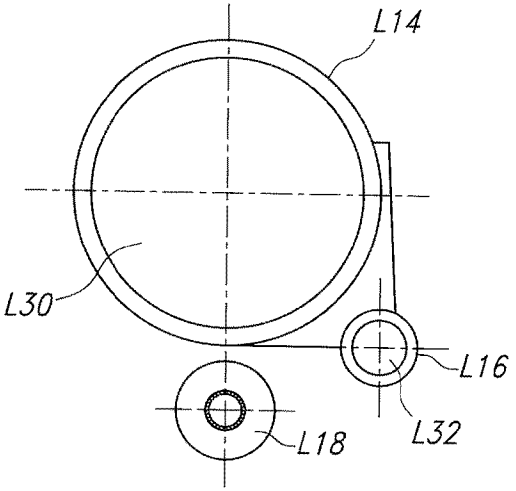
(PRIOR ART) FIG. 1I
Figure 1J:
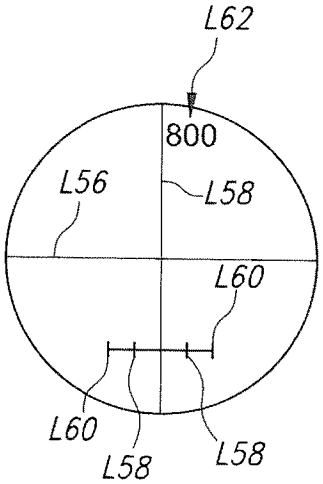
Figure 1K:
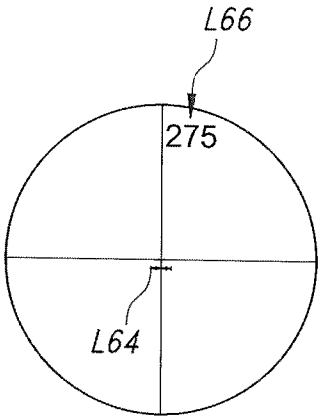
(PRIOR ART) FIG. 1K
Figure 1L:
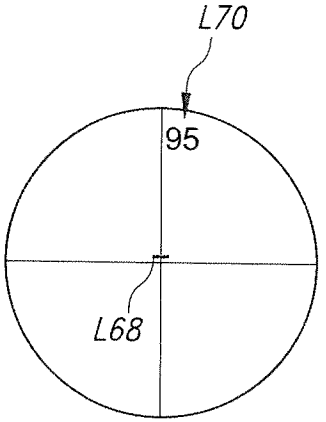
Figure 1M:
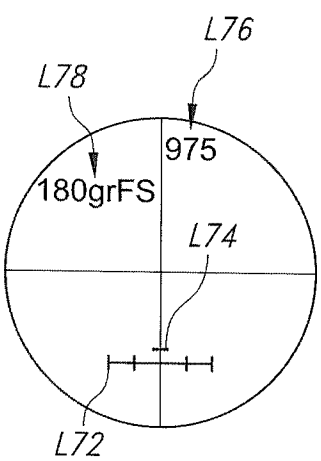
(PRIOR ART) FIG. 1M

As noted above, the applicant's prior art DTAC™ reticles (e.g., as shown in FIGS. 1C and 1D) provided improved aids to precision shooting over long ranges, such as the ranges depicted in FIG. 1E. But more was needed, because applicant observed that crosswinds at elevations so far above the line of sight varied significantly from the winds closer to the line of sight (and thus closer to the earth's surface). In the study of fluid dynamics, scientists, engineers and technicians differentiate between fluid flow near "boundary layers" (such as the earth) and fluid flow which is unaffected by static boundaries and thus provides "laminar" or non-turbulent flow. The LRF ballistic effect compensating system 810 and the reticle of FIGS. 2A-9D is configured to aid the shooter by provided long-range aim points which more accurately predict the effects of recently studied combined ballistic and atmospheric effects, and the inter-relationship of these external ballistic effects as observed and recorded by the applicant have been plotted as part of the development work for the new range-finding (e.g., LRF) and compensating scope 804 used in the system of the present invention.

Referring next to FIGS. 2A-4, range-finding and ballistic effect compensating reticle and system 810 includes a LRF Rifle Scope 804 with a reticle (e.g., 200, 300 or 600) with a multiple point elevation and windage aim point field (e.g., 150, 350 or 650) including a primary aiming mark (e.g., 158, 358 or 658) indicating (a) a primary aiming point adapted to be sighted-in at a first selected range and (b) the locus of the LRF beam for sensing range during the LRF sensing display mode operation, as will be described below. The aim point field (e.g., 150, 350 or 650) also includes a plurality of secondary aiming points arrayed beneath the primary aiming mark aligned as the sloped row of downrange wind dots illustrating aim points for a range of crosswind conditions at the measured and adjusted (calculated) range (e.g., 29). The method for compensating for a projectile's ballistic behavior while developing a field expedient firing solution permits the shooter to sense or measure the LOS range to target 29, and then use slope angle 27, other environmental data such as actual Density Altitude ("DA") and, if necessary changed ammunition ballistics data to calculate an adjusted range call or Effective Hold Point ("EHP") range, as described below, to determine the EHP range to display (e.g., 800 yards). The method optionally (preferably) includes sensing or inputting the slope angle 27, the local or nominal air density ballistic characteristics (e.g., as a DA value) and the crosswind velocity (e.g., mph or kph), for windage hold points. The adaptive method of the present invention allows a shooter in the field to adapt to changes in available ammunition (e.g., from M118LR to M80 ammunition) and compensate for variations in ammunition as well as changes in atmospheric conditions.

Figure 5:
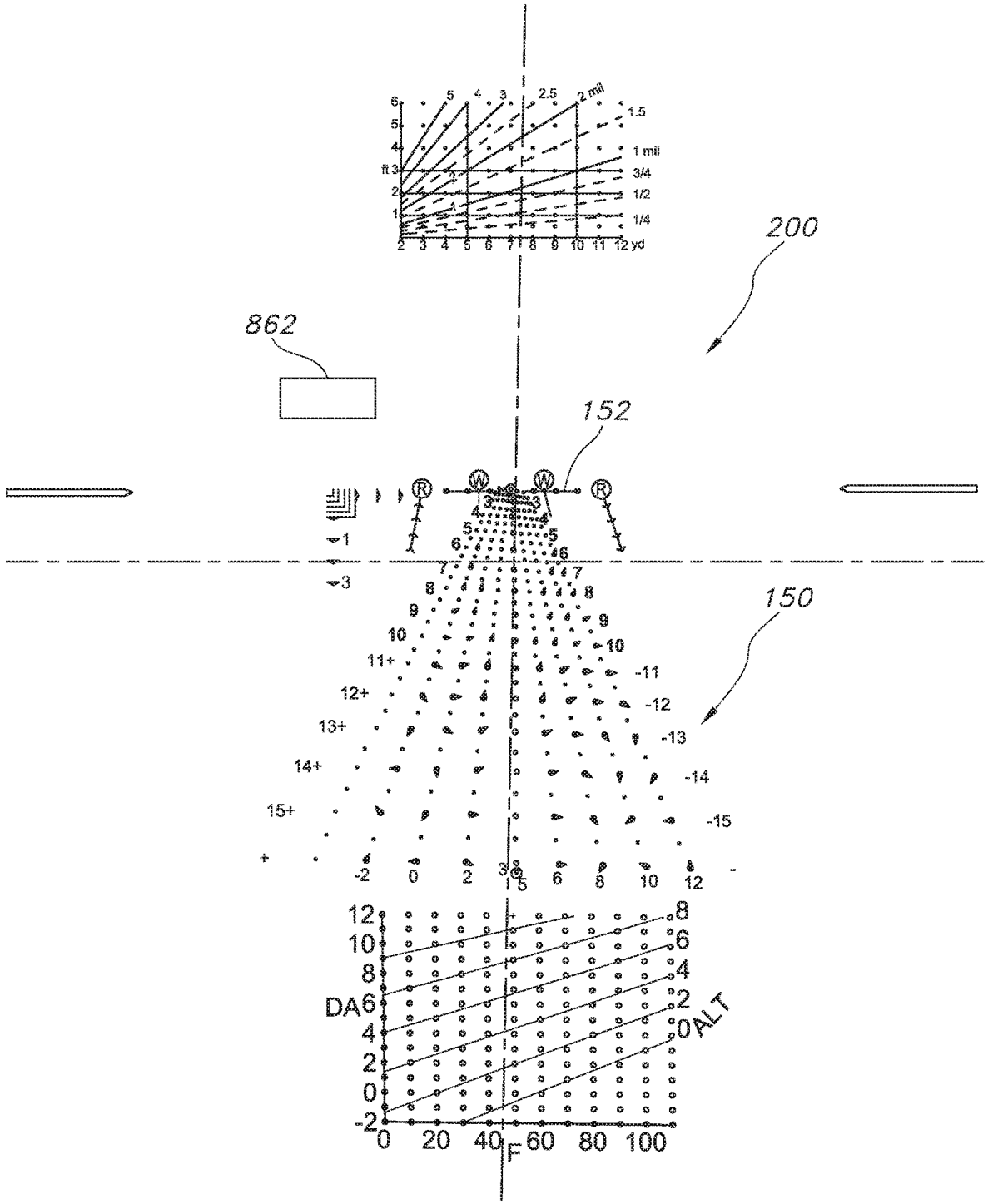
FIG. 5 illustrates a multi-nomograph reticle embodiment of the range finding and aim compensating system and aim compensation method of FIGS. 2A, 2B, 2C, 2D, 3 & 4, in accordance with the present invention.

The system 810, reticle (e.g., with aim point fields 150, 350 or 650) and method of present invention as illustrated in FIGS. 2-9D is adapted particularly for use with hand held firearms (e.g., Rifle system 810) having magnifying rifle scope sights (e.g., incorporated in LRF equipped scope assembly 804). The DTR™ reticle system as illustrated in FIGS. 2D, 4 and 5 includes an aim point field 150 with a main horizontal crosshair 152 comprising a linear horizontal array of aiming indicia. The range finding and aim compensating system and reticle of FIGS. 2-9D is configured for use with any projectile weapon, and especially with a sight such as rifle scope configured for developing rapid and accurate firing solutions in the field for long Time of Flight ("TOF") and long trajectory shots, especially in cross winds. The aiming method and system 810 of the present invention are usable with or without Range Cards (described below) or pre-programmed transportable computing devices. The system and aiming method of the embodiment of FIGS. 2A-9D is adapted to predict the effects of combined ballistic and atmospheric effects that have an inter-relationship observed by the applicant and plotted in reticle aim point field (e.g., 150, 350 or 650), in accordance with the present invention.

The range finding and aim compensating system 810 and method of present invention as illustrated in FIGS. 2A-9D differs from prior art LRF scopes in that the sloped windage adjustment axes (e.g., 160A) are not horizontal, meaning that they are not simply range compensated horizontal aiming aids which are parallel to the main horizontal crosshair indicia array 152 and so are not perpendicular to either vertical reference crosshair 156 or substantially vertical central aiming dot line 154. For purposes of nomenclature, the phrases "sloped wind dot line" and "sloped wind dot array" mean an array of aiming indicia which are (a) below the main horizontal crosshair and (b) laterally spaced for different wind compensation holds in an array which is sloped and not horizontal, and so is clearly NOT parallel with a main horizontal crosshair, and is instead arrayed along a line which defines an acute angle with the main horizontal crosshair.

The sloped downrange wind dots in aim point field 150 (e.g., for 800 yards, along sloped row 160A) have been configured or plotted to aid the shooter by illustrating the inter-relationship of the external ballistic effects observed and recorded by the applicant as part of the development work for the system and method of the present invention. In reticle aim point field 150, the windage aim point indicia or laterally offset wind dots on each sloped array of wind dots are not symmetrical about the vertical reference line 156, meaning that a full value windage offset indicator (e.g. 5 mph) on the left side of vertical crosshair 156 is not spaced from vertical crosshair 156 at the same distance as the corresponding full value windage offset indicator (e.g. 5 mph) on the right side of the vertical crosshair, for a given wind velocity offset.

As noted above, the LRF scope reticles of the prior art (e.g., as illustrated in FIGS. 1J-12M) include a vertical crosshair intended to be seen (through the riflescope) as being precisely perpendicular to a horizontal crosshair that is parallel to the horizon when the rifle is held level to the horizon with no angular variance from vertical (or "rifle cant"). Those prior art LRF scope range-indicating reticles indicate range with horizontal "sight lines" (e.g., L60, L64, L68 and L72) which are divided with evenly spaced indicia on both sides of the vertical crosshair. These prior art LRF range-compensating or bullet drop compensating reticles effectively represent a prediction of where a bullet will strike a target, and that prior art prediction includes an assumption that any windage aiming offset to the left (for left wind) is going to be identical to and symmetrical with a windage aiming offset to the right (for right wind). Another assumption built into the prior art LRF scope reticles pertains to the predicted effect on elevation arising from increasing windage adjustments, because the prior art reticles predict that no change in elevation (i.e., holdover) should be made, no matter how much windage adjustment is needed. This second assumption is demonstrated by the fact that the prior art reticles all have straight and parallel secondary horizontal crosshairs (e.g., as illustrated in FIGS. 1J-12M). These assumptions are wrong, which led to the development of the present invention.

The applicant of the present invention re-examined these assumptions and empirically observed, recorded and plotted the actual ballistic performance for a series of carefully controlled shots at selected ranges, and the plotted observations have been used to develop improved reticle aim point field (e.g., 150) which has been demonstrated to be a more accurate predictor of the effects of atmospheric and environmental conditions on a bullet's flight.

Experimental Approach and Prototype Development:

As noted above the reticle systems (e.g., 200, 300 and 600) and the method of the present invention are useful to predict the performance of specific ammunition fired from a specific rifle system (e.g., 6), but can be used with a range of other ammunition by using pre-defined correction criteria. The data for the reticle aim point field 150 shown in FIGS. 2D, 4 and 5 was generated using a Tubb 2000™ rifle with ammunition specially prepared for long distance precision shooting. The rifle was fitted with a RH twist barrel (1:9) for the results illustrated in FIGS. 2D-5. A second set of experiments conducted with a LH twist barrel (also 1:9) confirmed that the slope of the windage axes was equal magnitude but reversed when using a LH twist barrel, meaning that the windage axes rise (from right to left) at about a 5 degree angle and the substantially vertical central aiming dot line or elevation axis (illustrating the effect of spin drift) diverges to the left of a vertical crosshair (e.g., 156).

The range finding and aim compensating system of the present invention (e.g., 804) preferably includes an aim point field (e.g., 150) with a vertical crosshair 156 and a horizontal crosshair 152 which intersect at a right angle and also includes a plurality of windage adjustment axes (e.g., 160A) arrayed beneath horizontal crosshair 152. The windage adjustment axes (e.g., 160A) are angled downwardly at a shallow angle (e.g., five degrees, for RH twist), meaning that they are not secondary horizontal crosshairs each being perpendicular to the vertical crosshair 156. Instead, each windage axis defines an angled or sloped array of windage offset adjustment indicia. If a windage axis line were drawn through all of the windage offset adjustment indicia corresponding to a selected range (e.g., 800 yards), that windage axis line would slope downwardly from horizontal at a small angle (e.g., five degrees), as illustrated in FIGS. 2D, 4 and 5). In aim point field 150, at the 800 yard reference windage axis 160A, the right-most windage offset adjustment indicator (adjacent the "8" on the right) is one MOA below a true horizontal crosshair line and the left-most windage offset adjustment indicator (adjacent the "8" on the left) is one MOA above that true horizontal crosshair line.

As noted above, the windage offset adjustment indicia on each windage adjustment axis are not symmetrical about the vertical crosshair 156 or symmetrical around the array of elevation indicia or nearly vertical central aiming dot line 154. The nearly vertical central aiming dot line 154 provides a "no wind zero" for selected ranges (e.g., 100 to more than 1500 yards, as seen in FIGS. 2D and 5), and 10 mph windage offset adjustment indicator on the left side of substantially vertical central aiming dot line 154 is not spaced from central aiming dot line 154 at the same lateral distance as the corresponding (i.e., 10 mph) windage offset adjustment indicator on the right side of the vertical crosshair. Instead, the reticle and method of the present invention define differing windage offsets for (a) wind from the left and (b) wind from the right. Again, those windage offsets refer to elevation adjustment axis 154 which diverges laterally from vertical crosshair 156. The elevation adjustment axis or central aiming dot line 154 defines the diverging array of elevation offset adjustment indicia for selected ranges (e.g., in 100 yard increments).

The phenomena or external ballistic effects observed by the applicant are not anticipated in the prior art for rifle scopes, but applicant's research into the scientific literature has provided some interesting insights. A scientific text entitled "Rifle Accuracy Facts" by H. R. Vaughn, and at pages 195-197, describes a correlation between gyroscopic stability and wind drift. An excerpt from another scientific text entitled "Modern Exterior Ballistics" by R. L. McCoy (with appended errata published after the author's death), at pages 267-272, describes a USAF scientific inquiry into what was called "Aerodynamic Jump" due to crosswind and experiments in aircraft. Applicant's experiments have been evaluated in light of this literature and, as a result, applicant has developed a model for two external ballistics mechanisms which appear to be at work. The first mechanism is now characterized, for purposes of the system and method of the present invention, as "Crosswind Jump" wherein the elevation-hold or adjustment direction (up or down) varies, depending on whether the shooter is compensating for left crosswind (270°) or right crosswind (90°), and the present invention's adaptation to these effects is illustrated in FIGS. 2D-9B.

The second mechanism (dubbed "Dissimilar Wind Drift" for purposes of the system and method of the present invention) was observed as notably distinct lateral offsets for windage, depending on whether a crosswind was observed as left wind (270°) or right wind (90°). Referring again to FIG. 4, the lateral offset for the wind dots or aimpoint indicia that corresponds to a left wind (270°, meaning the dots on the right side, because one holds "into the wind") at 5 mph are spaced laterally closer to one another than the lateral offset for aimpoint indicia which corresponds to a right wind (90°) at 5 mph. The dissimilarity extends farther as wind speed increases, in that the lateral spacings between the 5 and 10 mph wind dots on the left side of the reticle are spaced farther apart than the lateral spacings between the 5 and 10 mph wind dots on the right side of the reticle.

Figure 3:
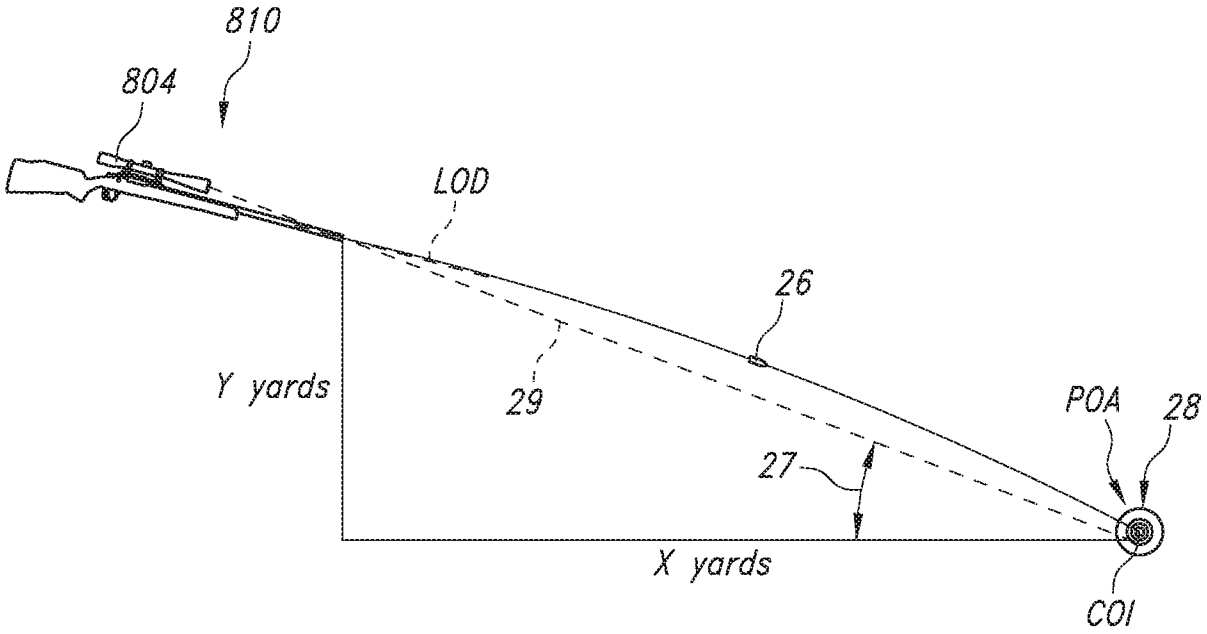
FIG. 3 illustrates the range finding and aim compensating system of FIGS. 2A, 2B, 2C and 2D in use, when aiming at a selected target using the sensing and aim compensation method, in accordance with the present invention.

Applicant's reticle system (e.g., 200, 300 or 600) permits the user or shooter to quickly align range finding and aim compensating system 810 toward a target of interest 28 (e.g., as shown in FIG. 3) and center that target in the reticle so that it appears in alignment with LRF aiming dot (e.g., central aiming indicia 158), whereupon the user actuates the LRF (e.g., closing switch 841 and energizing Laser generator 836), to obtain a LOS range measurement 29, which is preferably displayed in the reticle using a numerical indicia (e.g. 862) and at least one (nearest) sloped row of wind dot lines (e.g., 160A, in FIG. 4, indicating 800 yds). This allows the shooter to see and then choose a crosswind dependent aim point and the express a firing solution in EHP range (e.g., in yards) and crosswind velocity (e.g., in MPH) rather than angles (minutes of angle or MILS). Additionally the reticle aim point field (e.g., 150, 350 or 650) provides automatic correction for spin drift, crosswind jump and dissimilar crosswind drift, none of which are provided by any other LRF scope reticle. As a direct result of these unique capabilities, the shooter can develop precise long range firing solutions faster than with any other LRF scope reticle.

Figure 6:
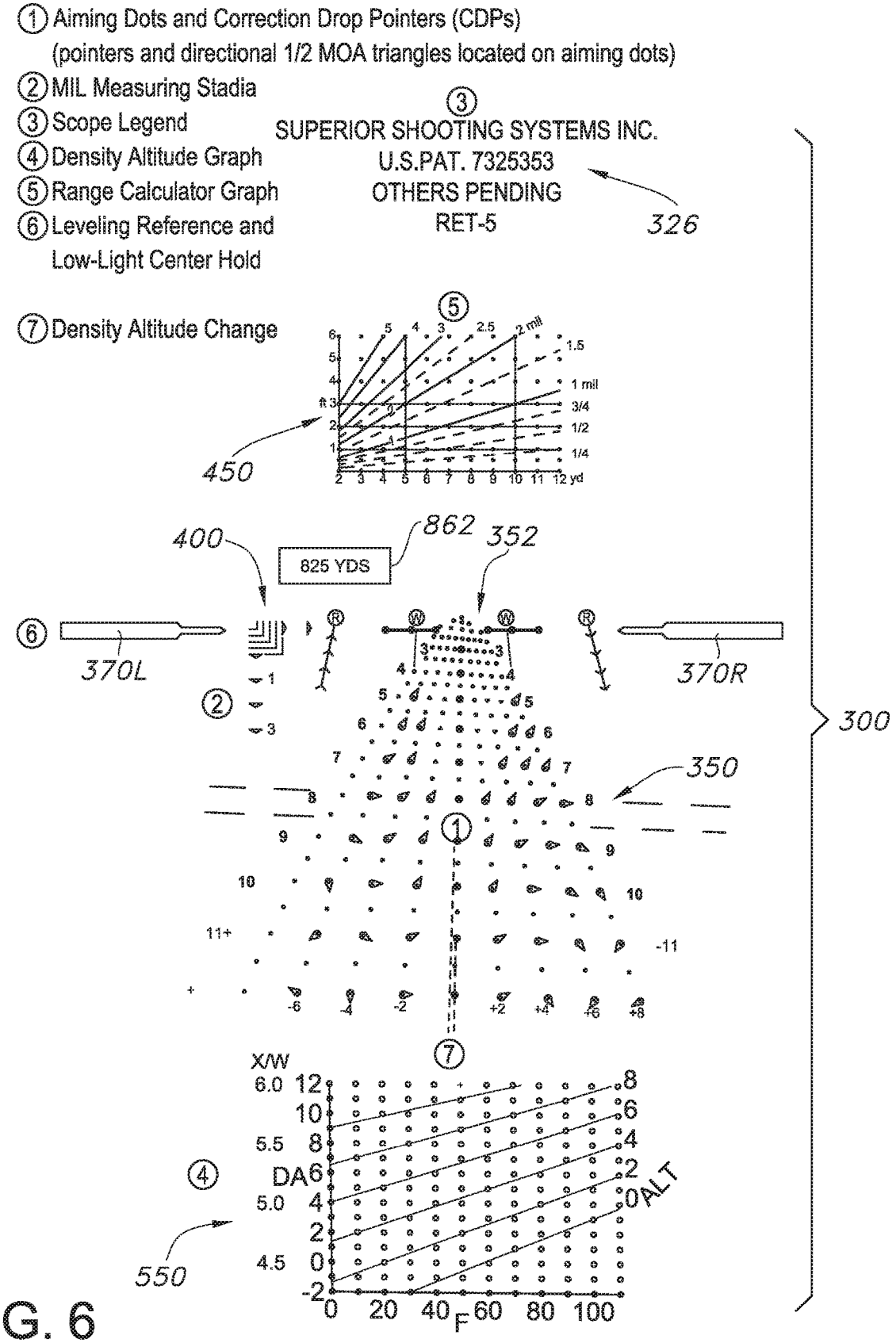
FIG. 6 illustrates another multiple nomograph reticle embodiment for use with the range finding and aim compensating system and aim compensation method of FIGS. 2A, 2B, 2C, 2D, 3 & 4, in accordance with the present invention. The multiple nomograph reticle of FIG. 6 is readily adapted for use with any projectile weapon, and especially with a rifle scope, when firing a selected ammunition such as USGI M118LR long range ammunition, in accordance with the present invention.
Figure 7:
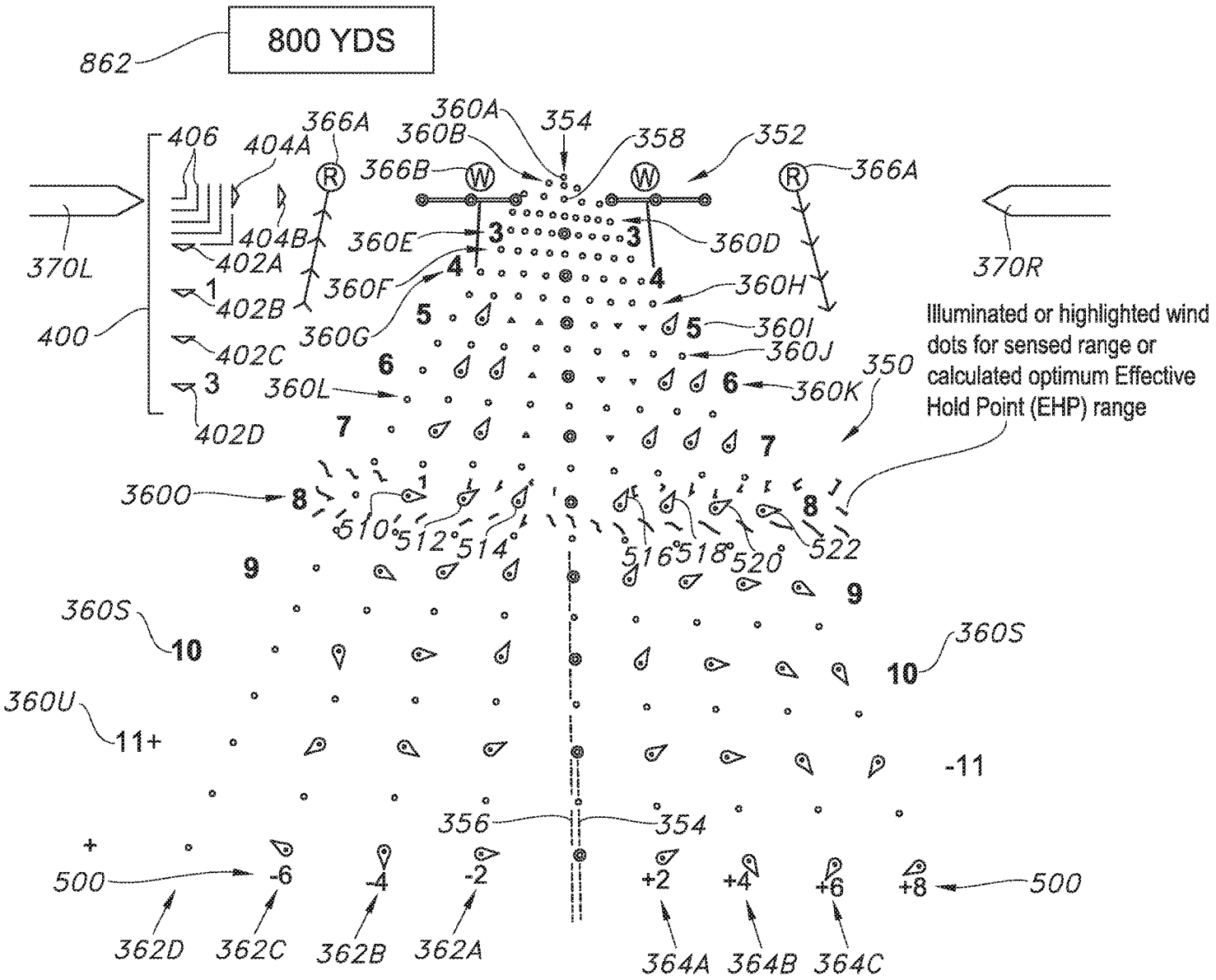
FIG. 7 illustrates a more detailed view of the aim point field and horizontal crosshair aiming indicia array for the range-finding and ballistic effect compensating reticle of FIG. 6, in accordance with the present invention.

The range finding and aim compensating scope 804 and reticle of the present invention can be used with the popular M118LR 0.308 (or 7.62NATO) caliber ammunition which is typically provides a muzzle velocity of 2565 FPS. Turning now to FIGS. 6 and 7, another embodiment of the system 810 and method of the present invention includes a LRF DTR rifle scope system 804 with a reticle aim point field 300 which is configured to predict the performance of that specific ammunition fired from a specific rifle system (e.g., rifle 6 which, apart from scope system 804 is readily configured as a standard US Army M24 or a USMC M40 variant rifle), but can be used with a range of other ammunition by using pre-defined correction criteria, as set forth below. The data for the reticle aim point field 350 shown in FIGS. 6 and 7 was generated using a rifle was fitted with a RH twist barrel. FIG. 6 illustrates a multiple nomograph ballistic effect compensating system or reticle system 300 for use with an aim compensation method for rifle sights or projectile weapon aiming systems which is readily adapted for use with any projectile weapon, when firing a selected ammunition such as USGI M118LR long range ammunition, in accordance with the present invention. FIG. 7 illustrates the aim point field 350 and horizontal crosshair aiming indicia array for the ballistic effect compensating system and reticle of FIG. 6.

FIGS. 6 and 7 illustrate a range finding and aim compensating rifle scope reticle 300 which is similar in some respects to the reticle of FIG. 1C and applicant's previous DTAC™ Reticle, as described and illustrated in applicant's own U.S. Pat. No. 7,325,353, in the prior art, but with important differences. FIG. 6 illustrates a reticle system having a scope legend 326 which preferably provides easily perceived indicia with information on the weapon system and ammunition as well as other data for application when practicing the range finding and aiming method of the present invention. Reticle system 300 preferably also includes a "backup" range calculation nomograph 450 as well as an air density or density altitude calculation nomograph 550, for use in checking the accuracy of sensed range or for use as a backup in the event something in the LRF system (e.g., Laser 834) fails.

FIG. 7 provides a detailed view of an exemplary elevation and windage aim point field 350, with the accompanying (backup) horizontal and vertical angular measurement stadia 400 included proximate the horizontal crosshair aiming indicia array 352. The aim point field 350 is preferably incorporated in an adjustable scope reticle screen (e.g., 16 or 824) but in a LRF equipped rifle scope assembly (e.g., 804) which is otherwise similar to L10 or L12 (as illustrated in FIGS. 1G and 1H). When using range finding and aim compensating scope 804, the marksman uses the aim point field 350 for aiming at the target as viewed through the scope and its reticle. The aim point field 350 comprises at least the first horizontal line or crosshair 352 and a substantially vertical central aiming dot line or crosshair 354, which in the case of the field 350 is represented by a line of substantially or nearly vertical dots. A true vertical reference line 356 is shown on the aim point field 350 of FIG. 7, and may optionally comprise the vertical crosshair of the reticle aim point field 350, if so desired. In the method of the present invention, range-finding (e.g., LRF) and compensating scope (e.g., 804) with ballistic effect compensating system and reticle aim point field 350 includes primary aiming mark 358 indicating (a) a primary aiming point adapted to be sighted-in at a first selected range and (b) the locus of the LRF beam (e.g., projected from laser subsystem 816) for sensing range 29 to a selected target 28. The aim point field also includes a plurality of secondary aiming points arrayed beneath the primary aiming mark (e.g., 510-522) illustrating aim points at the sensed range to target (e.g., 800 yds) for several indicated crosswind conditions (e.g., 510, for a wind from the right having a crosswind component of 15 mph and 510 for a wind from the left having a crosswind component of 15 mph). The method for compensating for a projectile's ballistic behavior while developing a field expedient firing solution permits the shooter to sense or measure the LOS range to target, (29, e.g., corresponding to an adjusted range call of 800 yards), and sense or input the slope angle, local or nominal air density ballistic characteristics and velocity (e.g., mph or kph), for windage hold points. The adaptive method allows a shooter in the field to adapt to changes in available ammunition (e.g., from M118LR to M80) and compensate for variations in ammunition as well as changes in atmospheric conditions.

As noted above, the nearly but not exactly vertical central aiming dot line 354 is curved or skewed somewhat to the right of the true vertical reference line 356 to compensate for "spin drift" of a spin-stabilized bullet or projectile in its trajectory when there is no significant crosswind. The exemplary M24 or M40 variant rifle barrels (e.g., 7) have "right twist" inwardly projecting rifling which spirals to the right, or clockwise, from the proximal chamber to the distal muzzle of the barrel. The rifling (e.g., in barrel 7) engraves and imparts a corresponding clockwise stabilizing spin to the M118LR bullet (not shown). As the projectile or bullet travels an arcuate trajectory in its distal or down range ballistic flight between the muzzle and the target, the longitudinal axis of the bullet will deflect angularly to follow that arcuate trajectory. As noted above, the flying bullet's clockwise spin results in gyroscopic precession which generates a force that is transverse or normal (i.e., ninety degrees) to the arcuate trajectory, causing the bullet to deflect to the right. This effect is seen most clearly at relatively long ranges, where there is substantial arc to the trajectory of the bullet (e.g., as illustrated in FIG. 1E). The lateral offset or skewing of substantially vertical central aiming dot line 354 to the right causes the user, shooter or marksman to aim or moving the alignment slightly to the left in order to position one of the aiming dots of the nearly central line 354 on the target (assuming no windage correction). This has the effect of more nearly correcting for the rightward deflection of the bullet due to gyroscopic precession.

FIG. 7 shows how main horizontal crosshair aiming mark indicia array 352 and substantially vertical central aiming dot line 354 define a primary aim point 358 at their intersection. Primary aiming mark 358 indicates (a) a primary aiming point adapted to be sighted-in at a first selected range and (b) the locus of the LRF beam for sensing LOS range 29 to a selected target 28 (during LRF display mode, as will be described below). The multiple aim point field 350, as shown, is formed of a series of sloped and non-horizontal rows of windage aiming indicia which are not parallel to horizontal crosshair 352 (e.g., 360A, 360B, etc.) and which are spaced at substantially lateral intervals to provide aim points corresponding to selected crosswind velocities (e.g., 5 mph, 10 mph, 15 mph, 20 mph and 25 mph) The windage aiming indicia for each selected crosswind velocity are aligned along axes which are inwardly angled but generally vertical (spreading as they descend) to provide left side columns 362A, 362B, 362C, etc. and right side columns 364A, 364B, 364C, etc. The left side columns and right side columns comprise aiming indicia or aiming dots (which may be small circles or other shapes, in order to minimize the obscuration of the target). It will be noted that the uppermost horizontal row 360A actually comprises only a single dot each, and provides a relatively close aiming points at only one hundred yards. The aim point field 350 is configured for a rifle and scope system (e.g., 810) which has been "zeroed" (i.e., adjusted to exactly compensate for the drop of the bullet during its flight) at aim point 358, corresponding to a distance of two hundred yards, as evidenced by the primary horizontal crosshair array 352. Thus, a marksman aiming at a closer target must lower his aim point to an aim point or dot slightly above the horizontal crosshair 352 (e.g., 360A or 360B), as relatively little drop occurs to the bullet in such a relatively short flight.

In FIG. 7, most of the horizontal rows, (e.g. rows 360E, 360F, 360G, down to row 360U, are numbered to indicate the range in hundreds of yards for an accurate shot using the dots of that particular row, designating ranges of 100 yards, 150 yards (for row 360B), 200 yards, 250 yards, 300 yards (row 360E), etc. The row 360S has a mark "10" to indicate a range of one thousand yards. It will be noted that the spacing between each horizontal row (e.g., 360A, 360B . . . 360S, 360U), gradually increases as the range to the target becomes longer and longer. This is due to the slowing of the bullet and increase in vertical speed due to the acceleration of gravity during its flight. The alignment and spacing of the horizontal rows more effectively compensates for these factors, such that the vertical impact point of the bullet will be more accurate at any selected range. After row 360U, for 1100 yards, the rows are no longer numbered, as a reminder that beyond that range, it is estimated that the projectile has slowed into the transonic or subsonic speed range, where accuracy is likely to diminish in an unpredictable manner.

The nearly vertical columns 362A, 362B, 364A, 364B, etc., spread as they extend downwardly to greater and greater ranges, but not symmetrically, due to the external ballistics factors including Crosswind Jump and Dissimilar Crosswind Drift, as discussed above. These nearly vertical columns define aligned angled columns or axes of aim points configured to provide an aiming aid permitting the shooter to compensate for windage, i.e. the lateral drift of a bullet due to any crosswind component. As noted above, downrange crosswinds will have an ever greater effect upon the path of a bullet with longer ranges. Accordingly, the vertical columns spread wider, laterally, at greater ranges or distances, with the two inner columns 362A and 364A being closest to the column of central aiming dots 354 and being spaced to provide correction for a five mile per hour crosswind component, the next two adjacent columns 362B, 364B providing correction for a ten mile per hour crosswind component, etc.

In addition, a moving target must be provided with a "lead," somewhat analogous to the lateral correction required for windage. The present scope reticle includes approximate lead indicators 366B (for slower walking speed, indicated by the "W") and 366A (farther from the central aim point 358 for running targets, indicated by the "R"). These lead indicators 366A and 366B are approximate, with the exact lead depending upon the velocity component of the target normal to the bullet trajectory and the distance of the target from the shooter's position.

As noted above, in order to use the elevation and windage aim point field 350 of FIGS. 6 and 7, the marksman must have a reasonably close estimate of the range to the target. If the laser range finding circuitry in range finding and aim compensating scope 804 fails, the backup range estimating reticle features are provided by means of the evenly spaced horizontal and vertical angular measurement stadia 400 disposed upon aim point field 350. The stadia 400 comprise a vertical row of stadia alignment markings 402A, 402B, etc., and a horizontal row of such markings 404A, 404B, etc. It will be noted that the horizontal markings 404A, etc. are proximate to and disposed along the horizontal reference line or crosshair 352, but this is not required; the horizontal marks could be placed at any convenient location on reticle 300. Each adjacent mark, e.g. vertical marks 402A, 402B, etc. and horizontal marks 404A, 404B, etc., are evenly spaced from one another and subtend precisely the same angle therebetween, e.g. one mil, or a tangent of 0.001. Other angular definition may be used as desired, e.g. the minute of angle or MOA system discussed in the Related Art further above. Any system for defining relatively small angles may be used, so long as the same system is used consistently for both the stadia 400 and the distance v. angular measurement nomograph 450.

It should be noted that each of the stadia markings 402 and 404 comprises a small triangular shape, rather than a circular dot or the like, as is conventional in scope reticle markings. The polygonal stadia markings of the present system place one linear side of the polygon (preferably a relatively flat triangle) normal to the axis of the stadia markings, e.g. the horizontal crosshair 352. This provides a precise, specific alignment line, i.e. the base of the triangular mark, for alignment with the right end or the bottom of the target or adjacent object, depending upon whether the length or the height of the object is being ranged. Conventional round circles or dots are subject to different procedures by different shooters, with some shooters aligning the base or end of the object with the center of the dot, as they would with the sighting field, and others aligning the edge of the object with one side of the dot. It will be apparent that this can lead to errors in subtended angle estimation, and therefore in estimating the distance to the target.

Referring back to FIG. 6, the bottom of aim point field 350 includes a density correction graphic indicia array 500 comprising a plurality of density altitude adjustment change factors (e.g., "−2" for column 362A, "−4" for column 362B, "−6" for column 362C, "+2" for column 364A, and "+4" for column 364B, and these are for use with the tear-drop shaped Correction Drop Pointers (e.g., 510, 512, 514, 516, 518, 520, 522, as seen aligned along the 800 Yard array of windage aiming points 360-0). Each of the density correction drop pointers (e.g., 510, 512, etc.) provides a clock-hour-hand like pointer which corresponds to an imaginary clock face on the aim point field 350 to designate whole numbers of MOA correction values. Aim point field 350 also includes aim points having correction pointers with an interior triangle graphic inside the correction drop pointer (e.g., 518) indicating the direction for an added ½ or 0.5 MOA correction on the hold (e.g., when pointing down, dial down or hold low by ½ MOA).

Figure 8A:
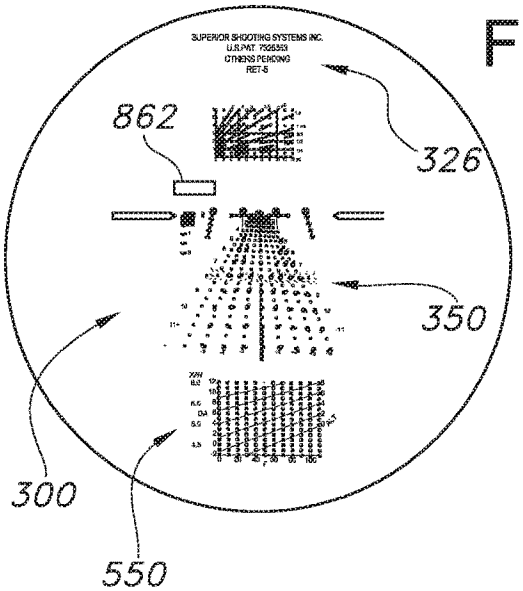
FIG. 8A illustrates the position and orientation and graphic details of the Density Altitude calculation nomograph included as part of reticle system of FIGS. 6 and 7, when viewed at the variable power scope's lowest magnification setting, in accordance with the present invention.
Figure 8B:
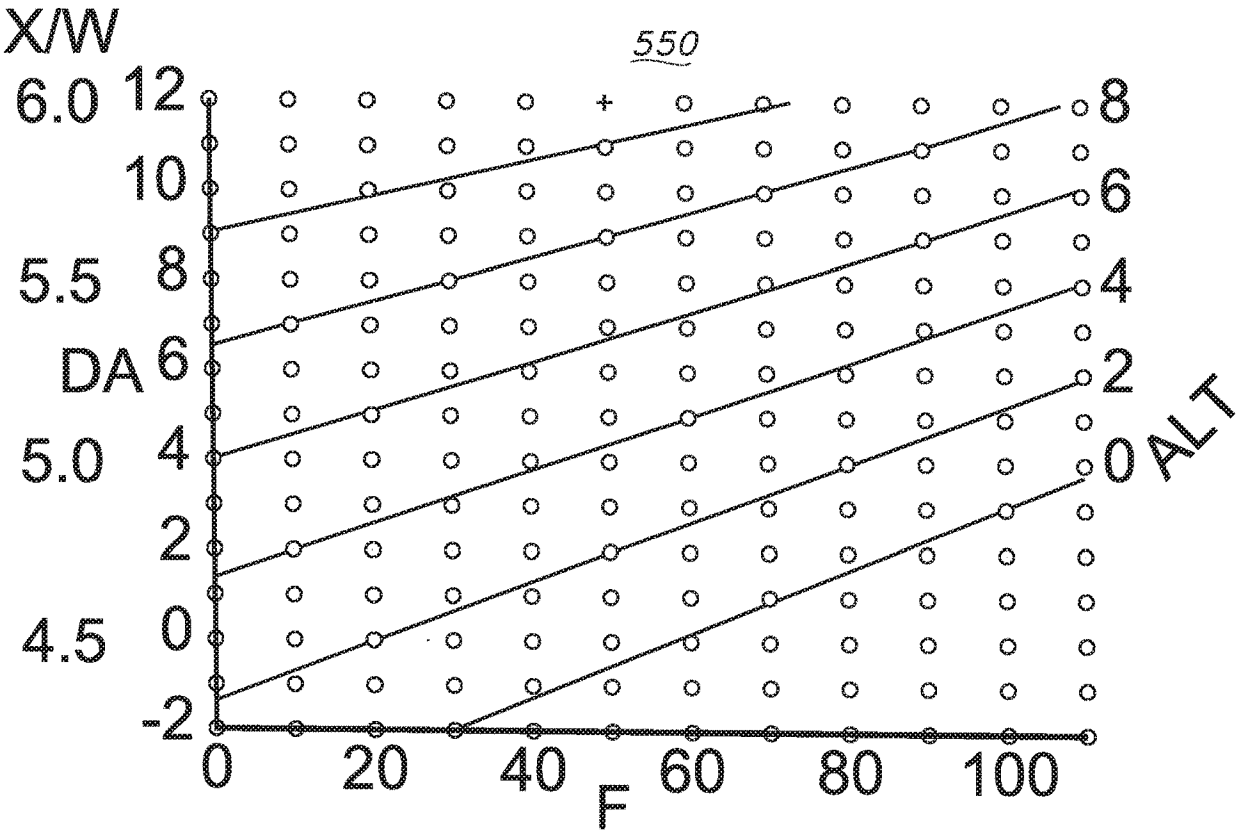
FIG. 8B illustrates the orientation and graphic details of the Density Altitude calculation nomograph of FIGS. 7, and 8A, in accordance with the present invention.

Range finding and aim compensating rifle scope 804 when equipped with aim compensating reticle 300 of FIG. 7 represents a much improved aid to precision shooting over long ranges, such as the ranges depicted in FIG. 1E, where air density plays an increasingly significant role in accurate aiming. Air density affects drag on the projectile, and lower altitudes have denser atmosphere. At a given altitude or elevation above sea level, the atmosphere's density decreases with increasing temperature. FIGS. 8A and 8B illustrate the position, orientation and graphic details of the Density Altitude calculation nomograph 550 included as part of reticle system 300 (and preferably programmed into a memory (not shown) within scope assembly 804). The crosswind (XW) values to the left of the DA graph indicate the wind hold (dot or triangle) value at the corresponding DA for the shooter's location. For example, X/W value "5" is 5 mph at 4000 DA or 4K DA. X/W value "5.5" is 5.5 mph at 8000 DA or 8K DA (adding % mph to the wind hold). X/W value "4.5" is 4.5 mph at 2000 DA or 2K DA (subtracting mph from the wind hold). The mph rows of correction drop pointers in aim point field 350 are used to find corresponding corrections for varying rifle and ammunition velocities. Velocity variations for selected types of ammunition is preferably accounted for by selecting and inputting an appropriate DA number into the range calculation used to determine and display the optimum EHP.

DA represents "Density Altitude" and variations in ammunition velocity can be integrated into the aim point correction method (preprogrammed into memory accessible by microprocessor 838) by selecting a lower or higher DA correction number, and this part of the applicant's method referred to as "DA Adaptability". This means that a family of reticles is readily made available for a number of different bullets for use with range finding and aim compensating scope 804. This particular example is for the USGI M118LR ammunition, which is a 0.308, 175 gr. Sierra™ Match King™ bullet, modeled for use with a rifle having scope 2.5 inches over bore centerline and a 100 yard zero. In computing the optimum EHP range, the bullet's flight path is defined to match the reticle at the following combinations of muzzle velocities and air densities:

2 k DA=2625 FPS and 43.8 MOA at 1100 yards
3 k DA=2600 FPS and 43.8 MOA at 1100 yards
4 k DA=2565 FPS and 43.6 MOA at 1100 yards
5 k DA=2550 FPS and 43.7 MOA at 1100 yards
6 k DA=2525 FPS and 43.7 MOA at 1100 yards where 1100 yard come-ups were used since this bullet is still above the transonic region. Thus, the reticle's density correction graphic indicia array 500 can be used with Density Altitude Graph 550 (or a corresponding Look Up Table programmed into scope 804) to provide the user with a convenient method to adjust or correct the selected aim point for a given firing solution when firing using different types of ammunition or in varying atmospheric conditions with varying air densities.

In accordance with the method and system (e.g., 810) of the present invention, each user is preferably provided with information (e.g., a placard or card for each scope 804 which defines the bullet path values (come-ups) at selected (e.g., 100 yard) intervals. When the user sets up their rifle system (and programs scope 804), they chronograph their rifle and pick the Density Altitude which matches the system's (i.e., rifle+ammunition) velocity. Handloaders have the option of loading to that velocity to match the main reticle value. The conditions which result in a bullet path that matches the reticle is referred to throughout this as the "nominal" or "main" conditions. The scope legend (e.g., 326), viewed by zooming back to the minimum magnification, shows the model and revision number of the reticle from which can be determined the main conditions which match the reticle. FIGS. 9A-9D illustrate an alternate reticle (650) and FIGS. 10A-10E and 11 illustrate information (e.g., printable on transportable placards and programmable into scope 804) summarizing ballistics information about a selected projectile (e.g., the M118LR) for use in finding Density Altitude ("DA") adaptability factors as part of the range finding and aim compensating method of the present invention.

Experienced long range marksmen and persons having skill in the art of external ballistics as applied to long range precision shooting will recognize that the present invention makes available a novel range finding and aim compensating system (e.g., 810) and ballistic effect compensating reticle system (e.g., 200, 300 or 600) for use in a projectile weapon aiming system adapted to provide a field expedient firing solution for a selected projectile, comprising: (a) a multiple point elevation and windage aim point field (e.g., 150, 350 or 650) including a primary aiming mark (e.g., 158, 358 or 658) indicating a primary aiming point adapted to be sighted-in at a first selected range (e.g., 200 yards); (b) the aim point field including a nearly vertical array of secondary aiming marks (e.g., 154, 354 or 654) spaced progressively increasing incremental distances below the primary aiming point and indicating corresponding secondary aiming points along a curving, nearly vertical axis intersecting the primary aiming mark, the secondary aiming points positioned to compensate for ballistic drop at preselected regular incremental ranges beyond the first selected range for the selected projectile having pre-defined ballistic characteristics where the aim point field, as displayed, also includes a sloped wind dot array or downrange array of windage aiming marks spaced apart along a secondary non-horizontal axes (e.g., 160A) intersecting a first selected secondary aiming point (e.g., corresponding to a selected EHP range). The first array of windage aiming marks includes a first windage aiming mark spaced apart to the left of the vertical axis at a first windage offset distance from the vertical axis selected to compensate for right-to-left crosswind of a preselected first incremental velocity (e.g., 5 mph) at the range of said first selected secondary aiming point, and a second windage aiming mark spaced apart to the right of the vertical axis at a second windage offset distance from the vertical axis selected to compensate for left-to-right crosswind of that same preselected first incremental velocity (e.g., 5 mph) at said range of said first selected secondary aiming point. The first array of windage aiming marks defining the highlighted or displayed sloped row of windage aiming points (e.g., as best seen in FIG. 2D) have a slope which is a function of the direction and velocity of said projectile's stabilizing spin or a rifle barrel's rifling twist rate and direction, thus compensating for said projectile's crosswind jump, and the reticle thereby facilitates aiming with accurate compensation for ballistics and windage for two crosswind directions at a first preselected incremental crosswind velocities, at a first preselected incremental range corresponding to the first selected secondary aiming point.

In the illustrated embodiments, the range finding and aim compensating scope 804 has a ballistic effect compensating reticle (e.g., 200, 300 or 600) with several sloped arrays of windage aiming marks which define sloped rows of windage aiming points having a negative slope which is a function of the right-hand spin direction for the projectile's stabilizing spin or a rifle barrel's right-hand twist rifling, thus compensating for the projectile's gyroscopic precession effects (including crosswind jump and dissimilar wind drift) and providing a more accurate compensated aim point for any range for which the projectile remains supersonic.

The ballistic effect compensating reticle (e.g., 200, 300 or 600) has each secondary aiming point intersected by a secondary array of windage aiming marks (e.g., 360E, for 300 yds) defining the sloped row of windage aiming points having a slope which is a function of the direction and velocity of the projectile's stabilizing spin or a rifle barrel's rifling twist rate and direction, and that sloped row of windage aiming points are spaced laterally in increments selected to indicate crosswind speed intervals (e.g., 5 mph). In the range finding and aim compensating system 810 and the method of the present invention, aiming compensation for ballistics and windage for multiple preselected incremental crosswind velocities (e.g., 5, 10, 15, 20 and 25 mph) is sensed during a first LRF display mode, and then calculated and displayed during a second shooting display mode. In the illustrated embodiments, each sloped row of windage aiming points includes windage aiming marks positioned to compensate for leftward and rightward crosswinds of 10 miles per hour and 20 miles per hour at the range of the secondary aiming point corresponding to the sloped row of windage aiming points, and at least one of the sloped row of windage aiming points is bounded by laterally spaced distance indicators which, in the method of the present invention, are illuminated or designated in the reticle to show the shooter the closest row to that indicated from the LRF sensing step. So, for example, if the range to target 29 is for a range which corresponds to an EHP that falls between two sloped rows (e.g., if EHP is calculated to be between 800 yds and 850 yds, e.g., 825 yds, as shown in FIG. 6) then the two closest sloped rows of wind dot lines (e.g. for 800 yds and 850 yds) are be illuminated or designated so the shooter may interpolate and visually aim or align the range finding and aim compensating rifle system 810 so that when aiming, the target appears between the most relevant wind dots or aiming indicia. FIG. 9C illustrates another embodiment where only the two closest sloped wind dot lines are displayed for a given EHP, effectively visually bracketing the target during aiming. In the example of FIG. 9C, for an EHP of 807 yards, only the sloped wind dot array for 800 yards (660) and the sloped wind dot array for 825 yards (662) are illuminated (or displayed at all) during the shooting display mode operation. In an alternative embodiment (illustrated in FIG. 9D), if the EHP is very close in value to the range corresponding to one sloped wind dot array (e.g., for an EHP range of 802 yards) only that closest sloped wind dot line (e.g., sloped wind dot line 660 for 800 yds), is displayed or highlighted during the shooting display mode operation.

Figure 9A:
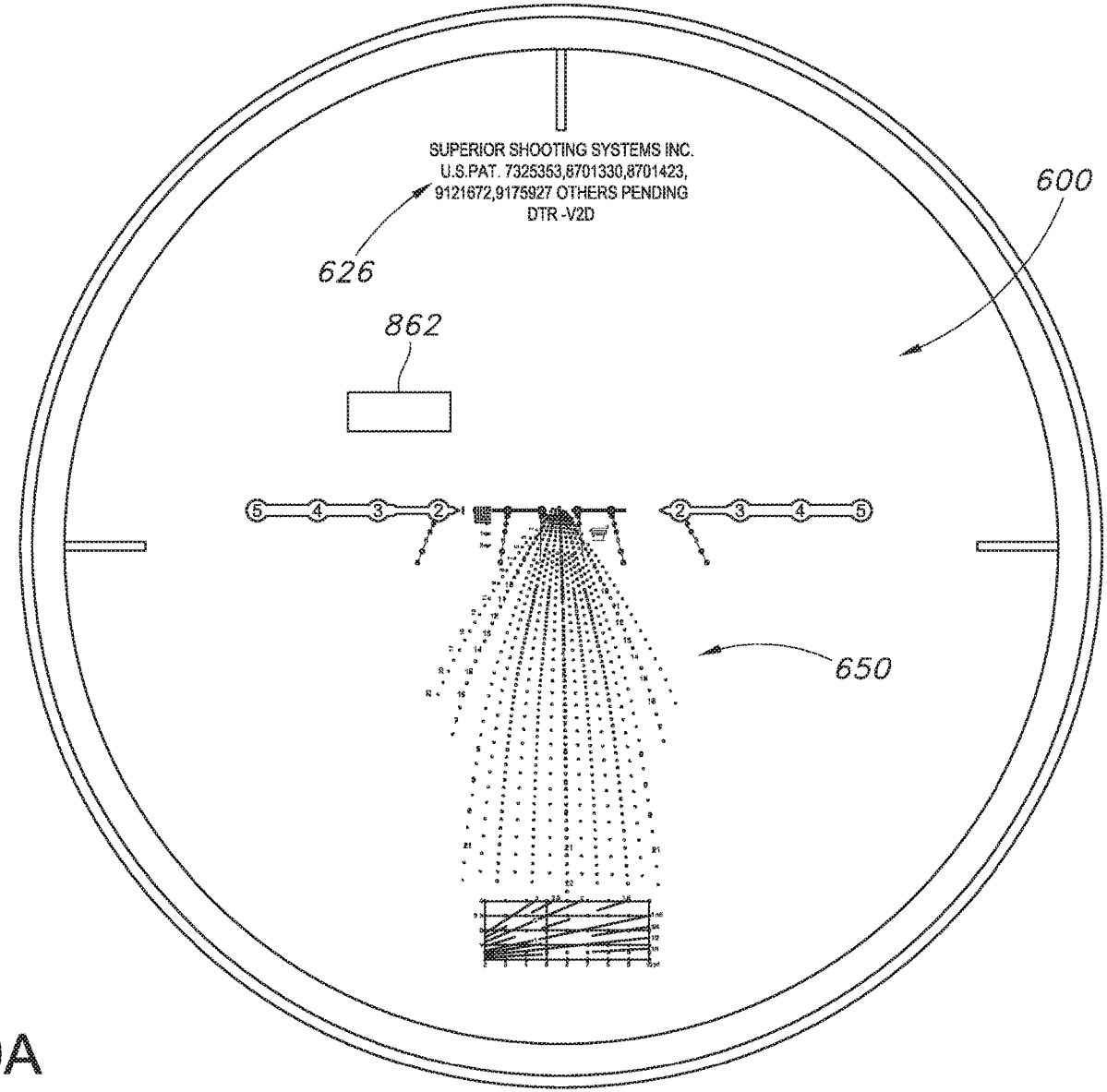
FIGS. 9A, 9B, 9C and 9D illustrate another ballistic effects compensated reticle embodiment for use with the range finding and aim compensating system 810 and aim compensation method of FIGS. 2A, 2B, 2C, 2D, 3 & 4, in accordance with the present invention.
Figure 9B:
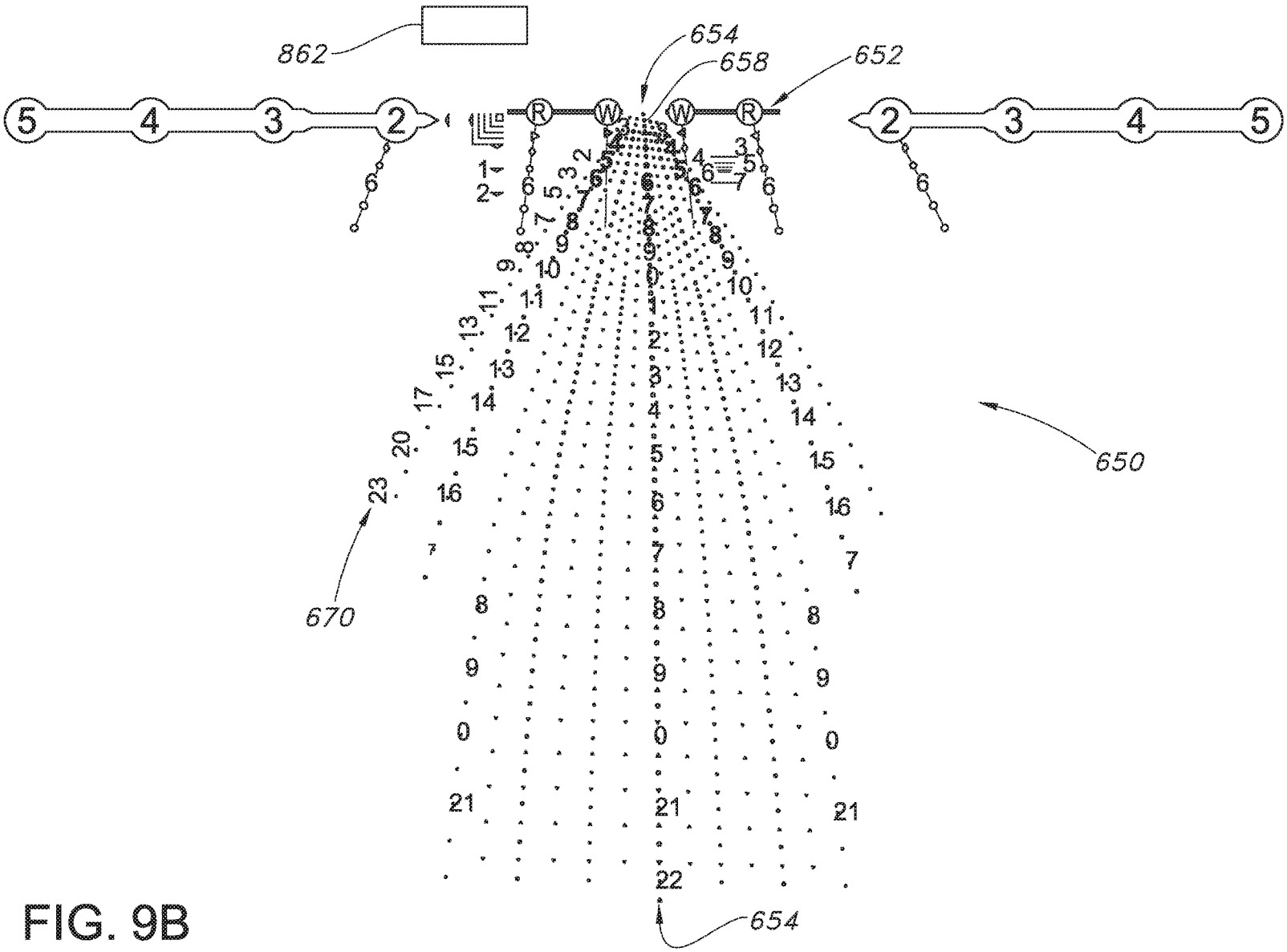
Figure 9C:
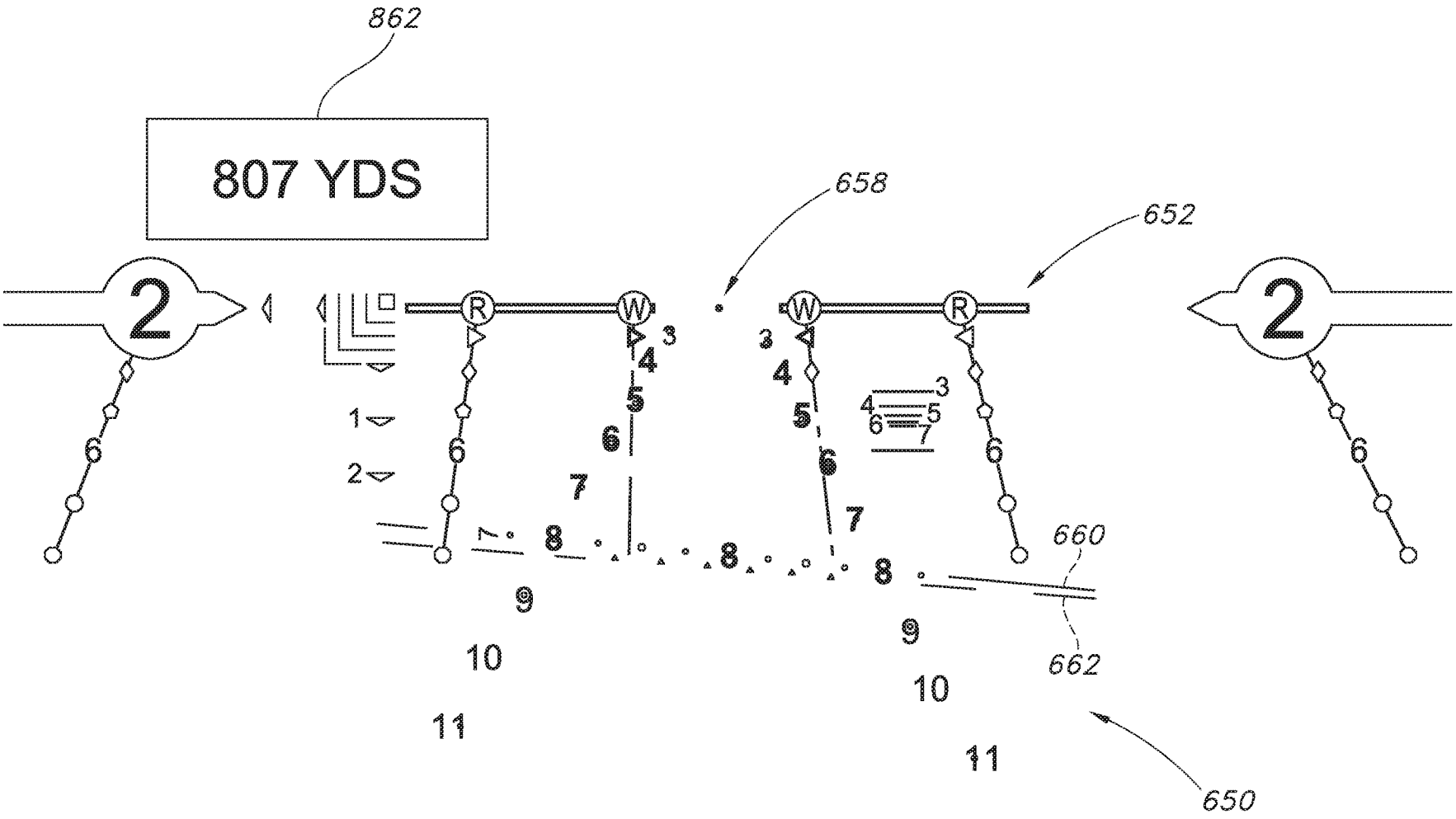
Figure 9D:
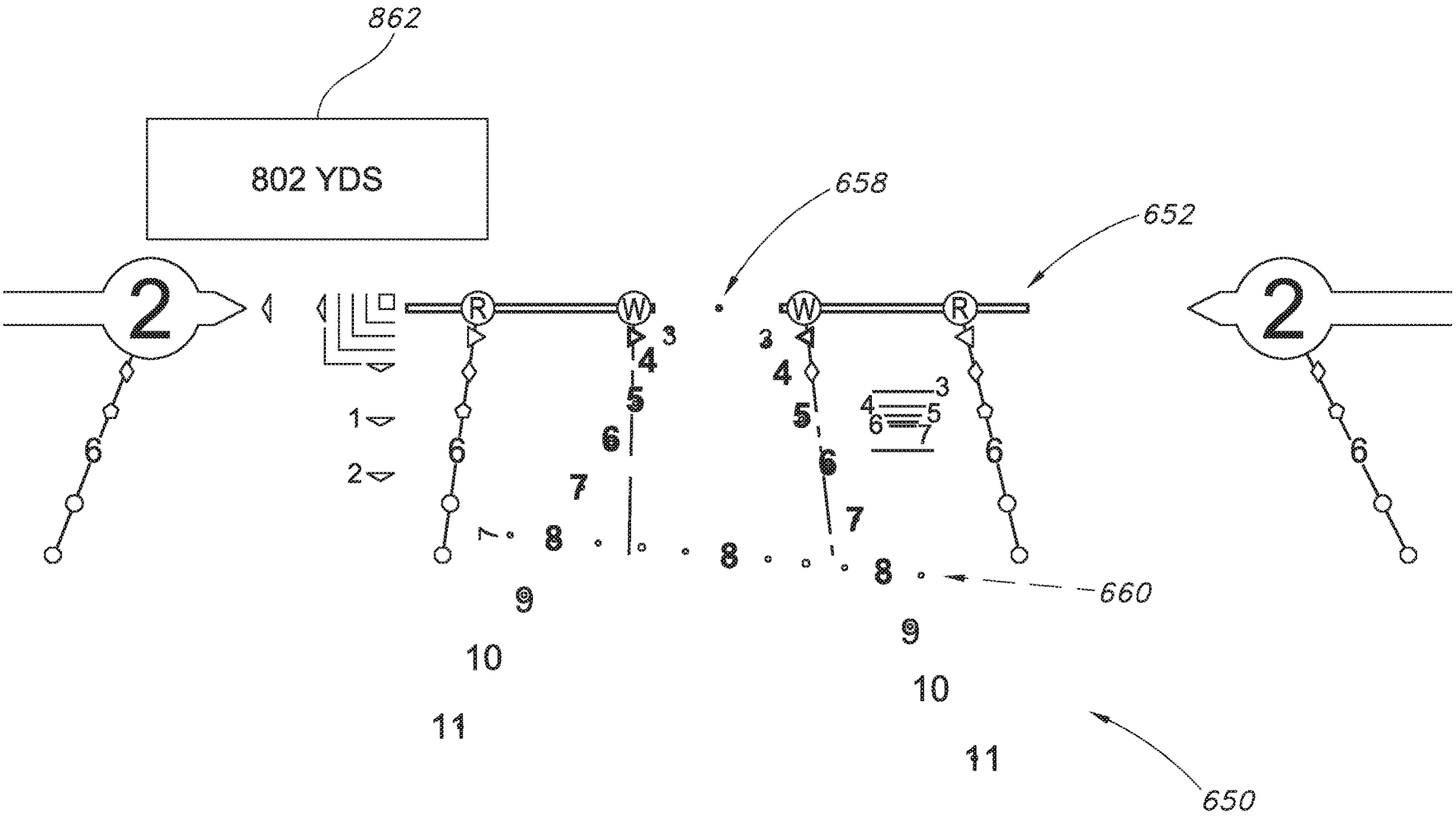

Using the DA adaptability numbers illustrated in FIG. 9B for reticle aim point field 650, the sideways (or "lazy") DA adaptability (or "ADC") numbers vary with range and are be used to calculate changes in optimum Effective Hold Point ("EHP") range from LRF sensed LOS range 29. For DTR V2D reticle 600, with aim point field 650, the ADC number for 800 yds is shown as a sideways "7". DA atmospheric condition data may be obtained from portable weather sensors (e.g., such as Kestrel brand hand-held sensors) or may be obtained from other sources online and transmitted (e.g., by Bluetooth from a user's smart phone (not shown)). Alternatively, Using the DA data in FIG. 8B and the tabular data in FIGS. 10A-11, the optimum EHP is calculated (e.g., using Microprocessor 838) as follows: First, the LOS range 29 is sensed and if LOS range is greater than 300 yds and Slope Angle 27 is greater than 10 degrees, the Cosine or "X" yards horizontal range is used. Next ammunition and air density effects (i.e. variation from nominal DA conditions (or "NAV") for rifle system 810 which might be 4 KDA for a given rifle and ammunition combination) are used to make a further adjustment; in this step, the adjustment ("Delta Yard") is calculated as:

$$\text{NAV-Current DA}\times\text{ADC \#=Delta Yard} \quad \text{(Eq. 1)}$$

And EHP is then calculated as:

$$\text{EHP=LOS range-Delta Yard} \quad \text{(Eq. 2)}$$

So referring again to FIG. 9B, if the NAV for rifle system 810 is 4 KDA and the Current DA (when aiming at the target) is 1 KDA, then for an LOS range of 800 yds, the Delta Yard adjustment is ((4−1)×7) yards or 21 yards so EHP becomes 800 yds−21 yds or 779 yds. When using ammunition with bullets having the same ballistic coefficient as the Nominal bullet, but travelling at a different muzzle velocity than was used to assign the NAV value for a given rifle/ammo/scope system (e.g., 810), each added 25 foot per second change in muzzle velocity (e.g., as measured by a chronograph) subtracts 1 KDA in NAV (and if the ammunition is 25 fps slower, it adds 1 KDA to NAV). All of these calculations and ballistics effect estimating rules are programmed into each Micro Processor of the range finding and aim compensating system scope 804 (e.g., of FIG. 2C) as part of the aim compensation method of the present invention.

Figure 12:
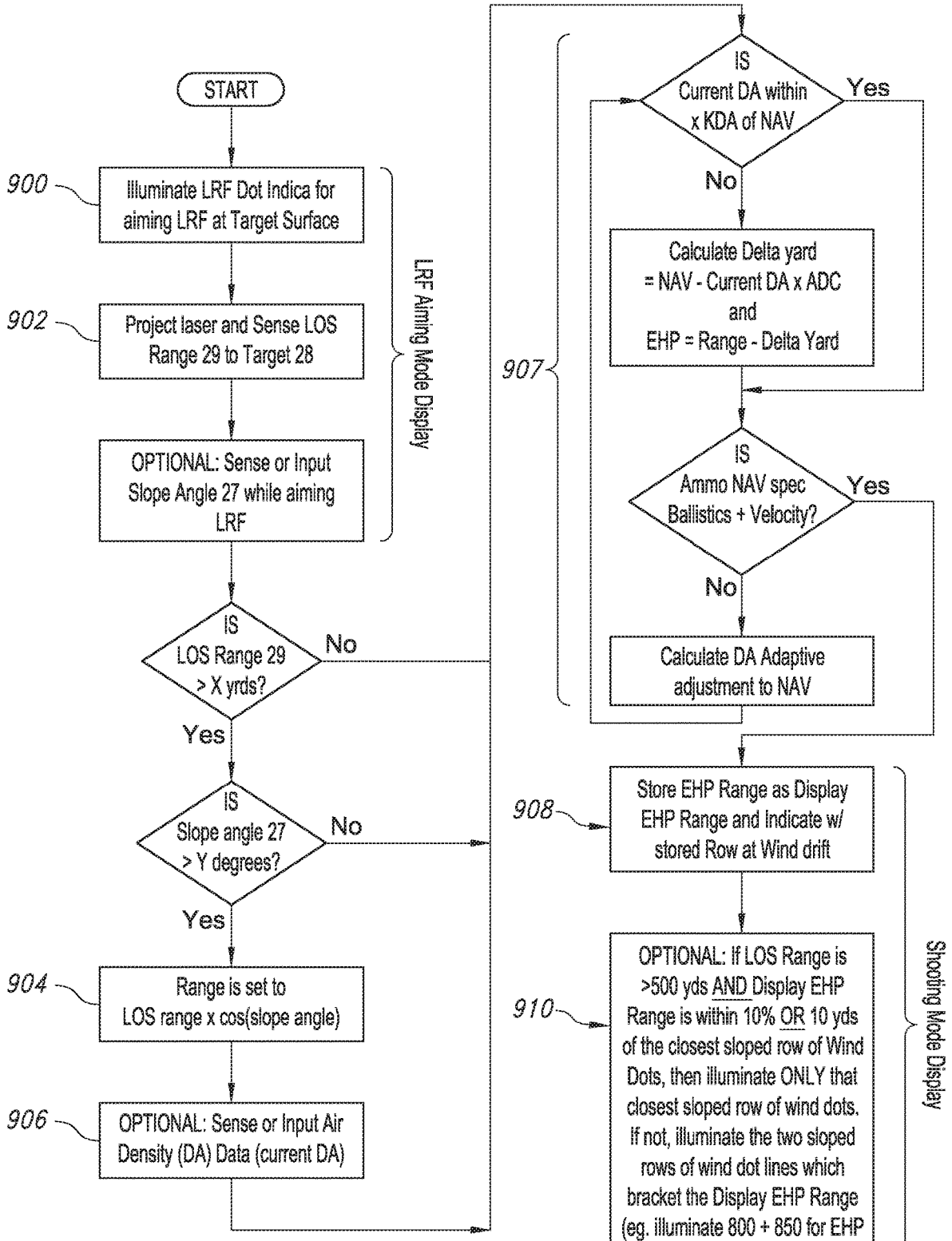
FIG. 12 is a process flow diagram illustrating the range finding and aim compensation method programmed into the Micro Processor of the range finding and aim compensating system scope of FIG. 2C as part of the aim compensation method of the present invention.

The method for calculating the adjusted optimum Effective Hold Point ("EHP") for display in EHP display window 862 and for choosing which sloped row of wind dot lines to illuminate (when in shooting display mode) is illustrated in the process flow diagram of FIG. 12. Initially, in step 900, the shooter or user actuates range finding and aim compensating rifle system 810 preferably by actuating control input 842 or optionally by simply moving scope assembly 804, where such movement is sensed by an internal solid state accelerometer (not shown), thereby energizing laser generator 836. This initialization step may optionally be delayed until the user indicates that range finding and aim compensating rifle system 810 is aimed at the target, with LRF targeting indicator or main crosshair dot 158 aligned with and visibly held over the target 28. Next, in step 902, the LOS range 29 is sensed and stored. Optionally, slope angle 27 is sensed or input from a remote source (e.g., through data interface 843). Next, in optional step 903, the user may elect to either adjust EHP with slope angle or not. Optionally, if slope angle is greater or equal to 10 degrees and LOS range is greater than 300 yards, the EHP range may be adjusted to be equal to the "Horizontal" range by subtracting a "hold closer distance" or calculating the smaller "cosine" range (e.g., as shown in step 904. Steps 906 and 907 use the calculations and data described above (with respect to determining whether current atmospheric (e.g., air density measured as kDA or DU units) to determine whether the current air density (e.g., kDA) differs significantly enough from the Nominal Assigned Value ("NAV") for the rifle system 810 when actually aiming to merit correction. If so, then, in accordance with the system and method of the present invention, a DA adaptive correction ("Delta Yard") value is calculated (e.g., using the information and method described above and Equations 1 and 2) to calculate an air density corrected EHP. Optionally, in step 907, for different ammunition than the specified ammunition used in assigning the NAV for rifle system 810, a DA adaptive adjustment is calculated for an adjusted NAV for the rifle system with the new or non-spec ammunition and the calculation is iteratively repeated to obtain a new optimum EHP for the then-in-use ammunition/rifle scope system. Optionally, the optimum EHP is displayed in a reticle numerical display area (e.g., 862). In the method of the present invention, the next and final step (e.g., 908) is displaying (e.g., illuminating or indicating in a conspicuous manner) at least one sloped wind dot line which shows the effective hold points for the sensed and corrected EHP range with ballistically compensated wind dots corresponding to multiple crosswind velocities for left wind or right wind.

For reticles with aim point fields such as 150, 350 or 650, the reticle's permanently inscribed pattern of wind dots is always visible, and in scope 804 microprocessor 838 is programmed to Illuminate or designate the one sloped wind dot line array which most closely matches the stored EHP value. Optionally, as illustrated in diagram block 910, Optional if LOS range is under a first selected threshold range (e.g., 500 yds) and optimum EHP range is within a selected percentage (e.g. 10%) or a selected distance (e.g., 10 yards) of the one closest sloped row of wind dots illuminated, the controller can be programmed to illuminate ONLY the closest sloped row; however, if this condition is NOT true, then the scope 804 is programmed to surround or bracket the true aim point EHP by illuminating both the closest row of sloped wind dots AND the second closest sloped row. Alternatively, where the reticles (200, 300 or 600) exist only in software within scope 804, and are NOT permanently etched on a reticle surface 824, the microprocessor is programmed to display only one sloped row at exactly the EHP.

Preferably, at least one of the sloped arrays windage aiming points is proximate an air density or projectile ballistic characteristic adjustment indicator such as the "Lazy" DA adjustment factors arrayed in density correction indicia array 670, and the air density or projectile ballistic characteristic adjustment indicator is preferably a Density Altitude (DA) correction indicator, but could also be expressed in air density units known with the acronym "DU." Those density correction factors can also be used by the shooter "on the fly", in case it is not possible to input current DA information to microprocessor 838.

Generally, when using the range-finding and compensating scope 804 with a ballistic effect compensating reticle aimpoint field (e.g., 150, 350 or 650), if there is actually no crosswind, the nearly vertical array of secondary aiming marks (e.g., 154, 354 or 654) provide very clearly defined secondary aiming points along a curving, nearly vertical axis and are curved in a direction that is a function of the direction of the projectile's stabilizing spin from rifle the barrel (e.g., 7) rifling direction, thus compensating for spin drift at any sensed EHP range. The primary aiming mark (e.g., 358) formed by the intersection of the primary horizontal sight line (e.g., 352) and the nearly vertical array of secondary aiming marks provide a conspicuous indicator or "dot" which may be illuminated or highlighted during the LRF sensing step, while LRF-DTR scope 804 is operating in the LRF display mode, during which the shooter aims rifle system 810 so that the primary aiming mark (e.g., 158, 358 or 658) is aligned directly over or at the target surface. The main horizontal crosshair array (e.g., 152, 352 or 652) preferably includes a bold, widened portion (370L and 370R) located radially outward from the primary aiming point, the widened portion having an innermost pointed end located proximal of the primary aiming point which provides an aid when aiming the LRF for LOS range detection.

The range-finding and ballistic effect compensating system 810 is shown with exemplary reticle aim point field (e.g., 150, 350 or 650) which preferably also includes at least a second array of windage aiming marks spaced apart along a second non-horizontal axis intersecting a second selected secondary aiming point; and the second array of windage aiming marks includes a third windage aiming mark spaced apart to the left of the vertical axis at a third windage offset distance from the vertical axis selected to compensate for right-to-left crosswind of the preselected first incremental velocity (e.g., 10 mph) at the range of said second selected secondary aiming point (e.g., 800 yards), and a fourth windage aiming mark spaced apart to the right of the vertical axis at a fourth windage offset distance from the vertical axis selected to compensate for left-to-right crosswind of the same preselected first incremental velocity at the same range, and the second array of windage aiming marks define another sloped row of windage aiming points having a slope which is also a function of the direction and velocity of said projectile's stabilizing spin or a rifle barrel's rifling twist rate and direction, thus compensating for the projectile's crosswind jump. In addition, the ballistic effect compensating reticle's aim point field also includes a third array of windage aiming marks spaced apart along a third non-horizontal axis intersecting a third selected secondary aiming point, where the third array of windage aiming marks includes a fifth windage aiming mark spaced apart to the left of the vertical axis at a fifth windage offset distance from the vertical axis selected to compensate for right-to-left crosswind of the preselected first incremental velocity at the range of said third selected secondary aiming point, and a sixth windage aiming mark spaced apart to the right of the vertical axis at a sixth windage offset distance from the vertical axis selected to compensate for left-to-right crosswind of said preselected first incremental velocity at said range of said third selected secondary aiming point; herein said second array of windage aiming marks define another sloped row of windage aiming points having a slope which is also a function of the direction and velocity of said projectile's stabilizing spin or a rifle barrel's rifling twist rate and direction, thus compensating for crosswind jump.

The range-finding and ballistic effect compensating system 810 reticle (e.g., 200, 300 or 600) may also have the aim point field's first array of windage aiming marks spaced apart along the second non-horizontal axis to include a third windage aiming mark spaced apart to the left of the vertical axis at a third windage offset distance from the first windage aiming mark selected to compensate for right-to-left crosswind of twice the preselected first incremental velocity at the range of said second selected secondary aiming point, and have a fourth windage aiming mark spaced apart to the right of the vertical axis at a fourth windage offset distance from the second windage aiming mark selected to compensate for left-to-right crosswind of twice said preselected first incremental velocity at said range of said selected secondary aiming point. Thus the third windage offset distance is greater than or lesser than the fourth windage offset distance, where the windage offset distances are a function of or are determined by the direction and velocity of the projectile's stabilizing spin or a rifle barrel's rifling twist rate and direction, thus compensating for the projectile's Dissimilar Wind Drift. The ballistic effect compensating reticle has the third windage offset distance configured to be greater than the fourth windage offset distance, and the windage offset distances are a function of or are determined by the projectile's right hand stabilizing spin or a rifle barrel's rifling right-twist direction, thus compensating for said projectile's Dissimilar Wind Drift.

Broadly speaking, the range finding and aim compensating system's reticle (e.g., 200, 300 or 600) has an aim point field configured to compensate for the selected projectile's ballistic behavior while developing a field expedient firing solution expressed two-dimensional terms of:

(a) EHP range or distance, used to orient a field expedient aim point vertically among the secondary aiming marks in said vertical array, and (b) crosswind relative velocity, used to orient the aim point laterally among a selected array of windage hold points.

The range-finding and ballistic effect compensating method for use when firing a selected projectile from a selected rifle or projectile weapon (e.g., 6 or 810) and developing a field expedient firing solution, comprises: (a) providing a range-finding and ballistic effect compensating system 810 with a ballistic effect compensating reticle system (e.g., 200, 300 or 600) comprising a multiple point elevation and windage aim point field (e.g., 150, 350 or 650) including a primary aiming mark (e.g., 158, 358 or 658) intersecting a nearly vertical array of secondary aiming marks spaced along a curving, nearly vertical axis, where the secondary aiming points are positioned to compensate for ballistic drop at preselected regular incremental ranges (e.g., every 25 yards or every 50 yards) beyond the first selected range for the selected projectile having pre-defined ballistic characteristics; and where the aim point field also includes a sloped row of wind dots or array of windage aiming marks spaced apart along a secondary non-horizontal axis intersecting that first selected secondary aiming point; wherein the sloped row of wind dots define a sloped row of windage aiming points having a slope which is a function of the direction and velocity of said projectile's stabilizing spin or a rifle barrel's rifling twist rate and direction, thus compensating for said projectile's crosswind jump; (b) based on at least the selected projectile, identifying said projectile's associated nominal Air Density ballistic characteristics; (c) sensing a LOS range to a target, based on the range to the target and the nominal air density ballistic characteristics of the selected projectile, determining a yardage equivalent aiming adjustment (or EHP) for the projectile weapon 810; (d) illuminating or displaying at least one sloped row of wind dots arrayed at a range corresponding to the sensed EHP and then evaluating the actual wind between the shooter and the target to then determine a windage hold point along that illuminated sloped row (based on any crosswind sensed or perceived), and then aiming the rifle or projectile weapon 810 using the yardage equivalent EHP aiming adjustment for elevation hold-off and holding laterally for the selected windage hold point.

The range-finding and ballistic effect aim compensation method of the present invention includes providing ballistic compensation information as a function of and indexed according to an atmospheric condition such as density altitude ("DA") for presentation to the shooter or user, and then associating that ballistic compensation information with the firearm scope reticle feature (e.g., the "lazy 7" at 800 yds from indicia array 670 in FIG. 9B) to enable a user to compensate for then existing density altitude levels to select one or more aiming points displayed on the scope reticle (e.g., 600). The ballistic compensation information is preferably encoded into markings (e.g., indicia array 670) disposed on the reticle of the scope via an encoding scheme AND programmed into scope assembly 804, and the ballistic compensation information is preferably graphed, or tabulated into those markings disposed on the reticle of the scope.

The range-finding and ballistic effect compensating system 810 is readily configured to adjust the point of aim of a projectile firing weapon or instrument firing a selected projectile under varying atmospheric and wind conditions (e.g. with a reticle such as 200, 300 or 600) and preferably includes a plurality of aiming points disposed upon that reticle, where a plurality of aiming points positioned for proper aim at various predetermined range-distances and wind conditions include at least a first array of windage aiming marks spaced apart along a non-horizontal axis (e.g., array 360-0 for 800 yards) to define the sloped row of windage aiming points having a slope which is a function of the direction and velocity of the selected projectile's stabilizing spin or a rifle barrel's rifling twist rate and direction, thus compensating for said selected projectile's crosswind jump; and where all of said predetermined range-distances and wind conditions are based upon a baseline atmospheric condition such as an expected air density. The range-finding and ballistic effect compensating system 810 optionally includes a means for determining existing density altitude characteristics (such as DA graph 550 in FIG. 6) either disposed on the reticle, external to the reticle or programmed into scope 804; and also includes ballistic compensation information indexed by density altitude criteria configured to be provided to the user or marksman such that the user can compensate or adjust an EHP aim point to account for an atmospheric difference between the baseline atmospheric condition and an actual atmospheric condition, as described above.

Preferably, the range-finding and ballistic effect compensating system's information is pre-programmed into the scope's memory, but may also be input via data interface 843 in a manner which mirrors or is consistent with the data encoded into the plurality of aiming points disposed upon the reticle (e.g. 200, 300 or 600), as best seen in FIGS. 7, 8, and 9A-9D. Preferably, the reticle also includes ballistic compensation indicia disposed upon the reticle and ballistic compensation information is encoded into the indicia (as shown in FIGS. 9A-9D, or alternatively, the ballistic compensation information can be positioned external to the reticle, on transportable placards such as placard 600 of FIGS. 10A-11. The ballistic compensation information may also be encoded into the plurality of aiming points disposed upon said reticle (e.g., such as Correction Drop Pointers 510, 512, best seen in FIG. 7), where the encoding is done via display of an density correction encoding scheme that comprises an array of range-specific density correction pointers being displayed on the reticle at selected ranges.

As noted above, the applicant's initial work was directed to determining an aim point for one specific type of ammunition, and the invention now includes a range-finding and ballistic effect compensating system 810 for using an adaptive method allowing a shooter in the field to adapt to changes in available ammunition and compensate for variations in ammunition or atmospheric conditions. Illustrative examples are provided in FIGS. 10A-11 summarize ballistics information about a selected projectile (e.g., a 0.308 dia. 175 gr Sierra™ Matchking™ HPBT projectile). As described in FIG. 11, the shooter or user may use Density Altitude ("DA") adaptability factors as part of the aim compensation method (described above) when changing ammunition types, in accordance with the method of the present invention.

So, for example, if a shooter's rifle (e.g., 6 or 810) is set up to shoot M118LR ammunition (i.e., with the 0.308 dia. 175 gr Sierra™ Match King™ HPBT projectile) at an initial muzzle velocity of 2565 Ft./Sec., the rifle may be assigned a nominal DA baseline or index value of 4 KDA (e.g., as shown and described in FIG. 11). The rifle, with that ammunition, is thus referred to as a "4 KDA" baseline rifle/ammunition system (meaning the rifle's NAV is 4 kDA). Turning now to FIG. 11, if the shooter or user is forced to use a different type of ammunition (e.g., M80 ammunition, with the 0.308 dia. 147 gr FMJ ball projectile) at an initial muzzle velocity of 2740 Ft./Sec., the rifle may be still be used as a 4 KDA baseline or index rifle/ammunition system out to 900 yards, and that information is pre-programmed into scope 804.

The ammunition-change adaptive range-finding and ballistic effect aim compensation method for use when firing first and second selected projectiles from a selected rifle or projectile weapon (e.g., 4 or 810) and developing a displayed field expedient firing solution (as a selected sloped row of windage dots) thus comprises: (a) providing a range-finding and ballistic effect compensating system 810 with a ballistic effect compensating reticle system (e.g., 200, 300 or 600) comprising a multiple point elevation and windage aim point field (e.g., 150, 350 or 650) including a primary aiming mark (e.g., 158, 358 or 658) intersecting a nearly vertical array of secondary aiming marks spaced along a curving, nearly vertical axis, the secondary aiming points positioned to compensate for ballistic drop at preselected regular incremental ranges beyond the first selected range for the selected projectile having pre-defined ballistic characteristics; and said aim point field also including a first array of windage aiming marks spaced apart along a secondary non-horizontal axis intersecting a first selected secondary aiming point; wherein said first array of windage aiming marks define a sloped row of windage aiming points having a slope which is a function of the direction and velocity of said first or second projectile's stabilizing spin or the rifle barrel's rifling twist rate and direction, thus compensating for said first or second projectile's crosswind jump; (b) based on at least the first selected projectile (e.g., M118LR ammunition (i.e., with the 0.308 dia. 175 gr Sierra™ Matchking™ HPBT projectile at an initial muzzle velocity of 2565 Ft./Sec.), identifying said first or projectile's associated nominal Air Density ballistic characteristics (e.g., 4 kDA); (c) sensing a LOS range to a target, based on the range to the target and the nominal air density ballistic characteristics of the first or second selected projectile, determining a yardage equivalent aiming adjustment or EHP for the projectile weapon and displaying, illuminating of highlighting one or two sloped wind dot lines corresponding to or bracketing the EHP range (d) determining a windage hold point, based on any crosswind sensed or perceived, and (e) aiming the rifle or projectile weapon using the displayed EHP yardage equivalent derived sloped row of windage aiming dots (e.g., for 800 yds when EHP is 800 yds) for elevation hold-off and choosing one or more of the wind dots in the sloped wind dot array to estimate the optimum windage hold point.

Having described preferred embodiments of a new and improved reticle and method, it is believed that other modifications, variations and changes will be suggested to those skilled in the art in view of the teachings set forth herein. It is therefore to be understood that all such variations, modifications and changes are believed to fall within the scope of the present invention as set forth in the following claims.

What is claimed is:

1. A range-finding and compensating scope assembly with a ballistic effect compensating reticle including a system to display aiming indicia for a rifle firing a first selected spin stabilized projectile under sensed or known local atmospheric and wind conditions, comprising:

(a) a ballistics effect compensating reticle display field having a horizontal crosshair indicia array aligned on a horizontal crosshair axis and being disposed or projected along an optical path and viewable by a shooter and (b) a laser signal emitter communicating with a microprocessor in operative communication with a range finding signal detector; wherein said microprocessor is programmed to generate a microprocessor-generated sensed Line of Sight Range signal for communication to an optical display element located along the optical path, wherein said optical display element generates a targeting display image upon said reticle display field representing a sensed and corrected Effective Hold Point range to a target;

wherein said ballistics effect compensating reticle display field is viewable through the range-finding and compensating scope assembly, and said ballistics effect compensating reticle display field includes a plurality of aiming points disposed thereupon, said plurality of aiming points including a first array of windage aiming marks spaced apart along a non-horizontal axis for wind-adjusted aim at a first predetermined range, wherein said first array of windage aiming marks define a first sloped row of windage aiming points; said first sloped row of windage aiming points being aligned along said non-horizontal axis which is positioned below and not parallel to said horizontal crosshair indicia array axis, wherein said first sloped row of windage aiming points has a slope which is a function of the direction and velocity of the first selected projectile's stabilizing spin and provides compensated aiming indicia for said first selected projectile's crosswind jump at said sensed and corrected Effective Hold Point range.

2. The range-finding and compensating scope assembly of claim 1, wherein said ballistics effect compensating reticle display field's first array of windage aiming marks correspond to a plurality of predetermined wind velocity conditions at a first predetermined Effective Hold Point range;

wherein said reticle display field's first array of windage aiming marks at said predetermined wind velocity conditions and said first predetermined Effective Hold Point range correspond to a predetermined baseline atmospheric condition.

3. The range-finding and compensating scope assembly of claim 2, wherein said reticle display field's first array of windage aiming marks at said predetermined wind velocity conditions and said first predetermined Effective Hold Point range correspond to a predetermined baseline air density.

4. The range-finding and compensating scope assembly of claim 3, wherein said reticle display field includes a second array of windage aiming marks aligned along a second sloped axis which is substantially parallel to but above or below said first array of windage aiming marks, wherein said second array of windage aiming marks defines a second sloped row of windage aiming points at said predetermined wind velocity conditions and at said sensed and corrected Effective Hold Point range.

5. The range-finding and compensating scope assembly of claim 4, wherein said reticle display field further comprises additional arrays of windage aiming marks at said predetermined wind velocity conditions and at a plurality of predetermined Effective Hold Point ranges corresponding to additional selected points of aim for additional selected ranges.

6. The range-finding and compensating scope assembly of claim 1, wherein ballistic compensation information comprising at least one of (a) a sensed or measured Line of Sight Range, (b) a sensed or measured slope angle, (c) a sensed or measured crosswind speed, and (d) a sensed or measured atmospheric condition is either programmed into the microprocessor or defined in the alignment of the first array of windage aiming marks.

7. The range-finding and compensating scope assembly of claim 6, wherein the ballistic compensation information is encoded into the plurality of aiming points disposed upon said ballistics effect compensating reticle display field, wherein the encoding is done via display of an air density correction encoding scheme that comprises an array of range-specific density correction pointers being displayed on said ballistics effect compensating reticle display field at selected ranges.

8. The range-finding and compensating scope assembly of claim 6, wherein said first selected projectile is fired at a selected standard initial muzzle velocity, whereby said first selected projectile when fired at the selected standard initial muzzle velocity is assigned a nominal Density Altitude ("DA") baseline or index value and wherein a second selected projectile from a different type of ammunition may be fired from said rifle at said assigned nominal DA baseline or index value for selected target surfaces out to a sensed and corrected Effective Hold Point range of 900 yards.

9. The range-finding and compensating scope assembly of claim 1, wherein said plurality of aiming points positioned for ballistic effects compensated aim at said sensed and corrected Effective Hold Point range comprising said first array of windage aiming marks spaced apart along said non-horizontal axis at lateral spacings corresponding to selected increments of lateral wind velocity.

10. The range-finding and compensating scope assembly of claim 9, wherein said plurality of aiming points positioned for ballistic effects compensated aim at said sensed and corrected Effective Hold Point range further comprise a second array of windage aiming marks which is spaced from said first array of windage aiming marks, said second array of windage aiming marks spaced apart along a second non-horizontal axis at said lateral spacings corresponding to said selected increments of lateral wind velocity of said first array of windage aiming marks.

11. A method for sensing a Line of Sight ("LOS") range to a selected target surface when using a selected rifle firing a first selected ammunition and generating a reticle display for a shooter which provides environmental and ballistically corrected aim points for sensed or measured local atmospheric conditions including crosswind velocities, comprising:

providing a range-finding and compensating scope assembly and system with a ballistic effect compensating reticle display field disposed or projected along an optical path within said range-finding and compensating scope assembly and system and viewable by the shooter, said system also including a range-finding signal emitter communicating with a microprocessor programmed to generate a signal communicated to an optical element establishing a projected targeting display image upon said ballistics effect compensating reticle display field representing a sensed and corrected Effective Hold Point ("EHP") range corresponding to a sensed range to the selected target surface; wherein said ballistic effect compensating reticle display field is viewable through the scope assembly, and said ballistics effect compensating reticle display field includes a main aiming point in a horizontal crosshair indicia array axis and above a plurality of downrange aiming points positioned for ballistic effects compensated aim at the EHP range and a range of crosswind speeds and including at least a first array of windage aiming marks spaced apart along a first non-horizontal axis, wherein said first array of windage aiming marks define at least a sloped row of windage aiming points, wherein said first non-horizontal axis is not parallel to said horizontal crosshair indicia array axis;

actuating a first Range Finder aiming display mode in which said range finding signal emitter is aimed at the selected target surface by aiming or aligning the ballistics effect compensating reticle display field main aiming point directly at or upon said selected target surface while the Line of Sight (LOS) range is sensed;

calculating a sensed and corrected Display Effective Hold Point range from the LOS range and selected additional information including, optionally, slope angle, air density, and ammunition ballistics information; and in response to said calculation, actuating a second display mode for shooting wherein at least said sloped row of windage aiming points is displayed or highlighted, at least said sloped row of windage aiming points corresponding to said sensed and corrected Display Effective Hold Point range for engaging said selected target surface to provide the environmentally and ballistically corrected aim points for selected crosswind velocities at said sensed and corrected Display Effective Hold Point range.

12. The method for sensing the Line of Sight ("LOS") range to the selected target surface when using the selected rifle firing the first selected ammunition and generating the reticle display of claim 11, wherein said step of calculating said sensed and corrected Display Effective Hold Point range includes:

identifying, for a first selected projectile of the first selected ammunition, said first selected projectile's associated nominal Air Density ballistic characteristics and current environmental air density characteristics;

determining, from said LOS range to the selected target surface, the nominal air density ballistic characteristics of the first selected projectile and the current environmental air density characteristics, a yardage equivalent aiming adjustment value "Delta Yard" for the selected rifle and said first selected projectile; and calculating said sensed and corrected Display Effective Hold Point range from the LOS range and the yardage equivalent aiming adjustment value "Delta Yard".

13. The method for sensing the Line of Sight ("LOS") range to the selected target surface when using the selected rifle firing the first selected ammunition and generating the reticle display of claim 12, wherein said step of calculating said sensed and corrected Display Effective Hold Point range includes:

identifying the slope angle encountered while aiming at the selected target surface;

determining, from said slope angle and said LOS range to the selected target surface, a cosine range aiming adjustment; and calculating said sensed and corrected Display Effective Hold Point range from the LOS range and the cosine range aiming adjustment.

14. The method for sensing the Line of Sight ("LOS") range to the selected target surface when using the selected rifle firing the first selected ammunition and generating the reticle display of claim 11, further comprising:

in response to the calculation of said sensed and corrected Display Effective Hold Point range, when actuating said second display mode for shooting, displaying a second array of windage aiming marks proximate said first array of windage aiming marks to provide upper and lower arrays of windage aiming marks which bracket the sensed and corrected Display Effective Hold Point range for said selected crosswind velocities.

15. The method for sensing the Line of Sight ("LOS") range to the selected target surface when using the selected rifle firing the first selected ammunition and generating the reticle display of claim 14, further comprising:

selecting, for said sensed or measured local atmospheric conditions, a windage hold point corresponding most closely to a closest or optimum windage aiming mark from said second array of windage aiming marks; and displaying a highlighted or illuminated windage aiming point corresponding to said optimum windage aiming mark at said sensed and corrected Display Effective Hold Point range in said reticle display.

16. The method for sensing the Line of Sight ("LOS") range to the selected target surface when using the selected rifle firing the first selected ammunition and generating the reticle display of claim 11, further comprising:

displaying a numerical value corresponding to said sensed and corrected Display Effective Hold Point range in said reticle display.

17. The method for sensing the Line of Sight ("LOS") range to the selected target surface when using the selected rifle firing the first selected ammunition and generating the reticle display of claim 11, further comprising:

selecting, for said sensed or measured local atmospheric conditions, a windage hold point corresponding most closely to a closest or optimum windage aiming mark from said first array of windage aiming marks spaced apart along said first non-horizontal axis defining said sloped row of windage aiming points; and displaying a highlighted or illuminated windage aiming point corresponding to said optimum windage aiming mark at said sensed and corrected Display Effective Hold Point range in said reticle display.

* * * * *